US011591193B2

(12) United States Patent
Desormeau et al.

(10) Patent No.: US 11,591,193 B2
(45) Date of Patent: Feb. 28, 2023

(54) TELESCOPING JACK FOR LIFTING LARGE CAPACITY TRUCKS

(71) Applicant: NORDIC MINESTEEL TECHNOLOGIES INC., North Bay (CA)

(72) Inventors: Wayne Desormeau, Callander (CA); Jeff Weaver, Goderich (CA); Guy Mathieu, North Bay (CA)

(73) Assignee: NORDIC MINESTEEL TECHNOLOGIES INC., North Bay (CA)

( * ) Notice: Subject to any disclaimer, the term of this patent is extended or adjusted under 35 U.S.C. 154(b) by 0 days.

(21) Appl. No.: 17/745,613

(22) Filed: May 16, 2022

(65) Prior Publication Data

US 2022/0274815 A1 Sep. 1, 2022

Related U.S. Application Data

(63) Continuation of application No. 16/725,991, filed on Dec. 23, 2019, now Pat. No. 11,332,350, which is a continuation-in-part of application No. 16/510,946, filed on Jul. 14, 2019, now Pat. No. 11,479,450, (Continued)

(51) Int. Cl.

*B66F 3/30* (2006.01)
*B66F 3/36* (2006.01)

(Continued)

(52) U.S. Cl.

CPC ..... *B66F 3/30* (2013.01); *B66F 3/36* (2013.01); *B66F 3/44* (2013.01); *B66F 5/04* (2013.01); *B66F 2700/05* (2013.01)

(58) Field of Classification Search

CPC .... B66F 1/00; B66F 1/02; B66F 1/025; B66F 1/08; B66F 3/28; B66F 3/30; B66F 3/24;

(Continued)

(56) References Cited

U.S. PATENT DOCUMENTS 2,369,838 A 2/1945 Minnis
2,624,543 A * 1/1953 Jackson ..... B66F 5/04 254/8 B (Continued)

FOREIGN PATENT DOCUMENTS

CA 2714047 2/2012
CA 2714047 A1 2/2012

(Continued)

OTHER PUBLICATIONS

Australian Patent Office, Examination Report, dated Sep. 29, 2021, for corresponding/related Australian Patent Application No. 2020281125.

(Continued)

*Primary Examiner* — Joseph J Hail
*Assistant Examiner* — Timothy Brady
(74) *Attorney, Agent, or Firm* — Conneely PC; Joseph Conneely

(57) ABSTRACT

A jack, comprising: a top plate adapted to contact a load; a base plate positioned below the top plate; at least one actuator coupled perpendicularly between the base plate and the top plate; wherein the at least one actuator is operable to move the top plate between a lowered position and a raised position to thereby lower and raise the load; and, at least one locking assembly adapted to lock the top plate in the raised position.

20 Claims, 67 Drawing Sheets

Related U.S. Application Data which is a continuation-in-part of application No. 15/589,947, filed on May 8, 2017, now Pat. No. 10,513,423, which is a continuation-in-part of application No. 15/589,947, filed on May 8, 2017, now Pat. No. 10,513,423.

(51) Int. Cl.
*B66F 3/44* (2006.01)
*B66F 5/04* (2006.01)

(58) Field of Classification Search
CPC ..... B66F 3/25; B66F 3/36; B66F 3/38; B66F 3/44; B66F 5/00; B66F 5/04; B66F 7/00; B66F 7/04; B66F 7/08; B66F 7/16; B66F 7/18; B66F 7/26; B66F 7/28; B66F 7/085; B66F 11/00; B66F 13/00; B66F 17/00
USPC ..... 60/325
See application file for complete search history.

(56) References Cited

U.S. PATENT DOCUMENTS 2,891,765 A * 6/1959 Pearne ..... B66F 5/04 60/426
2,904,308 A 9/1959 Vergara
2,956,645 A * 10/1960 Halstead ..... B66F 7/18 187/221
3,110,476 A * 11/1963 Farris ..... B66F 7/08 187/269
3,220,698 A 11/1965 Carder
3,713,515 A * 1/1973 Hott ..... B66F 7/18 187/217
3,865,214 A * 2/1975 Clark ..... B66F 7/08 254/91
4,005,850 A * 2/1977 Myers ..... B66F 5/04 254/2 R
4,123,038 A * 10/1978 Meyers ..... B66F 19/00 414/427
4,212,374 A 7/1980 Bubik
4,330,105 A 5/1982 Gallagher
4,447,042 A * 5/1984 Masui ..... B66F 7/0675 187/217
4,491,194 A * 1/1985 Mountz ..... B66F 7/28 254/93 L
4,697,788 A * 10/1987 Arzouman ..... B66F 1/06 254/8 B
4,724,930 A * 2/1988 VanLierop ..... B66F 7/065 187/206
4,794,783 A * 1/1989 Eck ..... B21D 1/14 72/705
4,815,712 A * 3/1989 Kawada ..... B66F 3/46 187/211
4,830,147 A * 5/1989 Kawada ..... B66F 7/08 254/122
4,899,987 A * 2/1990 Craig ..... B66F 7/065 254/122
4,901,980 A * 2/1990 Hansen ..... B66F 7/08 254/90
4,909,357 A * 3/1990 Kawada ..... B66F 7/08 187/207
4,921,074 A * 5/1990 Ochs ..... B66F 7/26 187/207
5,031,726 A * 7/1991 Wakamiya ..... B66F 7/26 187/219
5,131,500 A * 7/1992 Hernick ..... B66F 7/26 254/90
5,156,238 A * 10/1992 Matthews ..... B66F 7/0625 254/89 R
5,183,235 A * 2/1993 Arzouman ..... B66F 5/04 403/328
5,190,122 A * 3/1993 Fletcher ..... B66F 7/08 74/519
5,406,880 A 4/1995 Haller
5,419,533 A * 5/1995 Barta ..... B66F 3/30 254/93 H
5,690,315 A * 11/1997 Thomas ..... B66F 3/24 254/2 C
5,878,996 A * 3/1999 Loan ..... B66F 5/04 254/8 B
6,059,263 A * 5/2000 Otema ..... B66F 7/08 254/1 OR
6,182,796 B1 * 2/2001 Perlstein ..... B66F 7/065 187/219
6,186,279 B1 * 2/2001 Blocker ..... B66F 7/08 187/206
6,305,668 B1 10/2001 Edens
6,601,430 B2 * 8/2003 McClellan ..... B66F 7/0658 72/457
6,729,032 B2 5/2004 Granata
7,134,643 B1 * 11/2006 Williams ..... B66F 5/04 254/1 OR
7,343,846 B2 3/2008 Stanford et al.
7,343,849 B2 3/2008 Asaba
D596,823 S * 7/2009 Thurm ..... D34/28
7,581,713 B1 * 9/2009 Voss ..... B66F 3/25 254/2 B
7,871,064 B2 1/2011 Dailey et al.
8,262,064 B2 9/2012 Knestel et al.
9,254,990 B2 * 2/2016 Matthews ..... B66F 7/08
9,796,569 B2 10/2017 Katerberg et al.
9,889,787 B2 * 2/2018 Thomas ..... B66F 7/28
10,023,446 B2 * 7/2018 Cudney ..... B66F 7/0625
10,513,423 B2 12/2019 Desormeau et al.
2006/0157678 A1 * 7/2006 Lin ..... B66F 5/04 254/8 B
2006/0163007 A1 7/2006 Bukowski et al.
2008/0224107 A1 * 9/2008 Polins ..... B66F 7/0666 254/45
2009/0230368 A1 9/2009 Marsh et al.
2009/0321189 A1 12/2009 Schmitt
2010/0012909 A1 * 1/2010 Lee ..... B66F 7/085 254/93 R
2010/0243973 A1 * 9/2010 Deuring ..... B66F 7/065 254/122
2010/0295261 A1 11/2010 Ellington
2011/0001098 A1 1/2011 Lee
2011/0253955 A1 * 10/2011 Gann ..... B66F 5/02 254/1 OR
2011/0278517 A1 * 11/2011 Deuring ..... B66F 7/065 254/122
2012/0034055 A1 2/2012 Leonard
2012/0048653 A1 * 3/2012 Matthews ..... B66F 7/08 187/211
2012/0112143 A1 * 5/2012 Gann ..... B66F 5/04 254/1
2012/0181494 A1 * 7/2012 Guyard ..... B66F 3/00 254/385
2012/0223280 A1 * 9/2012 Zhou ..... B66F 5/04 254/8 B
2012/0223281 A1 * 9/2012 Zhou ..... B66F 3/36 254/93 R
2013/0240300 A1 * 9/2013 Fagan ..... B66F 7/10 187/203
2013/0240812 A1 * 9/2013 Helmich ..... B66F 3/46 254/89 H
2013/0256610 A1 * 10/2013 Tijerina ..... B66F 5/04 254/108
2014/0219768 A1 * 8/2014 Holtman ..... B66F 5/04 414/800
2015/0034893 A1 * 2/2015 Bacon ..... B66F 3/46 254/290
2015/0102276 A1 4/2015 Juanjuan
2015/0123053 A1 * 5/2015 Arzouman ..... B66F 1/08 254/2 B
2015/0232309 A1 * 8/2015 Jaipaul ..... B66F 7/04 414/800

(56) References Cited

U.S. PATENT DOCUMENTS

| | | | | |
|---|---|---|---|---|
| 2015/0314988 | A1* | 11/2015 | Lowe | B66F 7/0666 187/269 |
| 2016/0039647 | A1* | 2/2016 | Katerberg | B66F 7/20 254/93 L |
| 2016/0280518 | A1 | 9/2016 | Kamphuis et al. | |
| 2016/0376134 | A1* | 12/2016 | Xiaoxian | B62D 5/02 180/216 |
| 2017/0015510 | A1* | 1/2017 | Ripperda | B61D 7/32 |
| 2017/0174188 | A1 | 6/2017 | Bennett | |
| 2017/0297472 | A1* | 10/2017 | Thomas | B66F 9/07577 |
| 2017/0313559 | A1* | 11/2017 | Lauderbaugh | B66F 3/24 |
| 2018/0118537 | A1* | 5/2018 | Goodsell | B66F 3/42 |
| 2018/0290634 | A1* | 10/2018 | Belley | B66F 5/04 |
| 2018/0319638 | A1 | 11/2018 | Desormeau et al. | |
| 2019/0337780 | A1 | 11/2019 | Desormeau et al. | |
| 2020/0156910 | A1* | 5/2020 | Tijerina | B66F 5/04 |

FOREIGN PATENT DOCUMENTS

| | | | |
|---|---|---|---|
| CA | 2912516 | | 12/2014 |
| CA | 2967492 | A1 | 6/2016 |
| CA | 2998248 | | 7/2018 |
| CN | 2743319 | | 8/2004 |
| CN | 104259167 | A | 1/2015 |
| KR | 100578574 | | 5/2006 |
| WO | 0056638 | | 9/2000 |
| WO | 2016086300 | | 6/2016 |

OTHER PUBLICATIONS

International Searching Authority (ISA/CA), International Search Report and Written Opinion, dated Feb. 23, 2021, for corresponding/related International Patent Application No. PCT/CA2020/000128.

International Searching Authority (ISA/CA), International Search Report and Written Opinion, dated Mar. 3, 2020, for corresponding International Patent Application No. PCT/CA2019/000139.

International Searching Authority (ISA/CA), International Search Report and Written Opinion, dated Jan. 15, 2018, for corresponding International Patent Application No. PCT/CA2017/000119.

* cited by examiner

Section A-A

SECTION A-A

SECTION A-A

SECTION A-A

TELESCOPING JACK FOR LIFTING LARGE CAPACITY TRUCKS

This application is a continuation of U.S. patent application Ser. No. 16/725,991, filed Dec. 23, 2019, which is a continuation-in-part of U.S. patent application Ser. No. 15/589,947, filed May 8, 2017, and a continuation-in-part of U.S. patent application Ser. No. 16/510,946, filed Jul. 14, 2019, which is a continuation-in-part of U.S. patent application Ser. No. 15/589,947, filed May 8, 2017, and the entire content of such applications is incorporated herein by reference.

FIELD OF THE APPLICATION

This application relates to the field of jacks, and more specifically, to a telescoping jack for lifting large capacity trucks, such as open pit mining haulage trucks, and the like.

BACKGROUND

Large capacity open pit mining haulage trucks require lifting or jacking to replace worn out or flat tires, for example. Currently, a single lifting ram or cylinder based jack is typically used for this purpose.

However, existing single cylinder jacks have several disadvantages. First, the single cylinder is often heavy and awkward to handle and as such may cause operator injuries and strains. Second, the operator typically needs to stand under the truck while operating the jack and as such the operator may be injured by falling debris from the undercarriage of the truck. Third, the operator is typically required to lock the lifted truck via safety stands or lock collars while positioned under the lifted truck, which may be dangerous. Fourth, existing jacks are slow to operate typically requiring approximately 20 to 30 minutes per lift. Fifth, as typically only one point or corner is lifted at a time by existing jacks, the lifted truck or load may become unstable when the entire front or rear is lifted at one time. Sixth, existing jacks are often unstable when subjected to side loading, for example, when a tire is pulled off the lifted truck. Finally, the cylinders of existing jacks are typically driven by an airline which may freeze up in cold climates.

Under pressure to improve both safety and efficiency while lifting and securing the largest haulage trucks (e.g., up to 400 ton) in the world, mining companies require a safe and cost effective jack for their truck maintenance needs.

A need therefore exists for an improved jack for lifting large capacity trucks and the like. Accordingly, a solution that addresses, at least in part, the above and other shortcomings is desired.

SUMMARY OF THE APPLICATION

According to one aspect of the application, there is provided a jack, comprising: a top plate adapted to contact a load; an intermediate plate positioned below the top plate, the intermediate plate having a channel formed therein; a base plate positioned below the intermediate plate; a first pair of actuators coupled between the base plate and the intermediate plate, one of the first pair of actuators positioned on either side of the channel; and, a second pair of actuators coupled between the channel of the intermediate plate and the top plate; wherein the first and second pairs of actuators are operable to move the top plate and the intermediate plate between respective lowered positions and respective raised positions to thereby lower and raise the load.

According to another aspect of the application, there is provided a jack, comprising: a top plate having at least one adapter block mounted thereon and adapted to contact a load; an intermediate plate positioned below the top plate; a base plate positioned below the intermediate plate; a first pair of actuators coupled between the base plate and the intermediate plate; and, a second pair of actuators coupled between respective lowered portions of the intermediate plate and the top plate; wherein one of the first pair of actuators is positioned on the base plate on either side of the respective lowered portions of the intermediate plate; wherein the first and second pairs of actuators are operable to move the top plate and the intermediate plate between respective lowered positions and respective raised positions to thereby lower and raise the load; and, wherein a top adapter plate of the at least one adapter block is operable to slide between first and second positions on the top plate as the load is raised and lowered to thereby maintain alignment of the top, intermediate, and base plates below the load.

According to another aspect of the application, there is provided a jack, comprising: a top plate adapted to contact a load; a base plate positioned below the top plate; at least one actuator coupled perpendicularly between the base plate and the top plate; wherein the at least one actuator is operable to move the top plate between a lowered position and a raised position to thereby lower and raise the load; and, at least one locking assembly adapted to lock the top plate in the raised position; wherein the at least one locking assembly includes a locking bar and a ratchet rack, the locking bar having an upper end and a lower end, the locking bar hinge mounted at the upper end proximate to the top plate, the ratchet rack inclining upward from the base plate toward the top plate and having at least one notch formed therein, the at least one notch adapted to receive and lock the lower end of the locking bar, and the lower end of the locking bar slidable up the ratchet rack and into the at least one notch as the top plate is moved from the lowered position to the raised position.

According to another aspect of the application, there is provided a locking assembly for a jack, the jack having a top plate adapted to contact a load, a base plate positioned below the top plate, and at least one actuator coupled perpendicularly between the base plate and the top plate and operable to move the top plate between a lowered position and a raised position to lower and raise the load, the locking assembly comprising: a ratchet rack, the ratchet rack inclining upward from the base plate toward the top plate and having at least one notch formed therein; and, a locking bar, the locking bar having an upper end and a lower end, the locking bar hinge mounted at the upper end proximate to the top plate; wherein the at least one notch is adapted to receive and lock the lower end of the locking bar, the lower end of the locking bar slidable up the ratchet rack and into the at least one notch as the top plate is moved from the lowered position to the raised position to thereby lock the top plate in the raised position.

BRIEF DESCRIPTION OF THE DRAWINGS

Features and advantages of the embodiments of the present application will become apparent from the following detailed description, taken in combination with the appended drawings, in which.

It will be noted that throughout the appended drawings, like features are identified by like reference numerals.

DETAILED DESCRIPTION OF THE EMBODIMENTS

Figure 1:
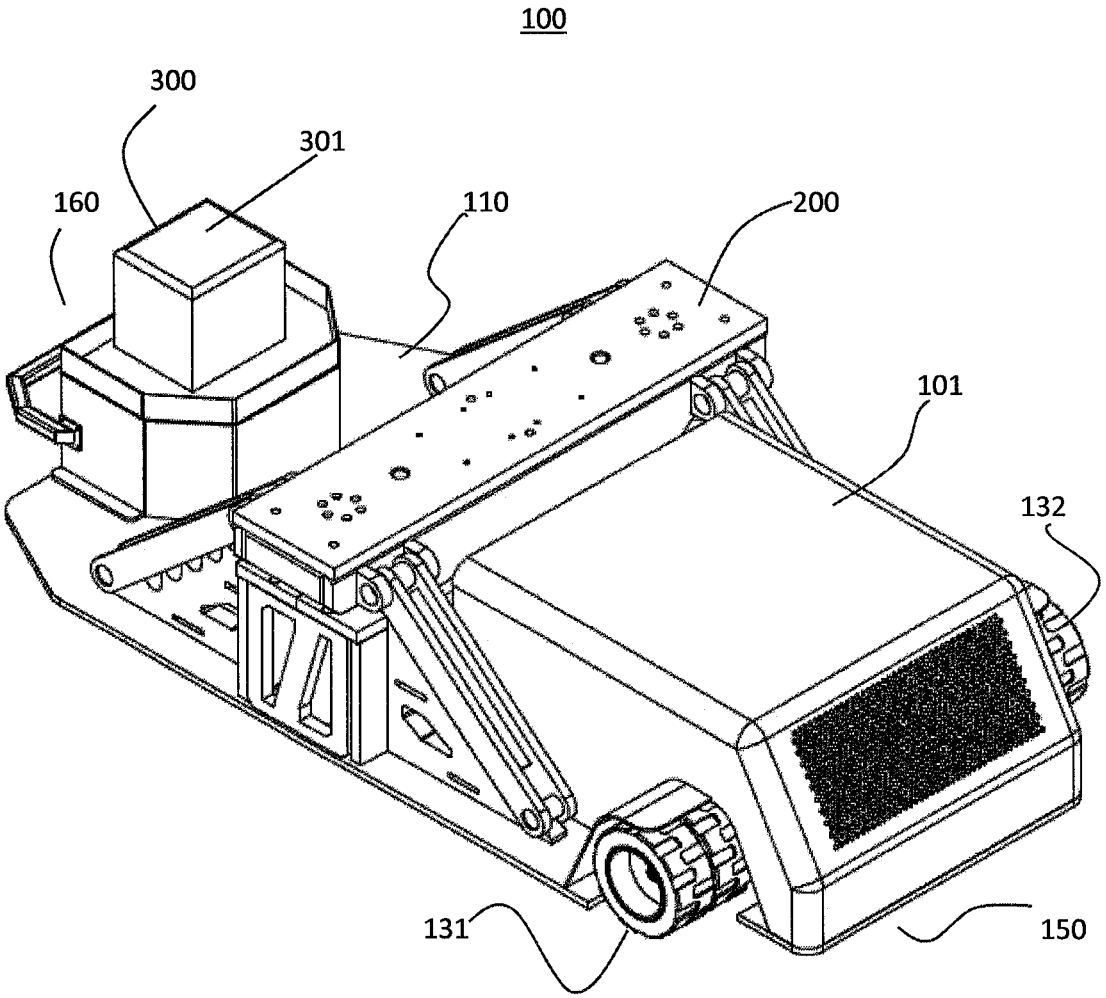
FIG. 1 is a front perspective view illustrating a jack in accordance with an embodiment of the application.

In the following description, details are set forth to provide an understanding of the application. In some instances, certain structures, techniques and methods have not been described or shown in detail in order not to obscure the application.

The jack 100 of the present application provides an integrated truck lifting solution. The jack 100 provides for reduced truck maintenance costs by reducing the time required to lift trucks for tire changing, repair, etc. In particular, according to one embodiment, the present application provides a jack 100 having a total collapsed height of approximately 33 inches with the ability to lift and extend linearly approximately 30 inches for a total working extend height of approximately 63 inches. This allows the jack 100 to fit under and lift a range of differently sized large capacity open pit mining haulage trucks 1000. In addition, the jack 100 has multiple visual secondary mechanical locking assemblies 810, 820, 830, 840 that may support the entire load of a lifted truck 1000 (e.g., 220 tons or 440,000 lbs, etc.). The secondary mechanical locking assemblies 810, 820, 830, 840 are visible to an operator of the jack 100 who may be positioned at a safe distance away from the truck 1000 as it is lifted. Furthermore, the jack 100 may be remotely controlled to lift and lock a truck 1000 using a handheld remote control unit 8000 (see FIG. 80) or the like.

The jack 100 is a mobile lifting and locking device designed to lift and lock in an elevated position, large capacity trucks including both 300 and 400 ton open pit mining haulage trucks. Advantageously, the jack 100 will work on both sizes of trucks. The jack 100 includes a remote control unit 8000 that allows an operator to maneuver the jack 100 under a truck (or other load) 1000, lift the truck 1000, and lock the truck 1000 in a raised position (e.g., 1600, 2000) without the operator having to venture underneath the truck 1000.

Figure 2:
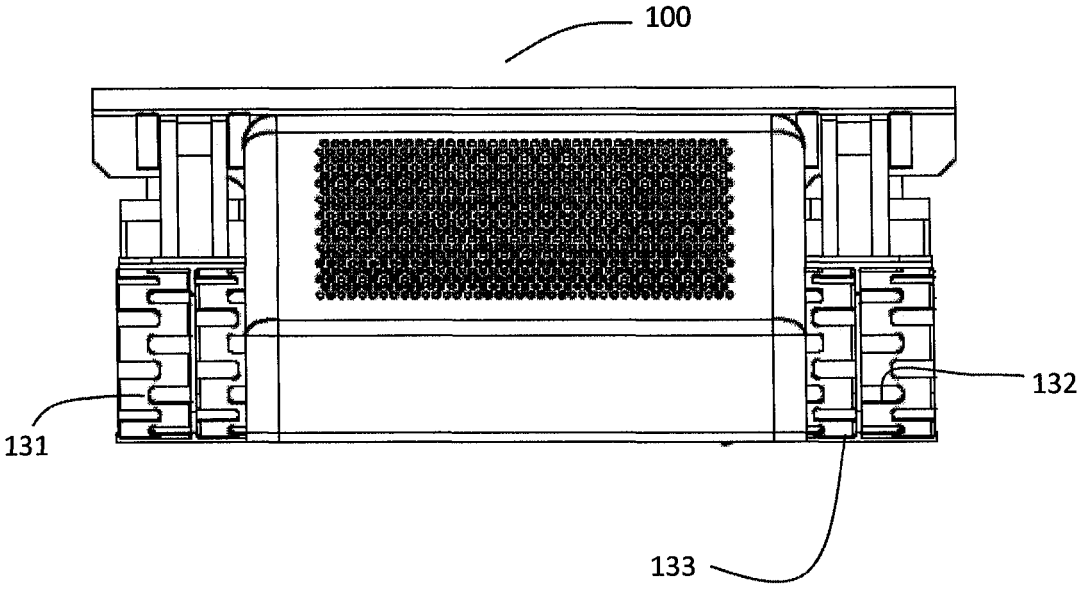
FIG. 2 is a front view thereof.
Figure 3:
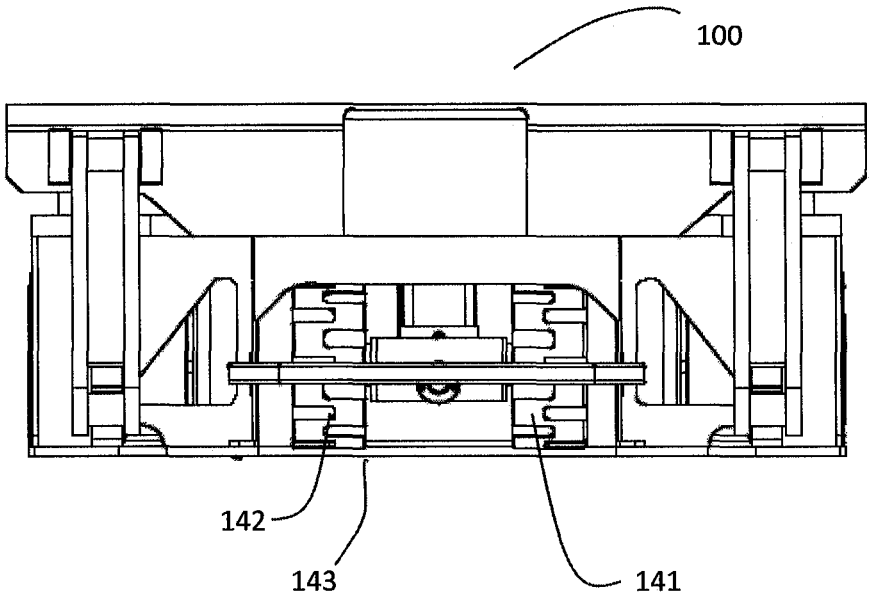
FIG. 3 is a rear view thereof.
Figure 4:
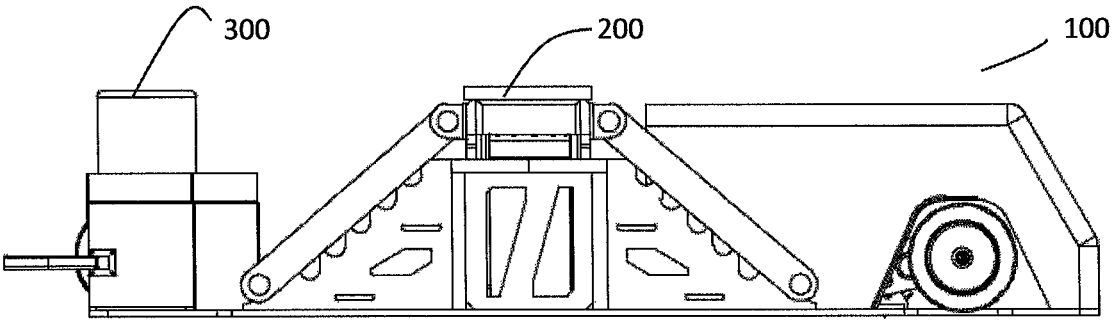
FIG. 4 is a left side view thereof.
Figure 5:
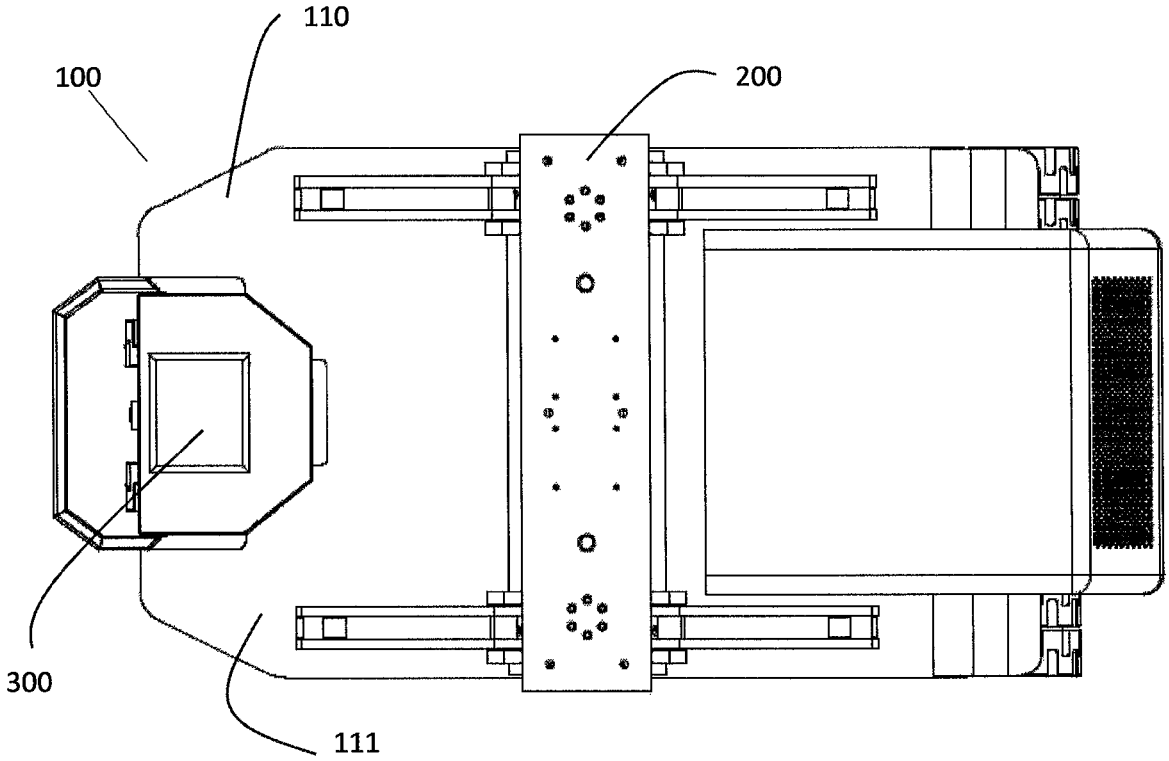
FIG. 5 is a top view thereof.
Figure 6:
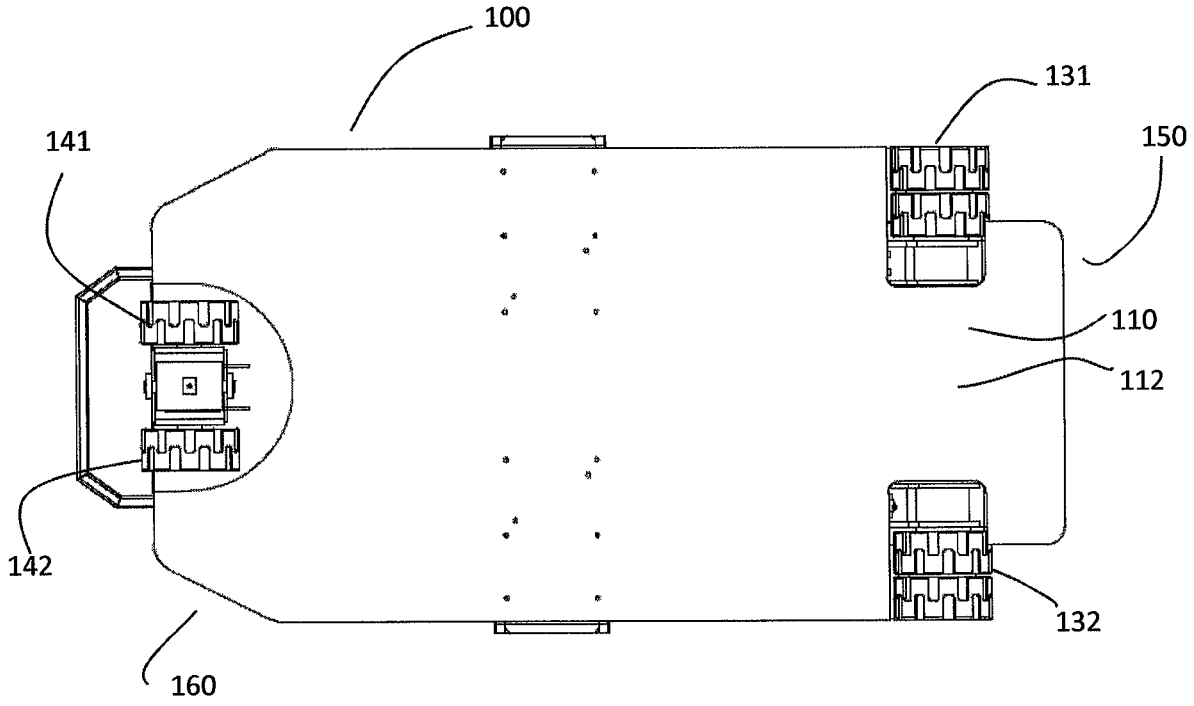
FIG. 6 is a bottom view thereof.

FIG. 1 is a front perspective view illustrating a jack 100 in accordance with an embodiment of the application. FIG. 2 is a front view thereof. FIG. 3 is a rear view thereof. FIG. 4 is a left side view thereof. FIG. 5 is a top view thereof. And, FIG. 6 is a bottom view thereof.

Figure 10:
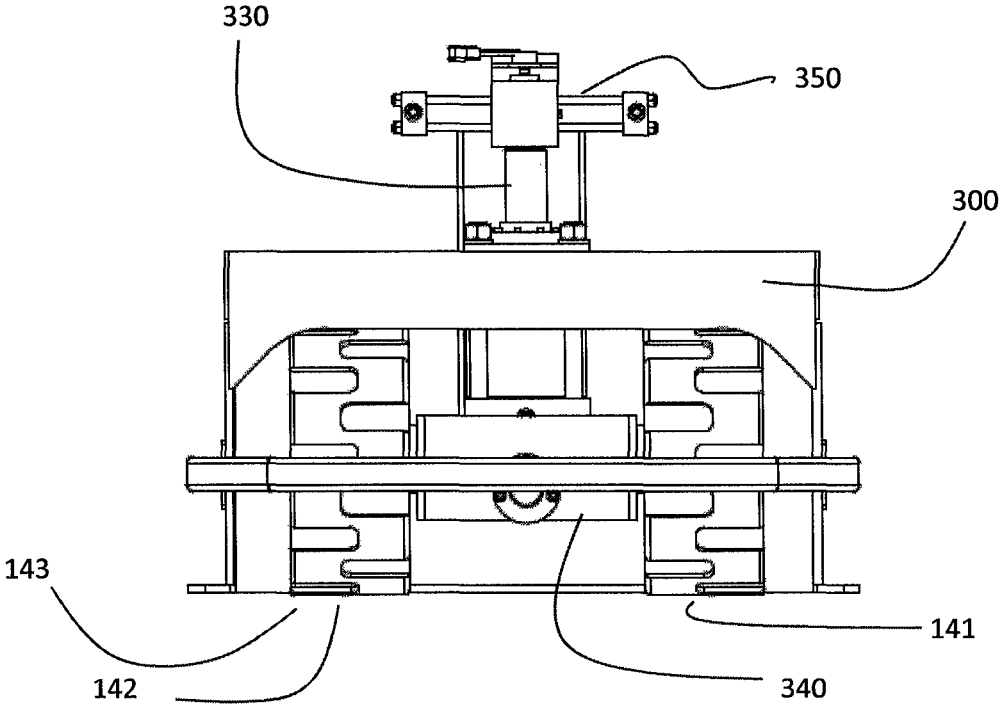
FIG. 10 is a front view thereof with the rear wheels shown in a retracted position.
Figure 11:
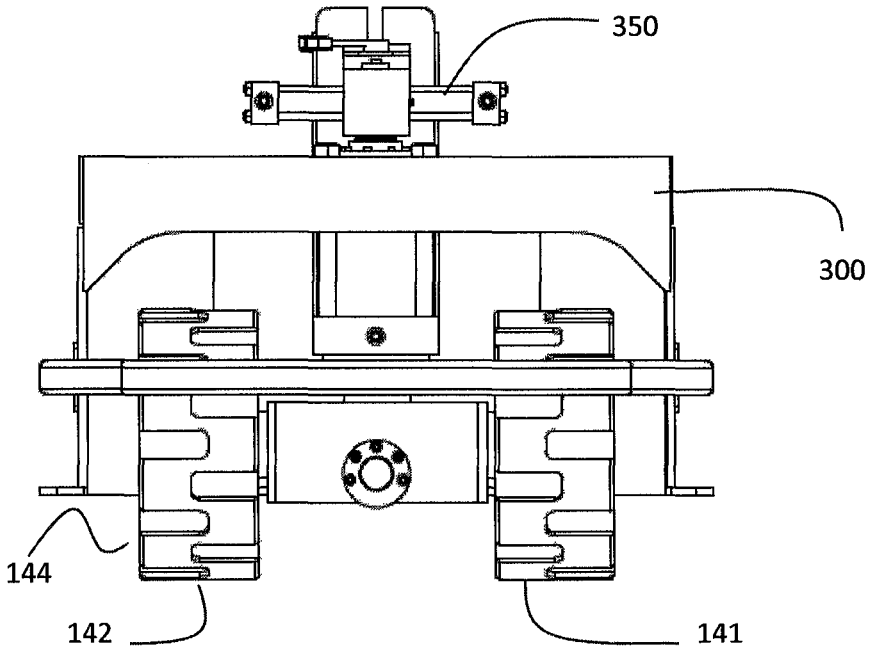
FIG. 11 is a rear view thereof with the rear wheels shown in an extended position.

According to one embodiment of the application, the jack 100 may include: a chassis, frame, or base plate 110 having an upper surface 111 and a lower surface 112; a main lifting assembly 200 mounted on the upper surface 111 of the base plate 110; first and second retractable front wheels 131, 132 mounted to the upper surface 111 of the base plate 110 at the front end 150, the front wheels 131, 132 movable from a retracted position 133 as shown in FIGS. 1-6 to an extended position (not shown); a rear strut, steering, and walking beam assembly 300 mounted on the upper surface 111 of the base plate 110 at the rear end 160; and, first and second retractable rear wheels 141, 142 mounted within the rear strut, steering, and walking beam assembly 300, the rear wheels 141, 142 movable from a retracted position 143 as shown in FIG. 10 to an extended position 144 as shown in FIG. 11 (described below). The structural components (e.g., the base plate 110, the main lifting assembly 200, etc.) of the jack 100 are typically made of metal (e.g., steel, etc.).

Figure 7:
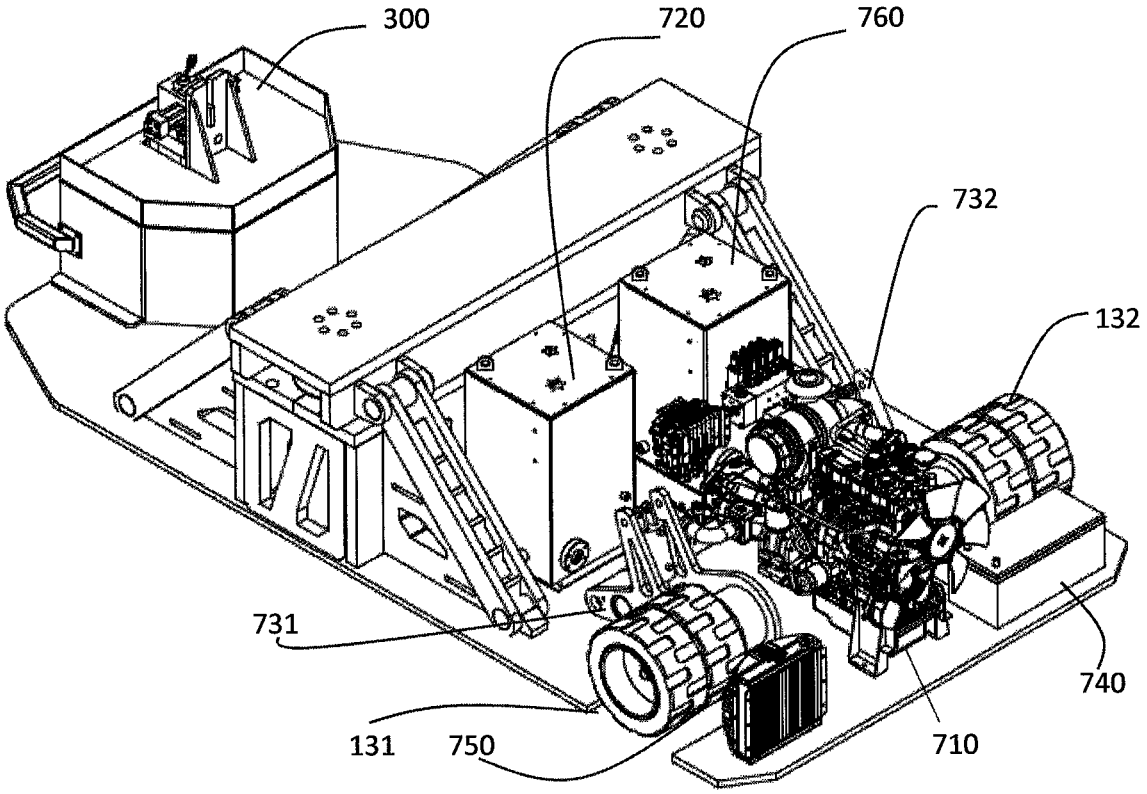
FIG. 7 is a front perspective view illustrating the jack of FIG. 1 with the front hood and rear hood removed in accordance with an embodiment of the application.
Figure 8:
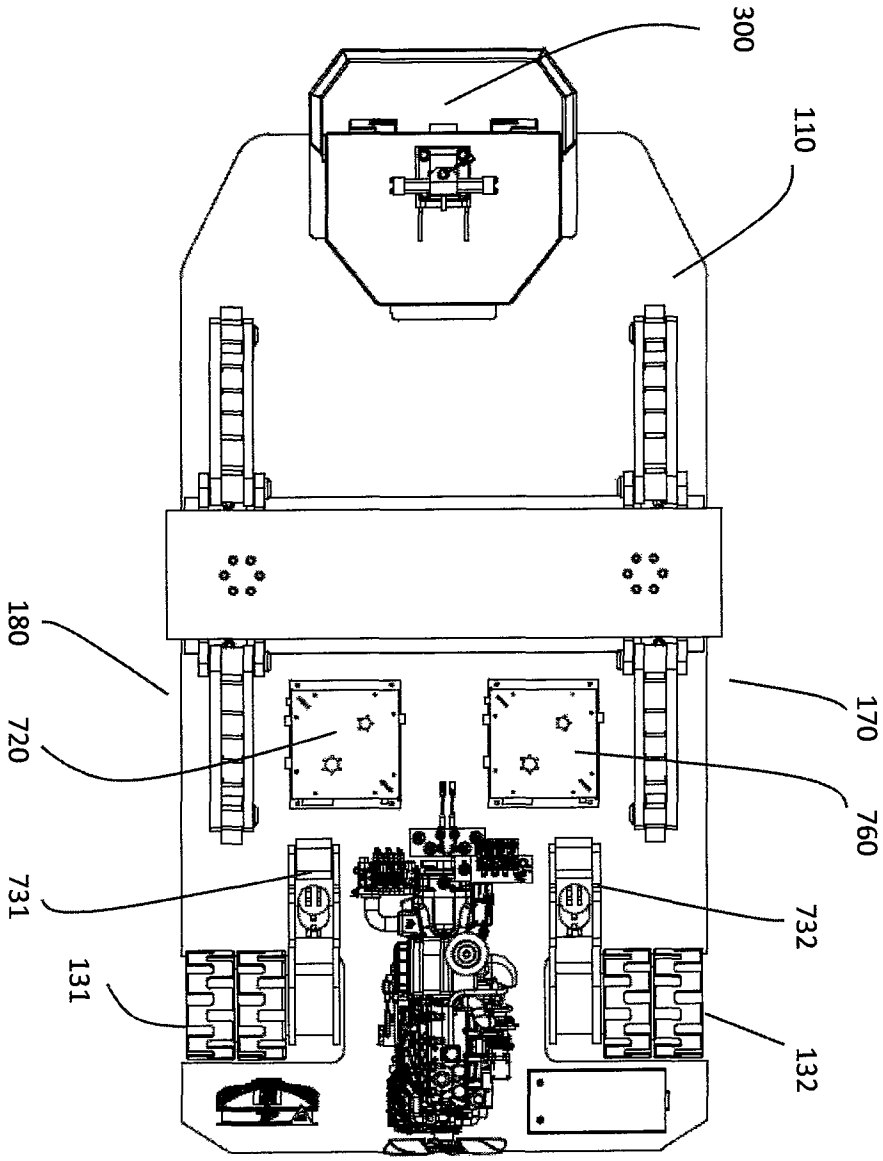
FIG. 8 is a top view thereof.

FIG. 7 is a front perspective view illustrating the jack 100 of FIG. 1 with the front hood 101 and rear hood 301 removed in accordance with an embodiment of the application. And, FIG. 8 is a top view thereof.

According to one embodiment, the first and second retractable front wheels 131, 132 are mounted to right and left sides 170, 180 of the upper surface 111 of the base plate 110 via respective first and second outrigger arms 731, 732. The outrigger arms 731, 732 may be controlled to extend and retract the front wheels 131, 132, either together or individually. The front wheels 131, 132 are generally extended when the jack 100 is being positioned under a truck 1000 and are retracted during lifting of the truck 1000.

According to one embodiment, the jack 100 may be self propelled and has mounted on its base plate 110 a diesel engine 710, fuel tank 720, battery 740, radiator 750, and hydraulic tank 760 for powering the hydraulic motors (e.g., integrated with the outrigger arms 731, 732) associated with the hydraulically driven front wheels 131, 132 and the hydraulic cylinders 271, 272, 273, 274 of the main lifting assembly 200. According to one embodiment, the operation and positioning of the jack 100 is remotely controllable using a handheld remote control unit 8000 operated by an operator or worker.

Figure 9:
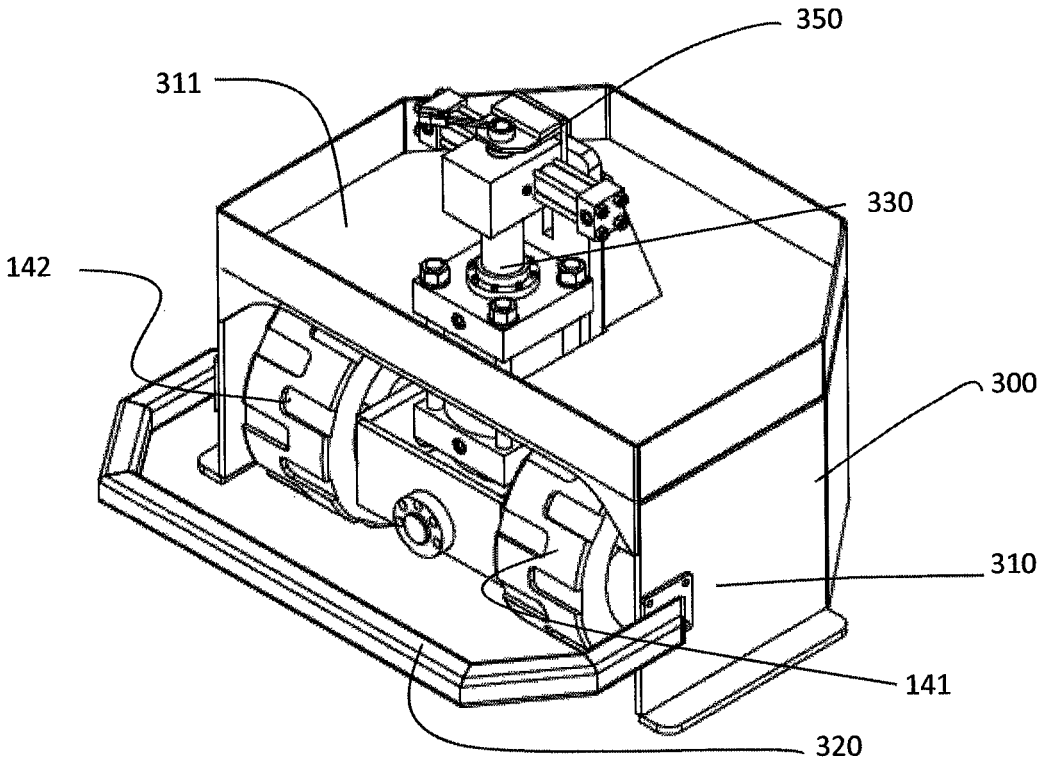
FIG. 9 is a rear perspective view illustrating the rear strut, steering, and walking beam assembly of the jack of FIG. 7 in accordance with an embodiment of the application.

FIG. 9 is a rear perspective view illustrating the rear strut, steering, and walking beam assembly 300 of the jack 100 of FIG. 7 in accordance with an embodiment of the application. FIG. 10 is a front view thereof with the rear wheels 141, 142 shown in a retracted position 143. And, FIG. 11 is a rear view thereof with the rear wheels 141, 142 shown in an extended position 144.

According to one embodiment, the rear strut, steering, and walking beam assembly 300 of the jack 100 may include: a frame 310; a bumper 320 mounted to the frame 310 for protecting the rear wheels 141, 142; a hydraulic cylinder strut 330 mounted through the upper surface 311 of the frame 310; a walking beam (and axle) 340 coupled to the lower end the hydraulic cylinder strut 330, the walking beam (and axle) 340 in turn being coupled to the rear wheels 141, 142 below the upper surface 311; and, a hydraulic rotary actuator (e.g., capable of 180 degrees of rotation) 350 coupled to the upper end of the hydraulic cylinder strut 330 above the upper surface 311 of the frame 310. The hydraulic cylinder strut 330 is operable to move from a retracted position to an extended position and hence to move the rear wheels 141, 142 from a retracted position 143 above the lower surface 112 of the base plate 110 to an extended position 144 below the lower surface 112 of the base plate 110 where the wheels 141, 142 may come into contact with the ground (or other surface) 1010 for raising the jack 100 off the ground 1010 in preparation for movement or repositioning. The hydraulic rotary actuator 350 is operable to rotate the hydraulic cylinder strut 330 and hence the rear wheels 141, 142 coupled thereto for steering the jack 100 during movement or repositioning. The walking beam (and axle) 340 functions like a suspension arm allowing horizontal movement of the rear wheels 141, 142 so that both wheels remain in contact with the ground 1010.

The rear wheels 141, 142, hydraulic cylinder strut 330 and hydraulic rotary actuator 350 provide for smooth 180 degree rotational steering and, according to one embodiment, a four inch straight vertical lift in the extended position 144.

According to one embodiment, the jack 100 may be equipped for hydraulic front wheel direct drive and may include an electronic differential control system for left and right steering.

According to one embodiment, the front drives/outriggers 731, 732 of the front wheels 131, 132 may extend and retract approximately four inches which allows the entire jack 100 to be selectively raised above and lowered to the ground 1010. The operation of the two front outriggers 731, 732 may be synchronized with the operation of the strut 330 to provide smooth and level lifting and lowering of the jack 100 which in turn improves alignment of the jack 100 with the certified lifting points 1020, 1030 of the truck 1000.

Figure 12:
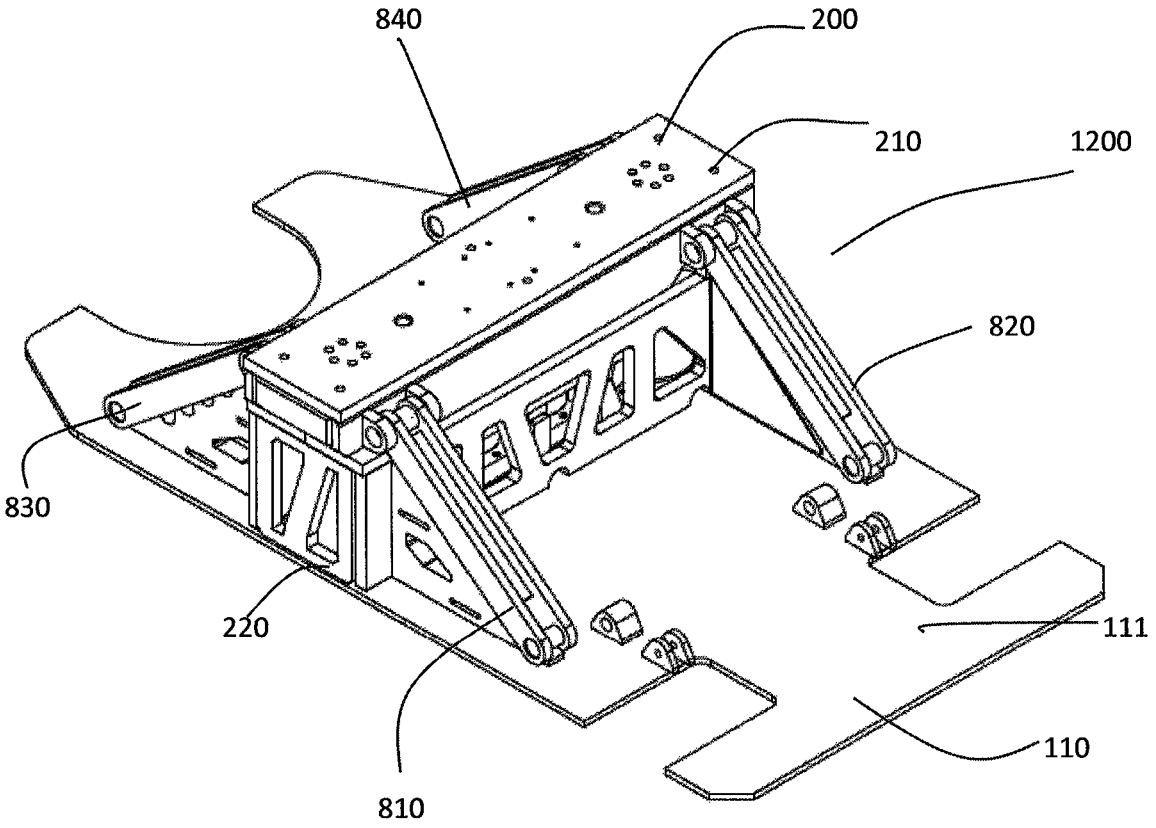
FIG. 12 is a front perspective view illustrating the main lifting assembly of the jack of FIG. 1 with the top plate shown in a lowered position in accordance with an embodiment of the application.
Figure 13:
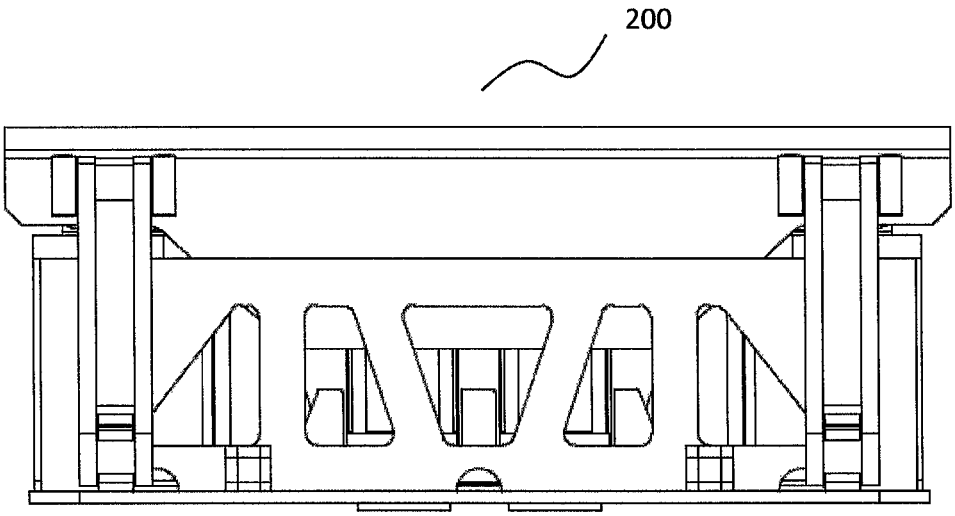
FIG. 13 is a front view thereof.
Figure 14:
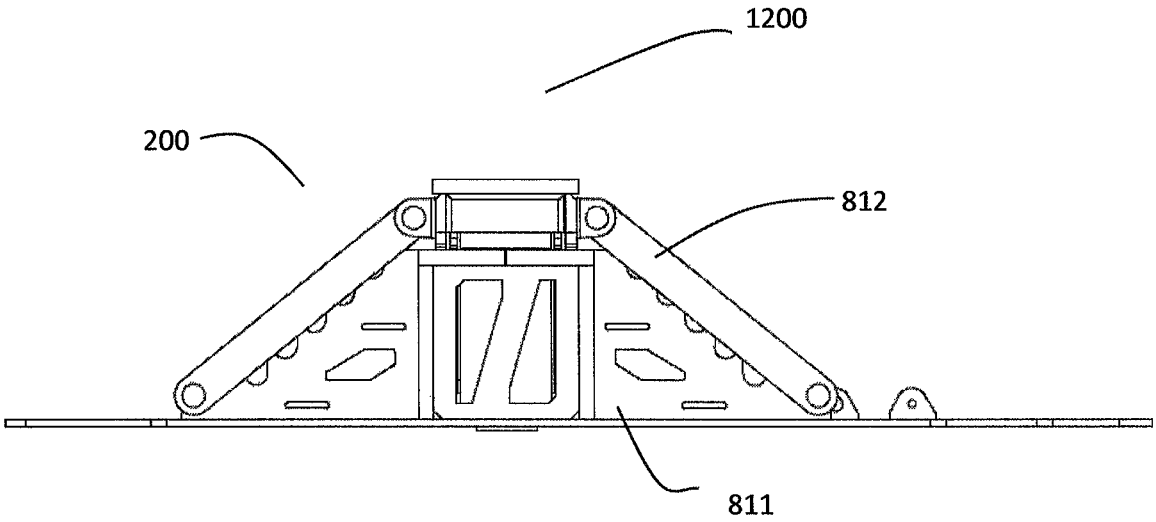
FIG. 14 is a left side view thereof.
Figure 15:
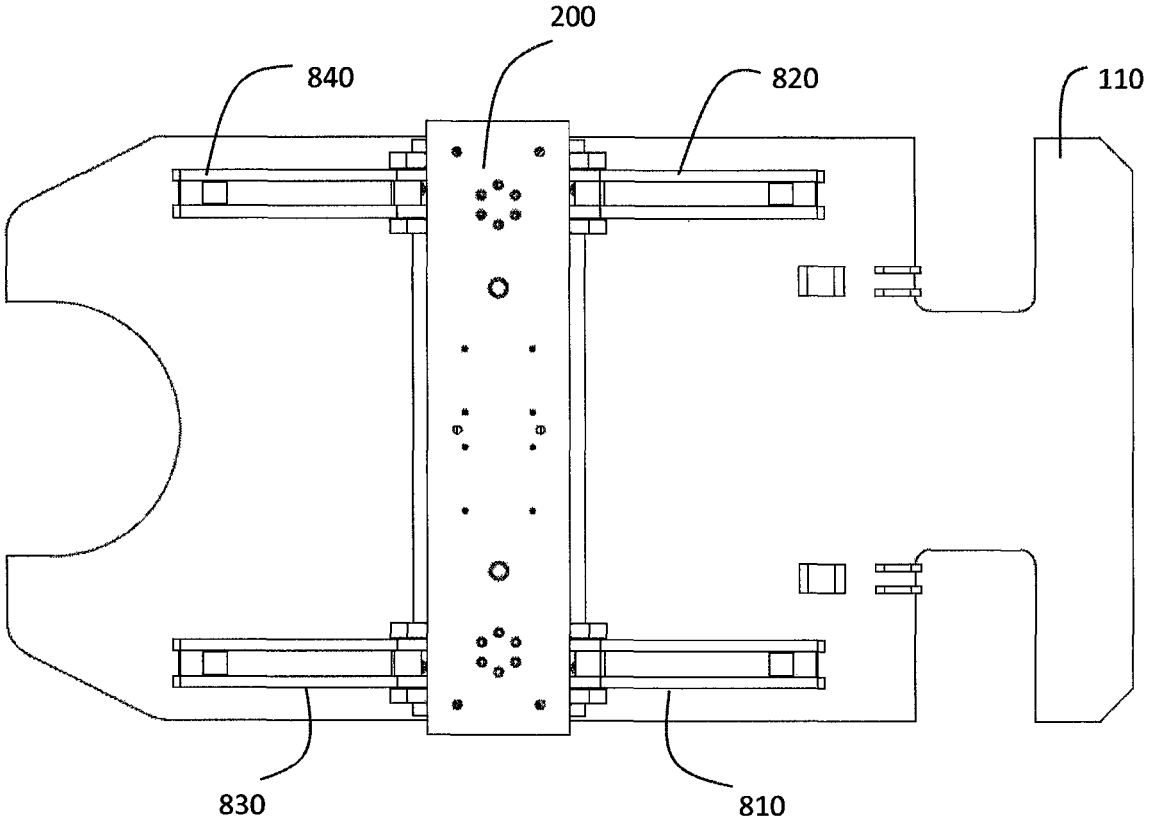
FIG. 15 is a top view thereof.

FIG. 12 is a front perspective view illustrating the main lifting assembly 200 of the jack 100 of FIG. 1 with the top plate 210 (and intermediate plate 230) shown in a lowered position 1200 in accordance with an embodiment of the application. FIG. 13 is a front view thereof. FIG. 14 is a left side view thereof. And, FIG. 15 is a top view thereof.

Figure 16:
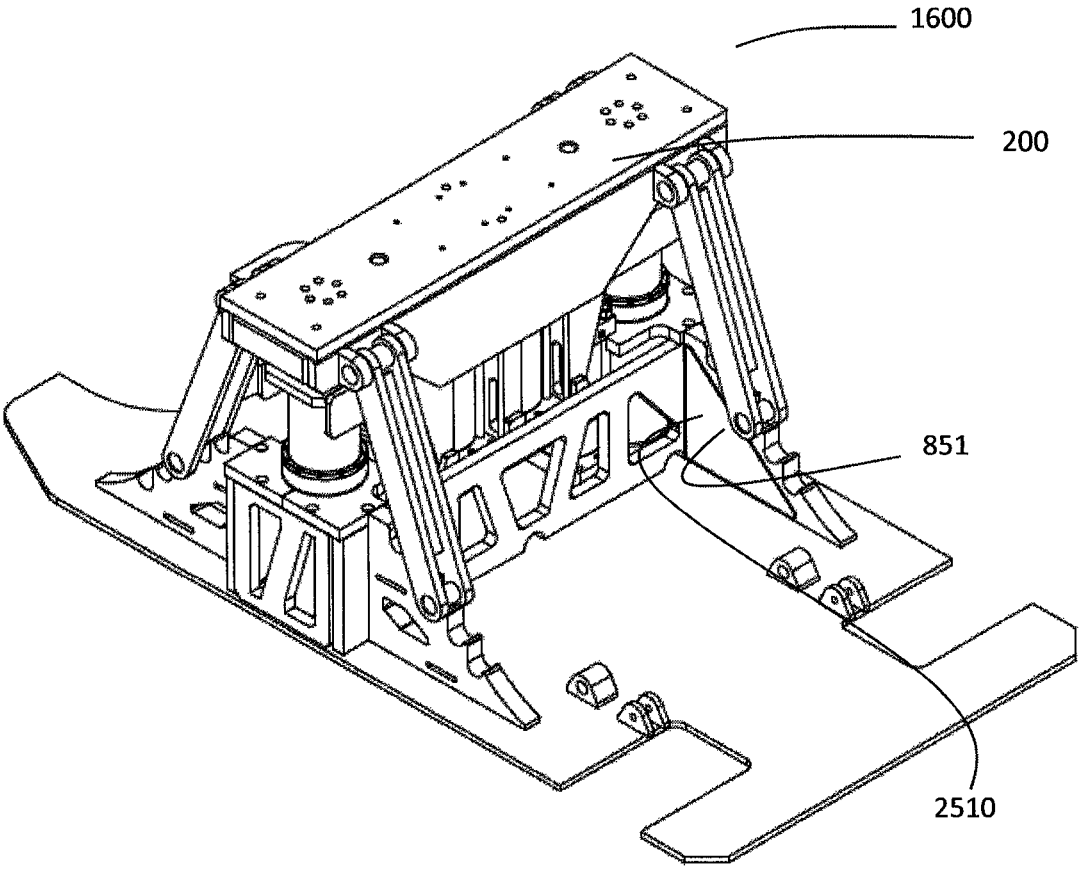
FIG. 16 is a front perspective view illustrating the main lifting assembly of the jack of FIG. 1 with the top plate shown in a partially raised position in accordance with an embodiment of the application.
Figure 17:
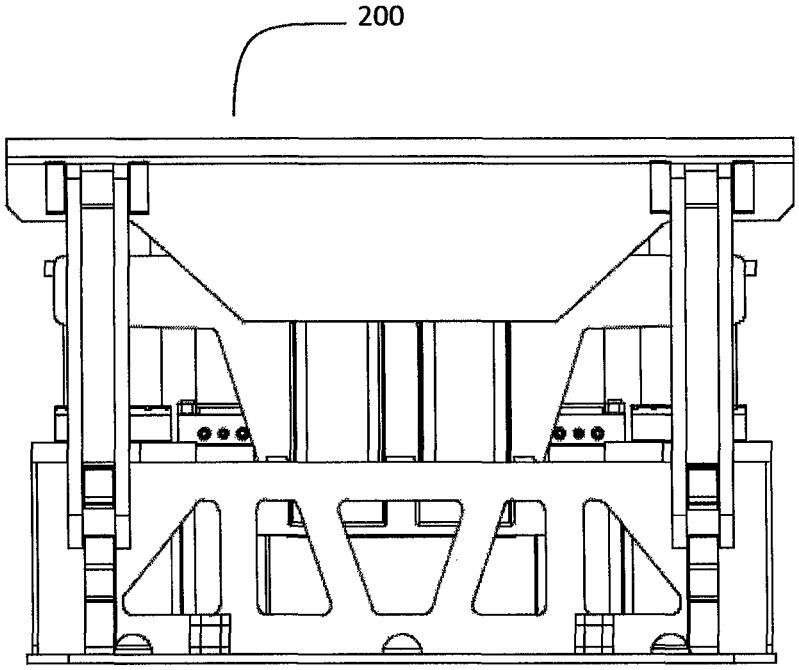
FIG. 17 is a front view thereof.
Figure 18:
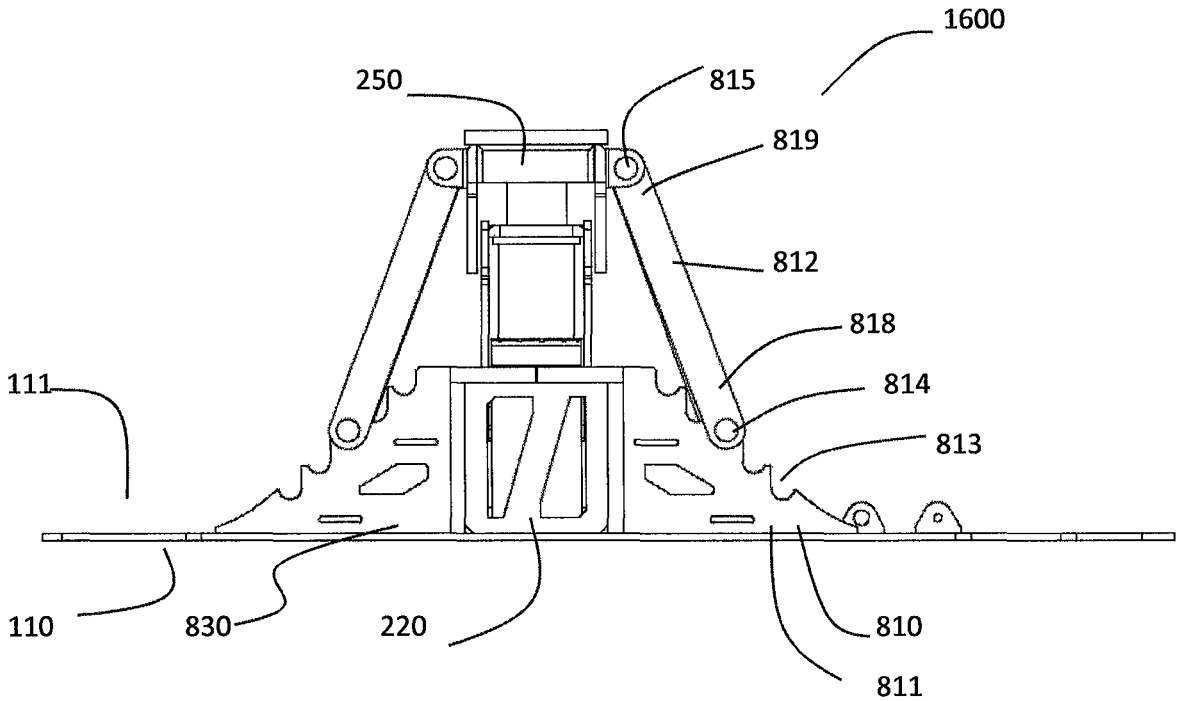
FIG. 18 is a left side view thereof.
Figure 19:
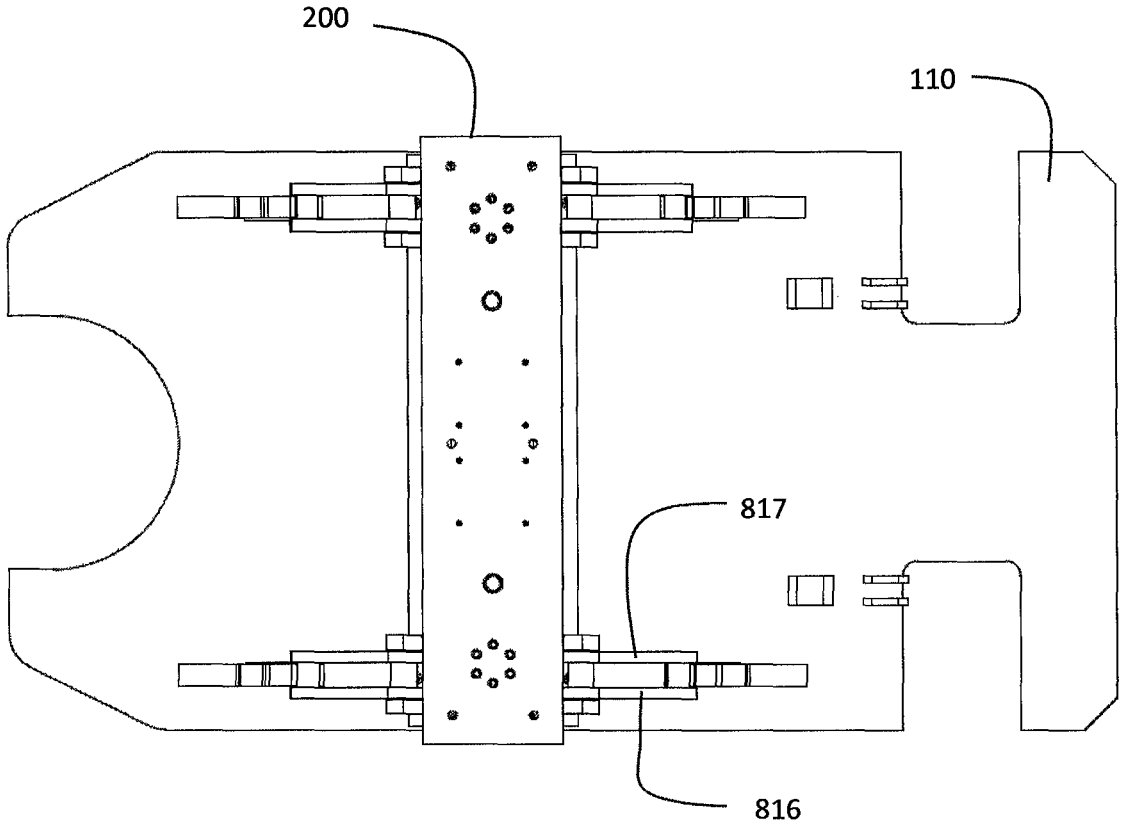
FIG. 19 is a top view thereof.

FIG. 16 is a front perspective view illustrating the main lifting assembly 200 of the jack 100 of FIG. 1 with the top plate 210 (and intermediate plate 230) shown in a partially raised position 1600 in accordance with an embodiment of the application. FIG. 17 is a front view thereof. FIG. 18 is a left side view thereof. And, FIG. 19 is a top view thereof.

Figure 20:
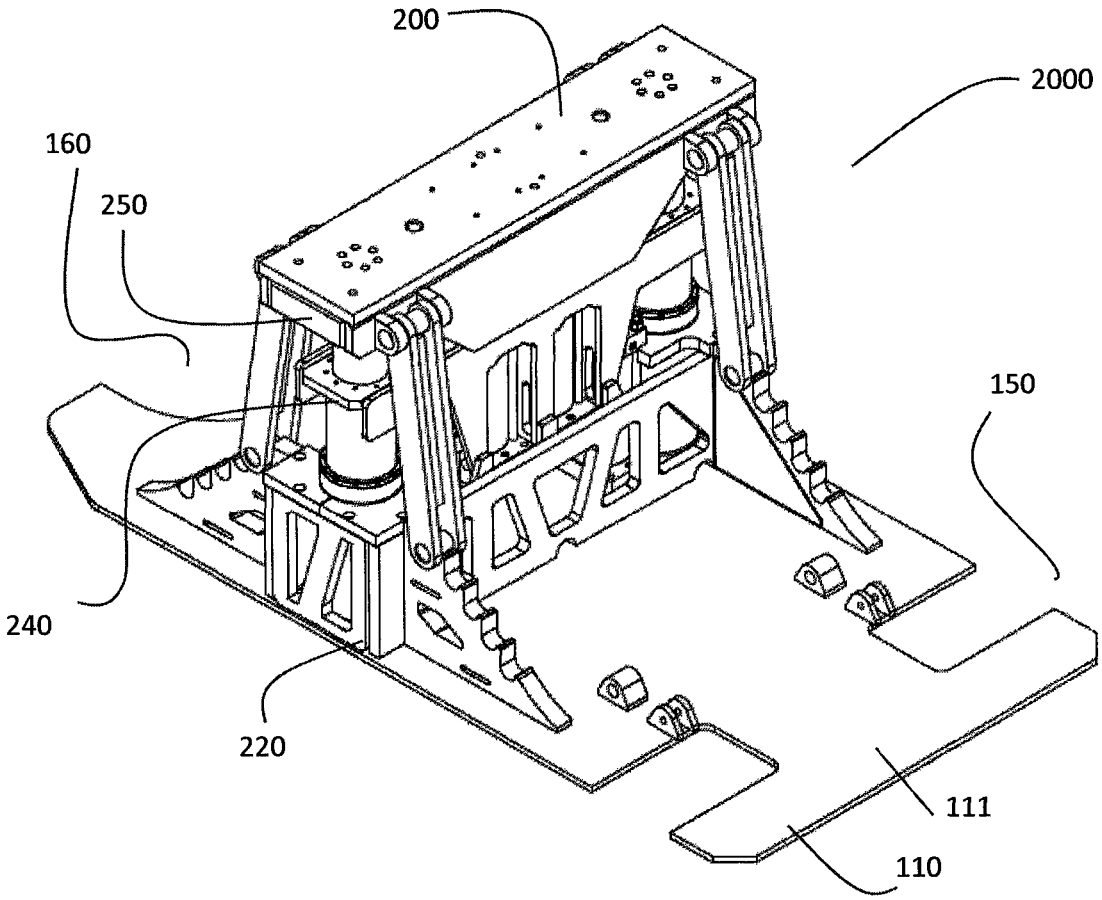
FIG. 20 is a front perspective view illustrating the main lifting assembly of the jack of FIG. 1 with the top plate shown in a fully raised position in accordance with an embodiment of the application.
Figure 21:
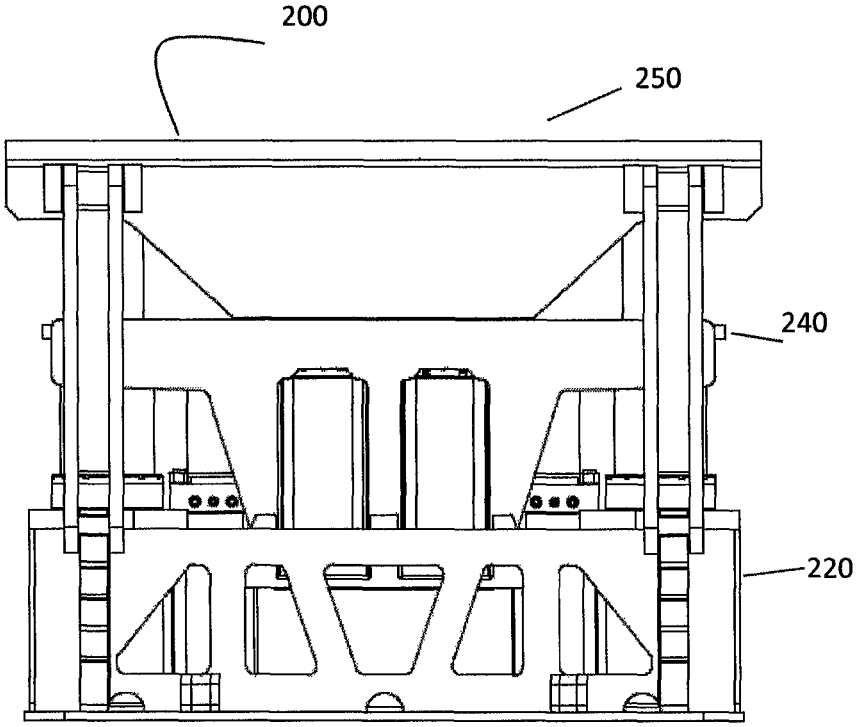
FIG. 21 is a front view thereof.
Figure 22:
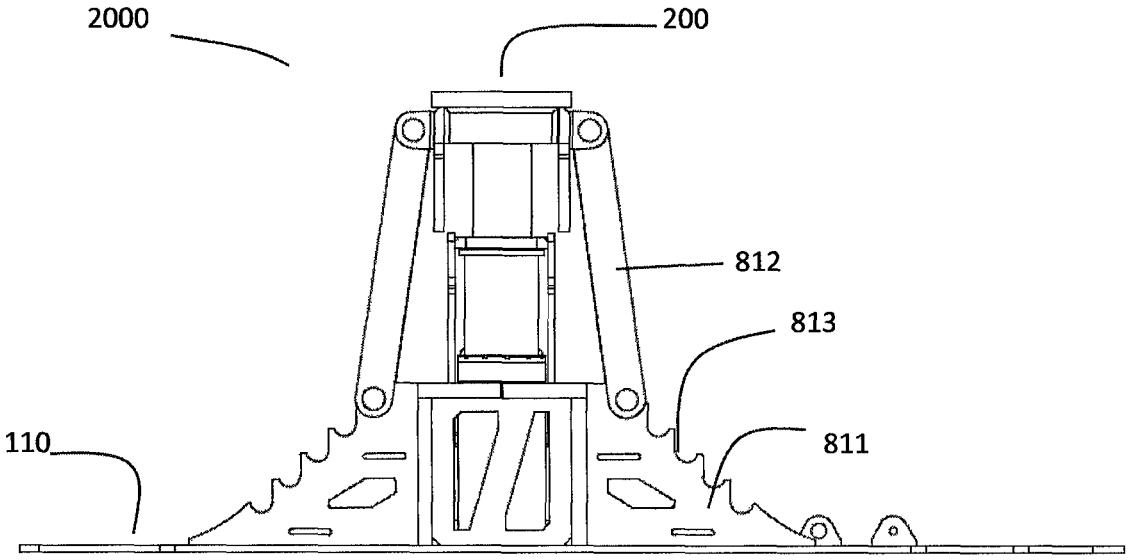
FIG. 22 is a left side view thereof.

FIG. 20 is a front perspective view illustrating the main lifting assembly 200 of the jack 100 of FIG. 1 with the top plate 210 (and intermediate plate 230) shown in a fully raised position 2000 in accordance with an embodiment of the application. FIG. 21 is a front view thereof. FIG. 22 is a left side view thereof. And, FIG. 23 is a top view thereof.

Figure 23:
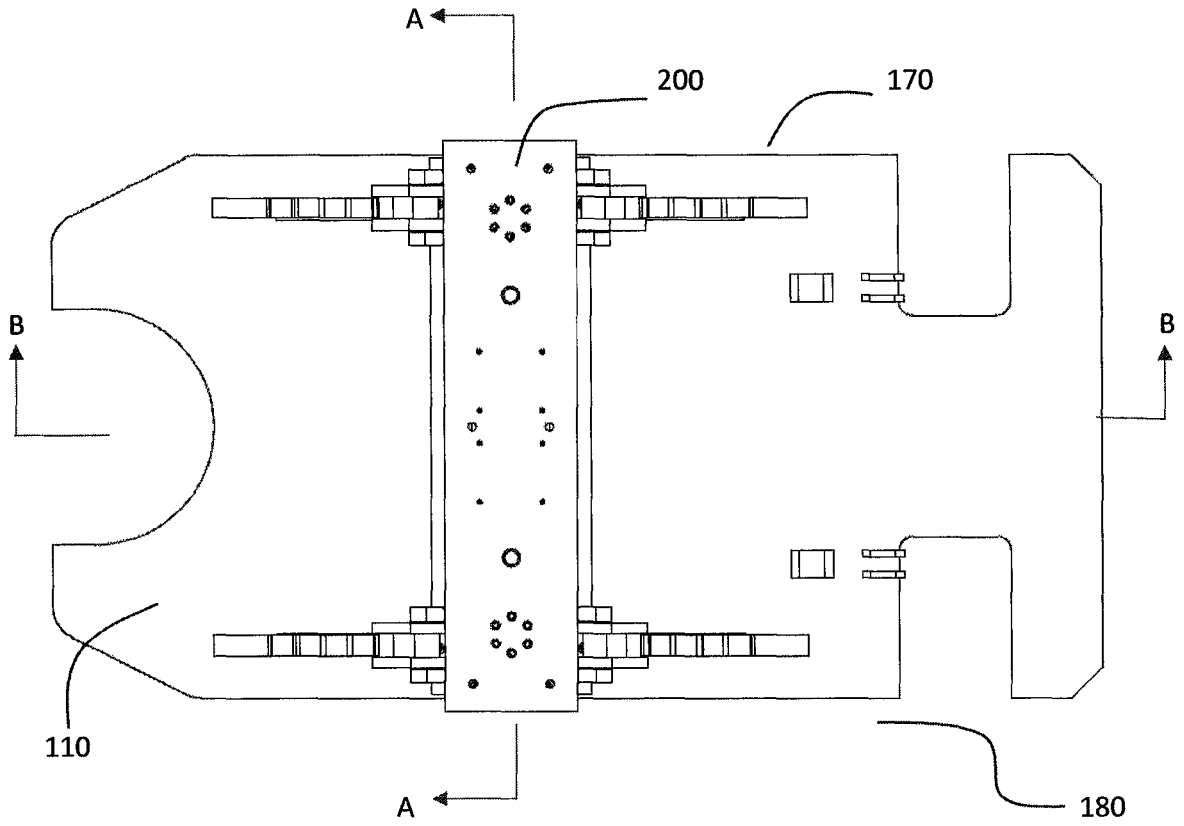
FIG. 23 is a top view thereof.
Figure 24:
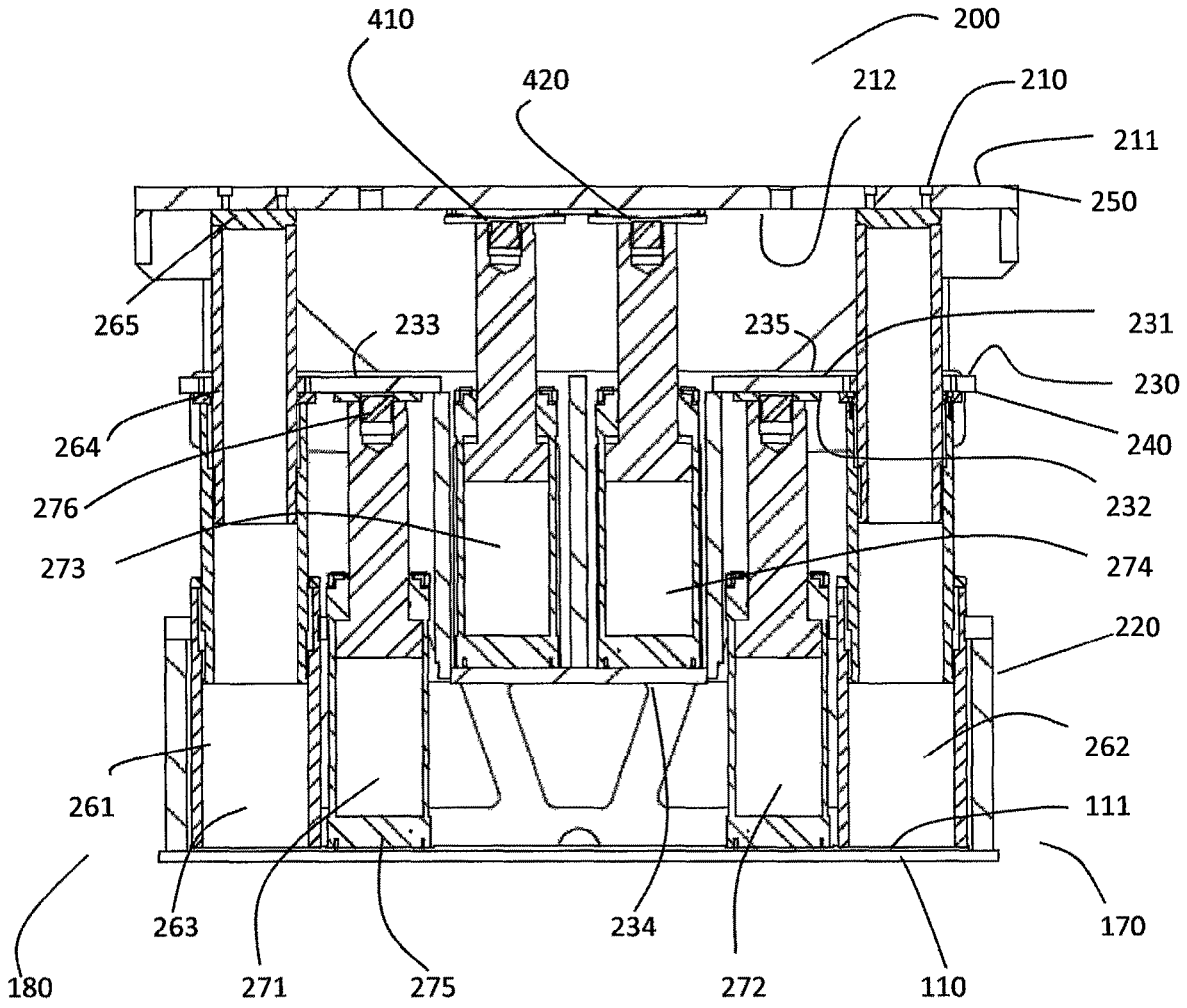
FIG. 24 is a cross-sectional view illustrating the main lifting assembly of the jack of FIG. 1 taken along line A-A in FIG. 23, in accordance with an embodiment of the application.
Figure 25:
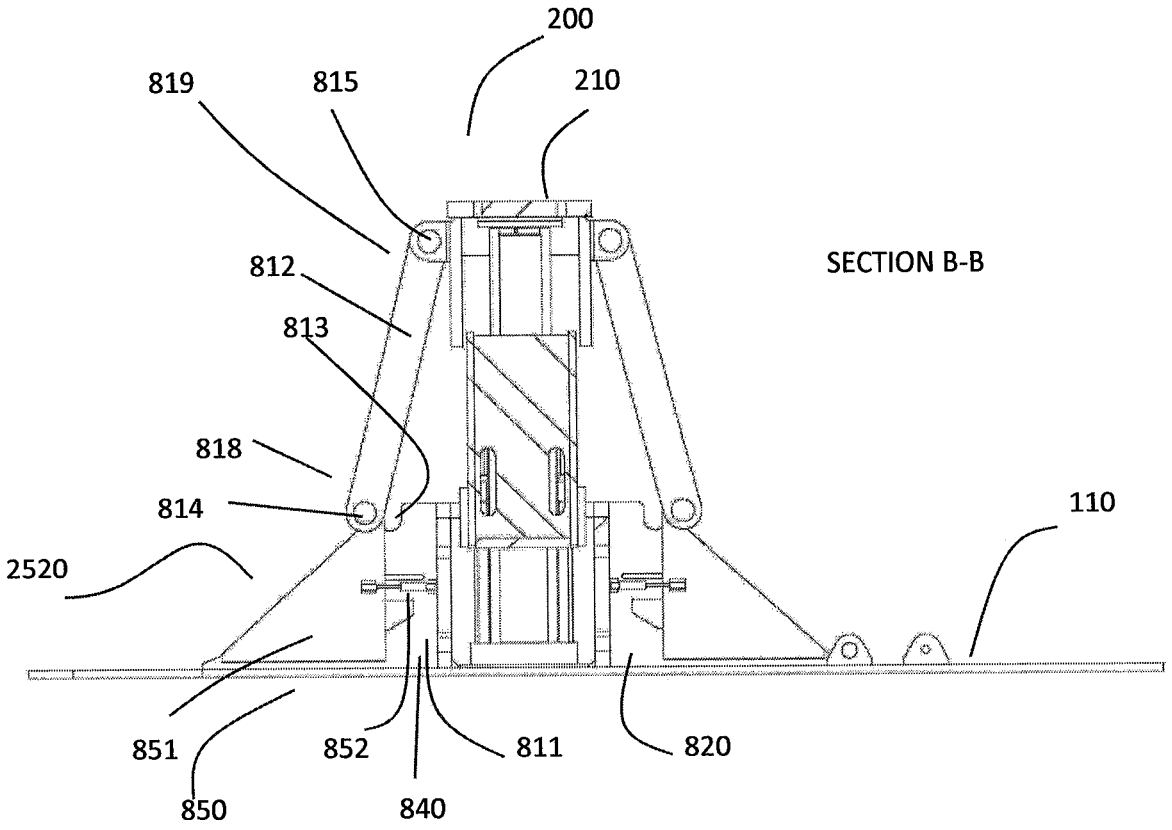
FIG. 25 is a cross-sectional view illustrating the main lifting assembly of the jack of FIG. 1 taken along line B-B in FIG. 23, in accordance with an embodiment of the application.

FIG. 24 is a cross-sectional view illustrating the main lifting assembly 200 of the jack 100 of FIG. 1 taken along line A-A in FIG. 23, in accordance with an embodiment of the application. And, FIG. 25 is a cross-sectional view illustrating the main lifting assembly 200 of the jack 100 of FIG. 1 taken along line B-B in FIG. 23, in accordance with an embodiment of the invention.

According to one embodiment, the main lifting assembly 200 may include: a base lifting assembly (or frame) 220 mounted on the upper surface 111 of the base plate 110; an intermediate lifting assembly (or frame) 240 mounted over the base lifting assembly 220 and coupled (i.e., one or more of attached, connected, joined, bolted, welded, screwed, pinned, hinged, etc.) thereto; a top lifting assembly (or frame) 250 mounted over the intermediate lifting assembly 240 and coupled thereto; first and second compact spherical bearing cylinder mounts 410, 420; and, first, second, third, and fourth locking assemblies 810, 820, 830, 840.

According to one embodiment, the base lifting assembly (or frame) 220 may be mounted on the upper surface 111 of the base plate 110 and may have first and second telescoping linear guide columns 261, 262 and first and second main hydraulic lifting cylinders 271, 272 mounted therein. Each of the first and second main hydraulic lifting cylinders 271, 272 has a piston rod end 276 and a cylinder barrel end 275, the cylinder barrel end 275 of each of the first and second main hydraulic lifting cylinders 271, 272 may be mounted on the upper surface 111 of the base plate 110. Each of the first and second telescoping linear guide columns 261, 262 has a barrel end 263, a first stage end 264, and a second stage end 265. The barrel end 263 of each of the first and second telescoping linear guide columns 261, 262 may be mounted on the upper surface 111 of the base plate 110.

According to one embodiment, the intermediate lifting assembly 240 may have an intermediate plate 230 having a lower surface 232 and an upper surface 231. The intermediate plate 230 may have a central channel 234 formed therein. The left and right portions 233, 235 of the intermediate plate 230 on either side of the channel 234 are at the same level (or height) while the middle portion or channel 234 of the intermediate plate is at a lower level (or height). The intermediate plate 230 may be positioned over and parallel or approximately parallel to the base plate 110. The lower surface 232 of the left and right portions 233, 235 of the intermediate plate 230 may be coupled to the piston rod ends 276 of the first and second main hydraulic lifting cylinders 271, 272 of the base lifting assembly 220, respectively. The lower surface 232 of the left and right portions 233, 235 of the intermediate plate 230 may also be coupled to the first stage ends 264 of the first and second telescoping linear guide columns 261, 262, respectively. The upper surface 231 of the middle portion or channel 234 of the intermediate plate 230 may have third and fourth main hydraulic lifting cylinders 273, 274 mounted thereto. Each of the third and fourth main hydraulic lifting cylinders 273, 274 has a piston rod end 276 and a cylinder barrel end 275, the cylinder barrel end 275 of each of the third and fourth main hydraulic lifting cylinders 273, 274 may be mounted on the upper surface 231 of the middle portion or channel 234 of the intermediate plate 230.

Advantageously, by using a channelled intermediate plate 230, the overall height of the main lifting assembly 200 may be reduced.

According to one embodiment, the top lifting assembly 250 may have a top plate 210 having a lower surface 212 and an upper surface 211. The top plate 210 may be positioned over and parallel or approximately parallel to the intermediate plate 230. The lower surface 212 of the top plate 210 may be coupled to the piston rod end 276 of each of the third and fourth main hydraulic lifting cylinders 273, 274 of the intermediate lifting assembly 240 via respective compact spherical bearing mounts 410, 420 (described below). The lower surface 212 of the top plate 210 may also be coupled to the second stage end 265 of each of the first and second telescoping linear guide columns 261, 262. The upper surface 211 of the top plate 210 may be adapted for contacting the lifting points 1020, 1030 of a truck 1000 (or other load).

Referring to FIG. 24, according to one embodiment, the four main hydraulic lifting cylinders 271, 272, 273, 274 operate at 4500 psi hydraulic pressure creating a total tonnage lift of 220 tons. The main lifting assembly 200 is designed for the sequenced operation of all four main hydraulic lifting cylinders 271, 272, 273, 274 when raising, lowering, and maintaining level on off balanced loads. The main hydraulic lifting cylinders 271, 272, 273, 274 are connected in series (i.e., daisy chain) to each other, which together with the structure of the main lifting assembly 200 described above, eliminates or reduces the need for electronic motion control.

Advantageously, the channeled intermediate lifting plate 230, integrated main hydraulic lifted cylinders 271, 272, 273, 274, and compact spherical bearing mounts 410, 420 combined with the telescoping linear guide columns 261, 262 allows for a low profile collapsed height for the jack 100 of only 33 inches while providing a linear lifting working stroke of 30 inches. The telescoping linear guide columns 261, 262 provide the required stability to handle a full 220 ton off balanced load.

According to one embodiment, each of the first, second, third, and fourth locking assemblies 810, 820, 830, 840 may have an inclined ratchet rack (or plate) 811, a locking bar 812, and a lock release assembly 850. The ratchet rack 811 may be a right-angled triangle (or approximately right-angled triangle) shaped gusset plate having a horizontal or approximately horizontal base, a vertical or approximately vertical side, and a hypotenuse or inclined side. The base of the ratchet rack 810 is mounted to the upper surface 111 of the base plate 110 proximate a side (e.g., the left side 180) of the base plate 110. The vertical side of the ratchet rack 810 may be mounted to the side (e.g., the front side) of the base lifting assembly (or frame) 220. The ratchet rack 811 may be built into or function as a gusset plate strengthening the connection of the base lifting assembly 220 to the base plate 110. The inclined side of the ratchet rack 811 has a number (e.g., five) of teeth or notches 813 formed therein for receiving a lower pin or roller 814 of the locking bar 812. The locking bar 812 may include first and second elongate plates or members 816, 817 that are coupled and spaced apart at a lower end 818 by the lower pin or roller 814 and at an upper end 819 by an upper pin or roller 815. The upper end 819 of the locking bar 812 is pin or hinge mounted (e.g., using the upper pin or roller 815) to the side (e.g., the front side) of the top lifting assembly (or frame) 250 allowing the lower end 818 of the locking bar 812 to swing or rotate inwards toward the base lifting assembly 220 and outwards away from the base lifting assembly 220 by rotation about its pin or hinge.

Each locking assembly (e.g., 820) is gravity activated and the notches 813 on the inclined side of the ratchet rack 811 provides multiple (e.g., seven for five notches) pre-set locking positions. Advantageously, as each locking assembly 820 is externally mounted on the jack 100, engagement of the locking bars 812 in the ratchet rack 811 remains fully visible to an operator located at a safe distance from the truck 1000 or load.

Referring to FIGS. 12-15, when the top plate 210 of the jack 100 is in a lowered position 1200, for each locking assembly (e.g., 810), the roller 814 of the locking bar 812 is positioned below the lowest notch (e.g., the first notch) on the ratchet rack 811. Referring to FIGS. 16-19, as the top plate 210 is lifted to a partially raised position 1600, the roller 814 of the locking bar 812 rolls or slides up the ratchet rack 811 and is engaged with a higher notch 813 (e.g., the third notch) on the ratchet rack 811. Referring to FIGS. 20-23, as the top plate 210 is lifted to a fully raised position 2000, the roller 814 of the locking bar 812 rolls or slides further up the ratchet rack 811 and is engaged with a yet higher notch 813 (e.g., the fifth notch) on the ratchet rack 811.

The notches 813 formed in the ratchet rack 811 are shaped or angled upward to allow the roller 814 of the locking bar 812 to travel upward over the notches 813 as the top plate 210 is lifted. Advantageously, the upward angling of the notches 813 prevents the roller 814 of the locking bar 812 from travelling downward over the notches 813 as the top plate 210 is lowered. In this way, gravity is used to lock the locking bars 812 in position to secure the raised truck 1000 or load.

Referring to FIG. 25, to allow the roller 814 of the locking bar 812 to travel downward over the notches 813 when the top plate 210 is lowered, each locking assembly (e.g., 840) is equipped with a lock release assembly 850. The lock release assembly 850 includes a lock release plate 851 coupled to a lock release hydraulic cylinder 852. The lock release plate 851 (e.g., a ¼ inch plate) has a right-triangle shape similar to that of the ratchet rack 811. The lock release hydraulic cylinder 852 is operable to move the lock release plate 851 from a retracted position 2510 (as shown in FIG. 16) to an extended position 2520 (as shown in FIG. 25). When moved to the extended position 2520, the angled side of the lock release plate 851 extends beyond the angled side of the ratchet rack 811, contacts the roller 814 of the locking bar 812, urges the roller 814 out of the notch 813 in the ratchet rack 811, thus allowing the roller 814 and locking bar 812 to slide downward over the notches 813 in the ratchet rack 811.

Advantageously, the locking assemblies 810, 820, 830, 840 do not increase the overall height or width of the base plate 110 of the jack 100 while creating a slide effect for each locking bar 812.

According to one embodiment, the main hydraulic lifting cylinders 271, 272, 273, 274 are arranged in a straight or approximately straight row extending from the left side 180 to the right side 170 of the base plate 110 of the jack 100 with the telescoping liner guide columns 261, 262 on either end (as shown in FIG. 24).

According to one embodiment, each of the main hydraulic lifting cylinders 271, 272, 273, 274 may be another type of actuator such as a pneumatic or electric actuator.

Figure 26:
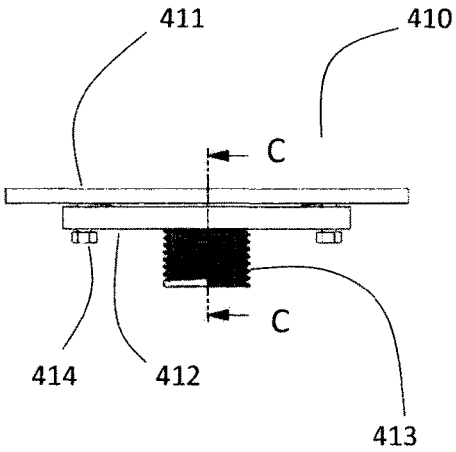
FIG. 26 is a front view illustrating one of the compact spherical bearing cylinder mounts shown in FIG. 24 in accordance with an embodiment of the application.
Figure 27:
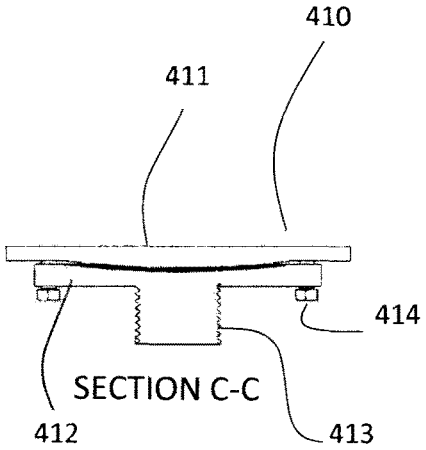
FIG. 27 is a cross-sectional view thereof taken along line C-C in FIG. 26.
Figure 28:
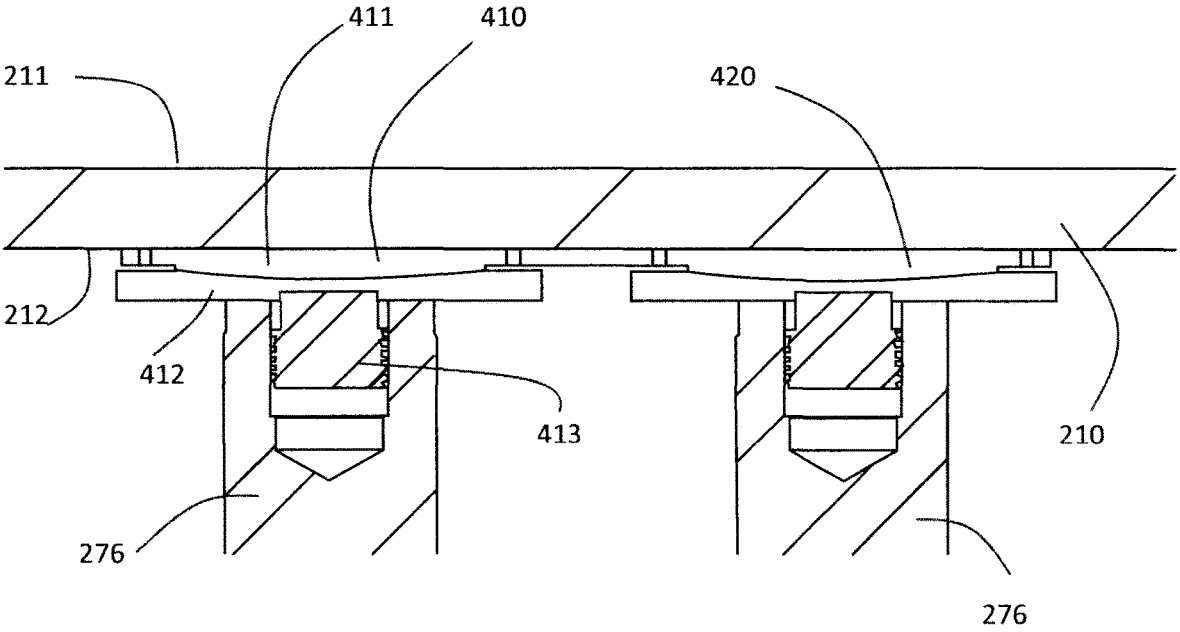
FIG. 28 is a cross-sectional detail view illustrating the installation of the spherical bearing cylinder mounts in the main lifting assembly shown in FIG. 24 taken along line A-A in FIG. 23.

FIG. 26 is a front view illustrating one of the compact spherical bearing cylinder mounts 410 shown in FIG. 24 in accordance with an embodiment of the application. FIG. 27 is a cross-sectional view thereof taken along line C-C in FIG. 26. And, FIG. 28 is a cross-sectional detail view illustrating the installation of the compact spherical bearing cylinder mounts 410, 420 in the main lifting assembly 200 shown in FIG. 24 taken along line A-A in FIG. 23.

According to one embodiment, each compact spherical bearing cylinder mount 410, 420 may include: a female spherical radius cup 411 having a flat outer surface for mounting on a surface, such as the lower surface 212 of the top plate 210, and a female spherical radius inner surface (or bearing); a male spherical radius cup 412 having a male spherical radius inner surface (or bearing) for mating with the female spherical radius inner surface of the female spherical radius cup 411 and a flat outer surface equipped with a central thread 413 for coupling to a hydraulic cylinder such as the piston rod end 276 of the third main hydraulic lifting cylinder 273; and, bolts 414 (or other fasteners) for loosely coupling the female spherical radius cup 411 to the male spherical radius cup 412.

The purpose of the compact spherical bearing cylinder mounts 410, 420 is to reduce mechanical side loading on the rods of the main hydraulic lifting cylinders 273, 274. The main lifting assembly 200 will typically move or flex when loads are introduced thus causing an offset linear force on the main hydraulic lifting cylinders 273, 274 and their rod assemblies which may result in a hydraulic seal failure and premature oil leakage. The bearings 411, 412 of each compact spherical bearing cylinder mount 410, 420 mate together in a manner similar to that of a ball and socket and allow for an approximately 15 thousands of an inch offset load. The compact spherical bearing cylinder mounts 410, 420 allow for a very low profile (e.g., approximately one inch) mechanical link between the main hydraulic lifting cylinders 273, 274 and the top lifting plate 210. The loose bolting 414 of the female spherical radius cup 411 to the male spherical radius cup 412 allows for a mechanical link between the hydraulic cylinders 273, 274 and the top plate 210 upon retraction or lowering as well as upon extension or lifting.

According to one embodiment, the main lifting assembly 200 may be operated as a stand alone lifting device.

Figure 30:
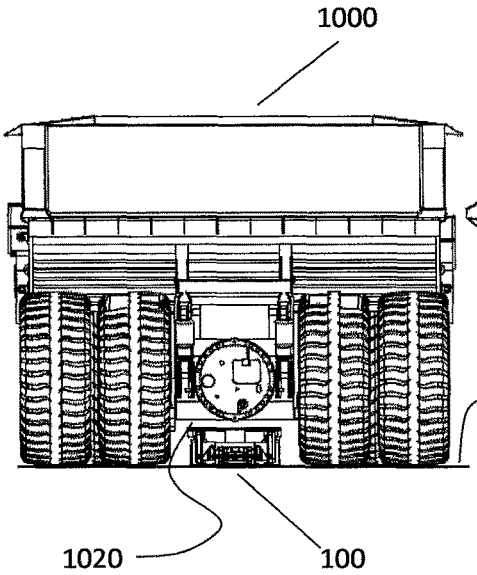
FIG. 30 is a rear view thereof.
Figure 29:
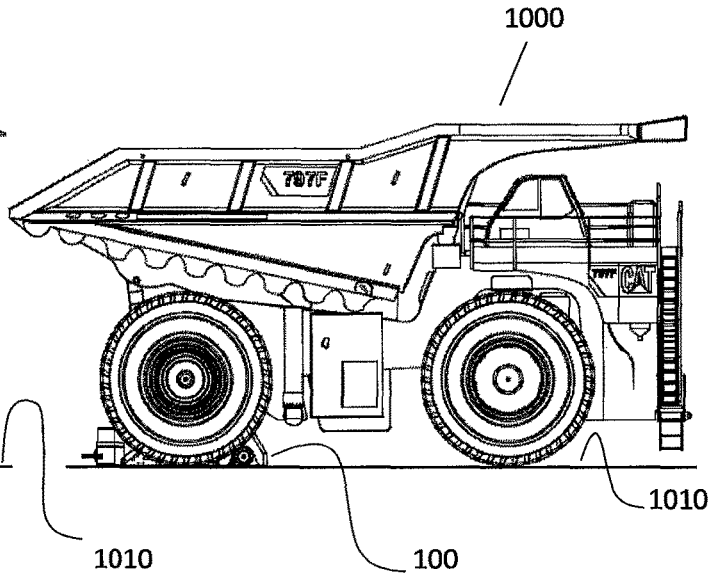
FIG. 29 is a left side view illustrating the jack of FIG. positioned under the rear lifting point of a truck in accordance with an embodiment of the application.
Figure 32:
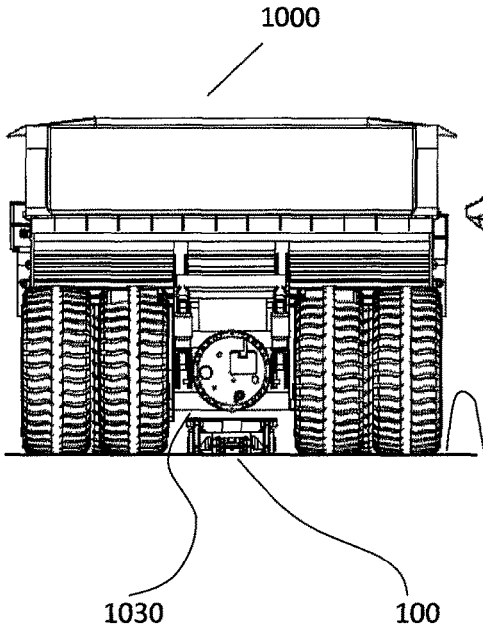
FIG. 32 is a rear view thereof.
Figure 31:
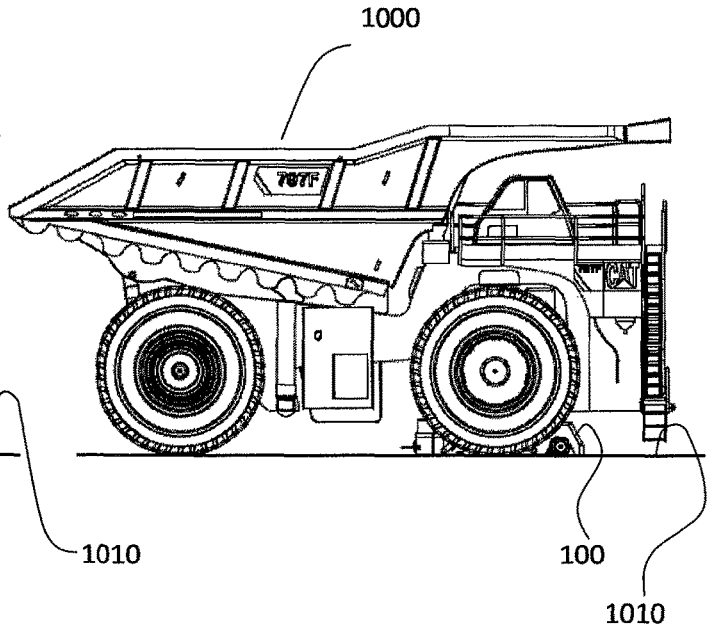
FIG. 31 is a left side view illustrating the jack of FIG. 1 positioned under the front lifting point of a truck in accordance with an embodiment of the application.

FIG. 29 is a left side view illustrating the jack 100 of FIG. 1 positioned under the rear lifting point 1020 of a truck 1000 in accordance with an embodiment of the application. FIG. 30 is a rear view thereof. FIG. 31 is a left side view illustrating the jack 100 of FIG. 1 positioned under the front lifting point 1030 of a truck 1000 in accordance with an embodiment of the application. FIG. 32 is a rear view thereof.

In operation, the jack 100 with its top plate 210 (and intermediate plate 230) in the lowered position 1200 is positioned under a lifting point (e.g., the rear lifting point 1020) of a truck 1000 by an operator using a remote control unit 8000. When positioned, the front and rear wheels 131, 132, 141, 142 of the jack 100 are retracted and the jack 100 is ready for lifting. To lift the truck 1000, the upper surface 211 of the top plate 210 is brought into contact with the lifting point 1020 by moving the top plate 210 to a partially raised position (e.g., 1600) under control of the operator using a remote control unit 8000. When moving from the jack's lowered position 1200 to its partially raised position 1600, the piston rod of each main hydraulic lifting cylinder 271, 272, 273, 274 is urged out of its respective cylinder barrel by fluid pressure causing the intermediate plate 230 and the top plate 210 to be pushed upward to their respective partially raised positions 1600, the telescoping linear guide columns 261, 262 to be partially extended, and the rollers 814 of the locking bars 812 of each of the locking assemblies 810, 820, 830, 840 to be pulled up their respective ratchet racks 811 to engage respective notches 813 (e.g., the third notches) to lock the top plate 210 and truck 1000 in place.

Similarly, when moving from the jack's partially raised position 1600 to its raised position 2000, the piston rod of each main hydraulic lifting cylinder 271, 272, 273, 274 is urged further out of its respective cylinder barrel by fluid pressure causing the intermediate plate 230 and the top plate 210 to be pushed further upward to their respective raised positions 2000, the telescoping linear guide columns 261, 262 to be fully extended, and the rollers 814 of the locking bars 812 of each of the locking assemblies 810, 820, 830, 840 to be pulled further up their respective ratchet racks 811 to engage respective notches 813 (e.g., the fifth notches) to the lock the top plate 210 and truck 1000 in place.

After maintenance on the truck 1000 has been performed, the truck 1000 is ready to be lowered. First, the lock release hydraulic cylinder 852 of each lock release assembly 850 is operated to move the lock release plate 851 from its retracted position 2510 to its extended position 2520 allowing the rollers 814 and their locking bars 812 to slide downward over the notches 813 in their respective ratchet racks 811. Second, when moving from the jack's raised position 1600 to its lowered position 1200, the piston rod of each main hydraulic lifting cylinder 271, 272, 273, 274 is urged into its respective cylinder barrel by fluid pressure causing the intermediate plate 230 and the top plate 210 to be pulled downward to their respective lowered positions 2000, the telescoping linear guide columns 261, 262 to be fully retracted, and the unlocked locking bars 812 of each of the locking assemblies 281, 282, 283, 284 to be pushed down their respective ratchet racks 811 to their lowered positions.

Thus, according to one embodiment, there is a provided a jack 100, comprising: a top plate 210 adapted to contact a load 1000; an intermediate plate 230 positioned below the top plate 210, the intermediate plate 230 having a channel 234 formed therein; a base plate 110 positioned below the intermediate plate 230; a first pair of actuators 271, 272 coupled between the base plate 110 and the intermediate plate 230, one of the first pair of actuators 271, 272 positioned on either side 233, 235 of the channel 234; and, a second pair of actuators 273, 274 coupled between the channel 234 of the intermediate plate 230 and the top plate 210; wherein the first and second pairs of actuators 271, 272, 273, 274 are operable to move the top plate 210 and the intermediate plate 230 between respective lowered positions (e.g., 1200) and respective raised positions (e.g., 1600, 2000) to thereby lower and raise the load 1000.

The above jack 100 may further include a pair of telescoping linear guide columns 261, 262 coupled between the base plate 110, intermediate plate 230, and top plate 210, one of the pair of telescoping linear guide columns 261, 262 positioned on either side of the first pair of actuators 271, 272. The first and second pairs of actuators 271, 272, 273, 274 may be operable simultaneously. The load may be a truck 1000. The first and second pairs of actuators may be first and second pairs of hydraulic cylinders 271, 272, 273, 274, respectively. The first pair of actuators 271, 272, the second pair of actuators 273, 274, and the pair of telescoping linear guide columns 261, 262 may be arranged in a row.

The above jack 100 may further include at least one locking assembly (e.g., 810) adapted to lock the top plate 210 in the raised position (e.g., 2000). The at least one locking assembly 810 may include a locking bar 812 and a ratchet rack 811, the locking bar 812 having an upper end 819 and a lower end 818, the locking bar 812 hinge mounted at the upper end 819 proximate to the top plate 210, the ratchet rack 811 inclining upward from the base plate 110 toward the top plate 210 and having at least one notch 813 formed therein, the at least one notch 813 adapted to receive and lock the lower end 818 of the locking bar 812, and the lower end 818 of the locking bar 812 being slidable up the ratchet rack 811 and into the at least one notch 813 as the top plate 210 is moved from the lowered position 1200 to the raised position 1600, 2000. The at least one locking assembly 810 may further include a lock release assembly 850 adapted to unlock the top plate 210 allowing the top plate 210 to be moved from the raised position 1600, 2000 to the lowered position 1200. The lock release assembly 850 may include a lock release plate 851 inclining upward from the base plate 110 toward the top plate 210, the lock release plate 851 moveable from a retracted position 2510 to an extended position 2520 to urge the lower end 818 of the locking bar 812 out of the at least one notch 813 allowing the lower end 818 of the locking bar 812 to slide down the ratchet rack 811 and over the at least one notch 813 as the top plate 210 is moved from the raised position 1600, 2000 to the lowered position 1200. The locking bar 812, the ratchet rack 811, and at least one notch 813 are mounted to be visible from a location distant from the jack 100 and load 1000. The at least one locking assembly 810 may be four locking assemblies 810, 820, 830, 840. The at least one notch may be five notches 813.

The above jack 100 may further include a pair of spherical radius bearing mounts 410, 420 adapted to couple the second pair of actuators 273, 274 to the top plate 210, respectively. The jack 100 may further include a pair of retractable front wheels 131, 132 mounted proximate to a front end 150 of the base plate 110. The pair of retractable front wheels 131, 132 may be hydraulically driven. The jack 100 may further include a pair of retractable and steerable rear wheels 141, 142 mounted proximate to a rear end 160 of the base plate 110.

The above jack 100 may further include an engine 710 mounted on the base plate 110 for providing power to components of the jack 100. The jack 100 may further include a remote control unit 8000 for controlling the jack 100 from a location distant from the jack 100 and load 1000. And, the jack 100 may further include a base lifting assembly 220 mounted to the base plate 110 within which the first pair of actuators 271, 272 and the pair of telescoping linear guide columns 261, 262 are mounted, an intermediate lifting assembly 240 within which the second pair of actuators 273, 274 are mounted, and a top lifting assembly 250 on which the top plate 210 is mounted.

Figure 33:
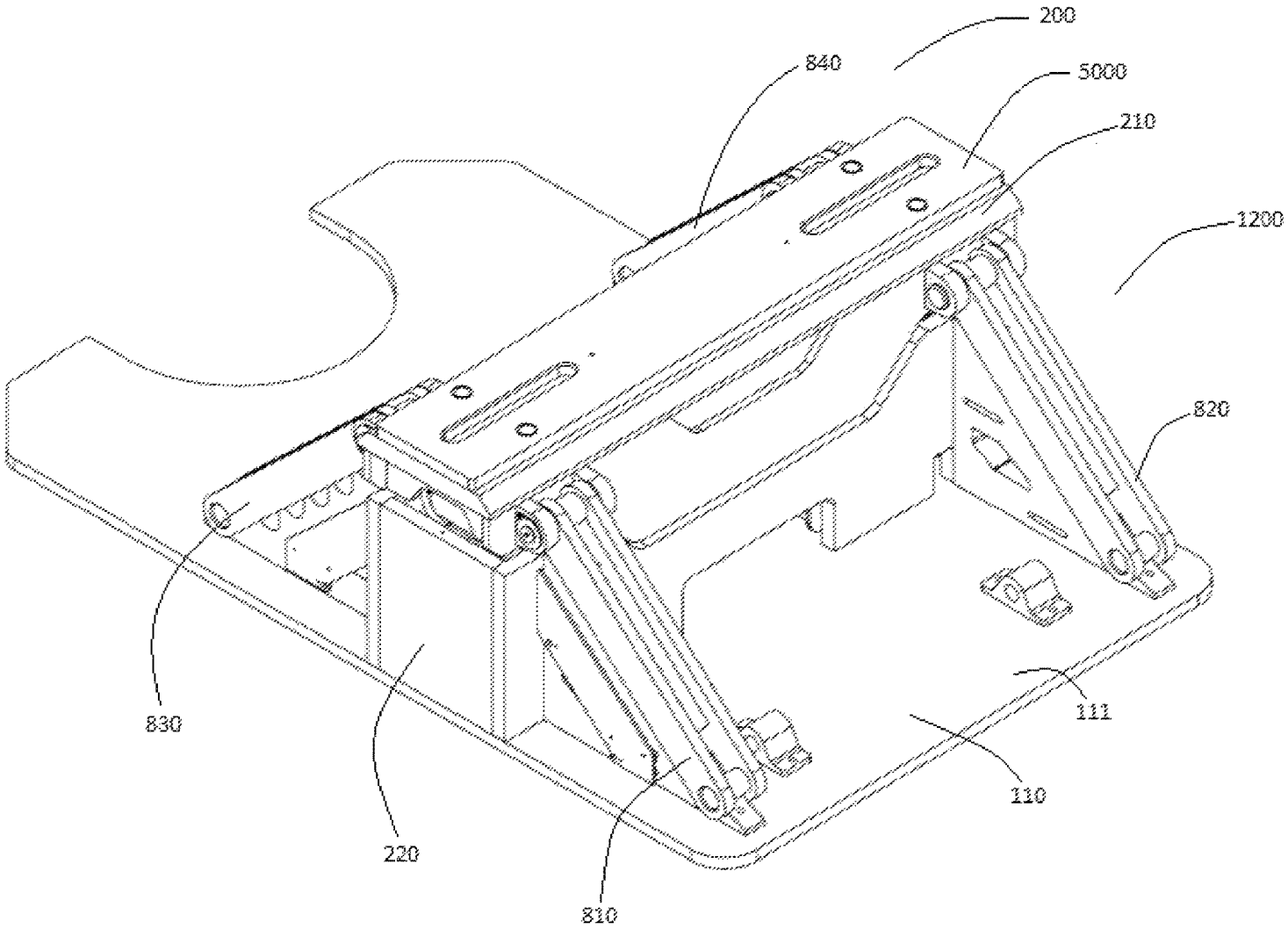
FIG. 33 is a front perspective view illustrating a main lifting assembly for the jack of FIG. 1 with the top plate shown in a lowered position in accordance with another embodiment of the application.
Figure 34:
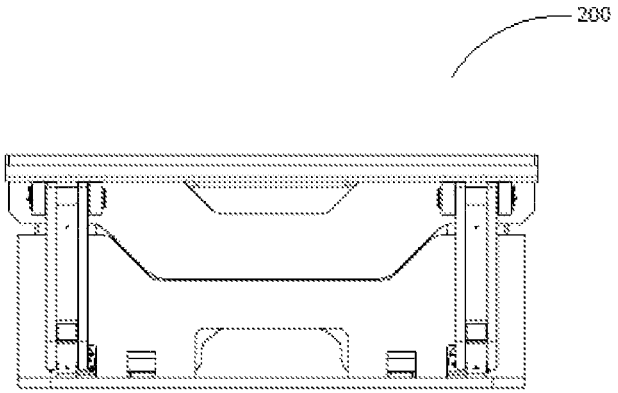
FIG. 34 is a front view thereof.
Figure 35:
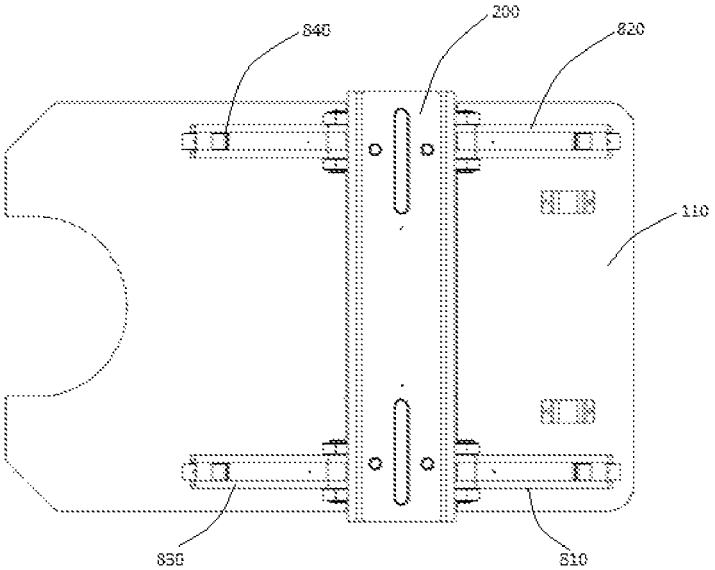
FIG. 35 is a top view thereof.
Figure 36:
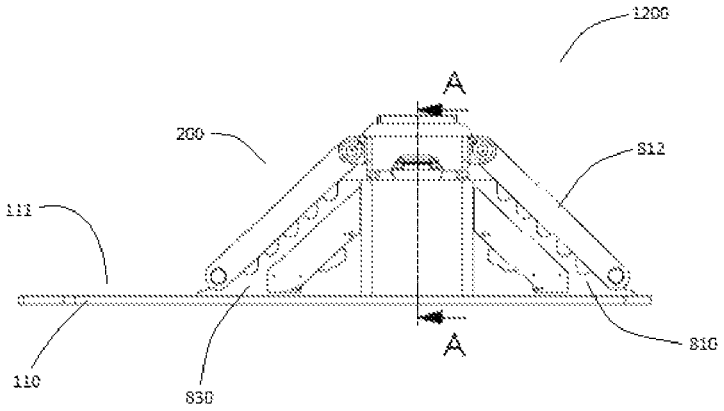
FIG. 36 is a left side view thereof.
Figure 37:
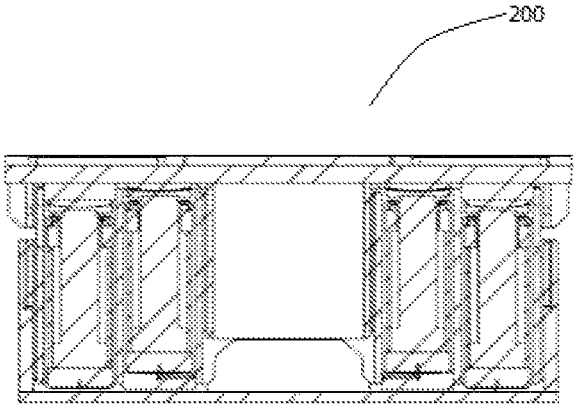
FIG. 37 is a cross-sectional view thereof taken along line A-A in FIG. 36.

FIG. 33 is a front perspective view illustrating a main lifting assembly 200 for the jack 100 of FIG. 1 with the top plate 210 (and intermediate plate 230) shown in a lowered position 1200 in accordance with another embodiment of the application. FIG. 34 is a front view thereof. FIG. 35 is a top view thereof. FIG. 36 is a left side view thereof. And, FIG. 37 is a cross-sectional view thereof taken along line A-A in FIG. 36.

Figure 38:
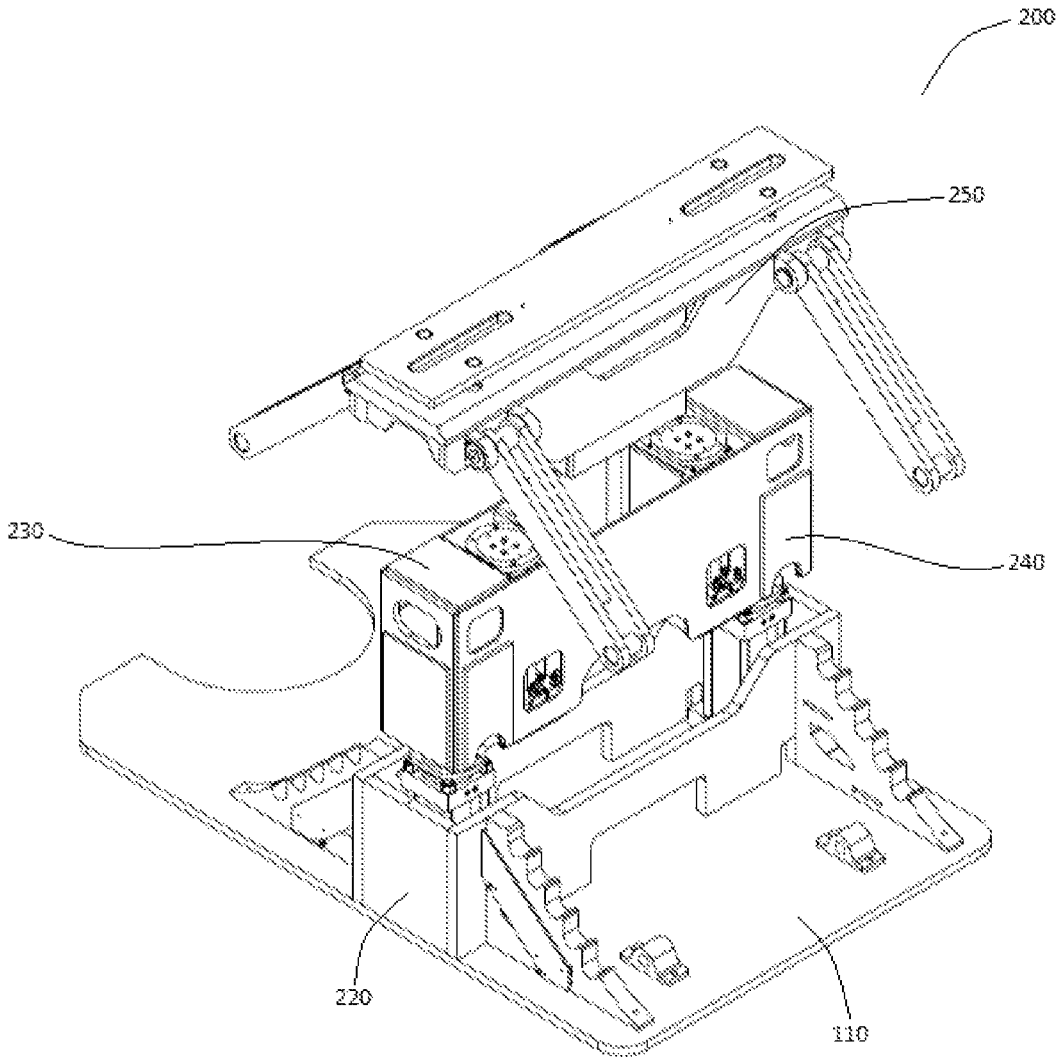
FIG. 38 is a partially exploded front perspective view illustrating the main lifting assembly of FIG. 33 in accordance with an embodiment of the application.
Figure 39:
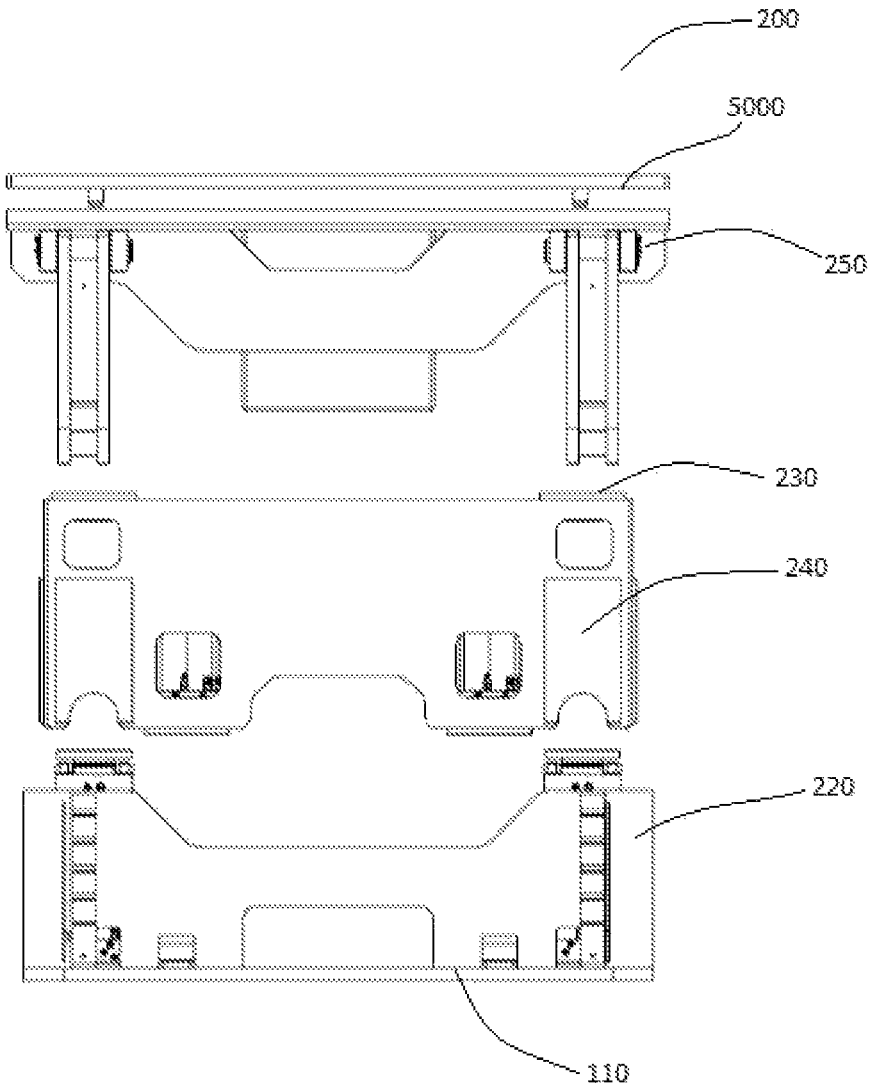
FIG. 39 is a front view thereof.
Figure 40:
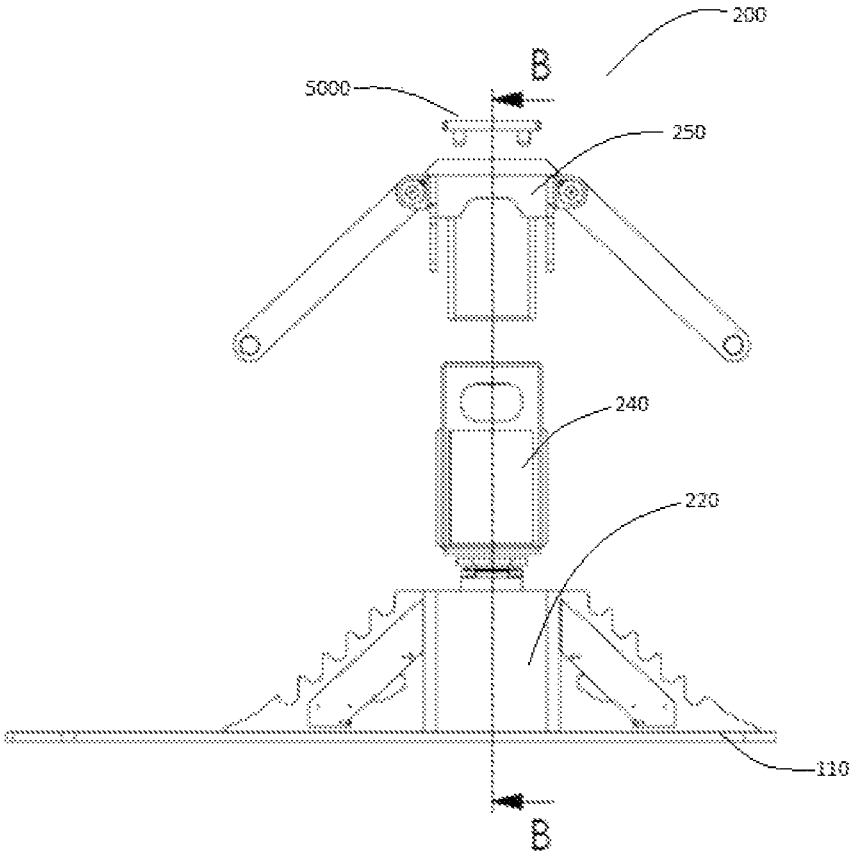
FIG. 40 is a left side view thereof.
Figure 41:
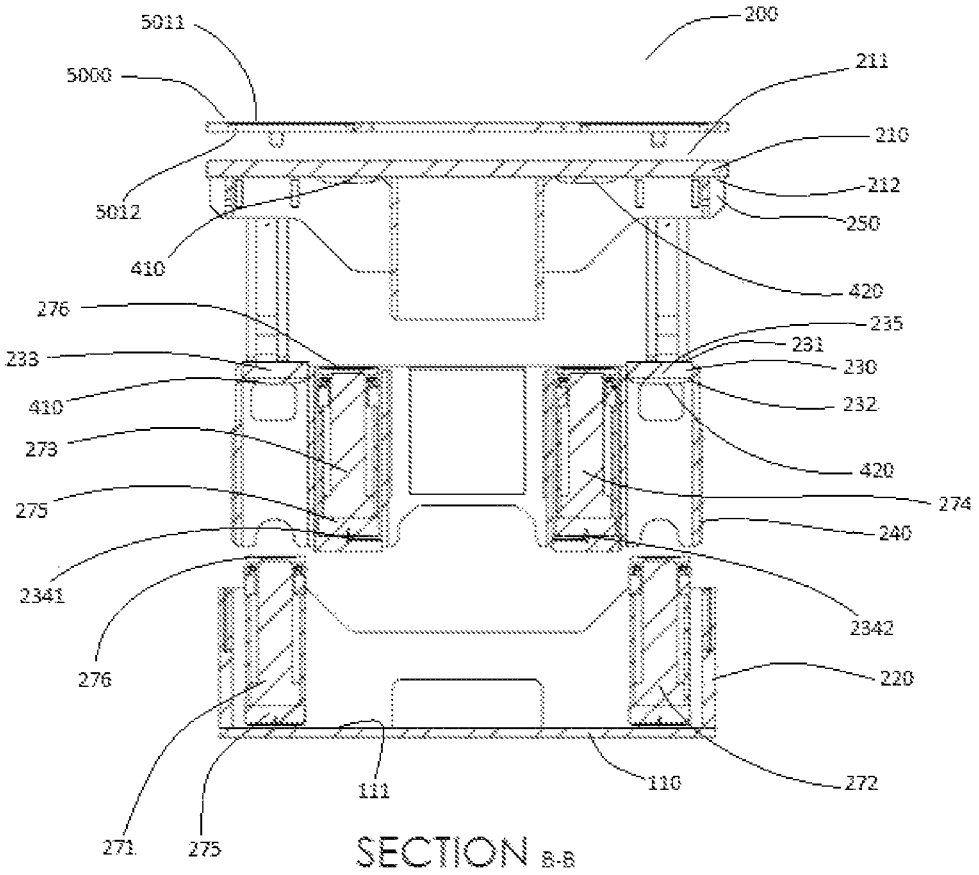
FIG. 41 is a cross-sectional view thereof taken along line B-B in FIG. 40.
Figure 42:
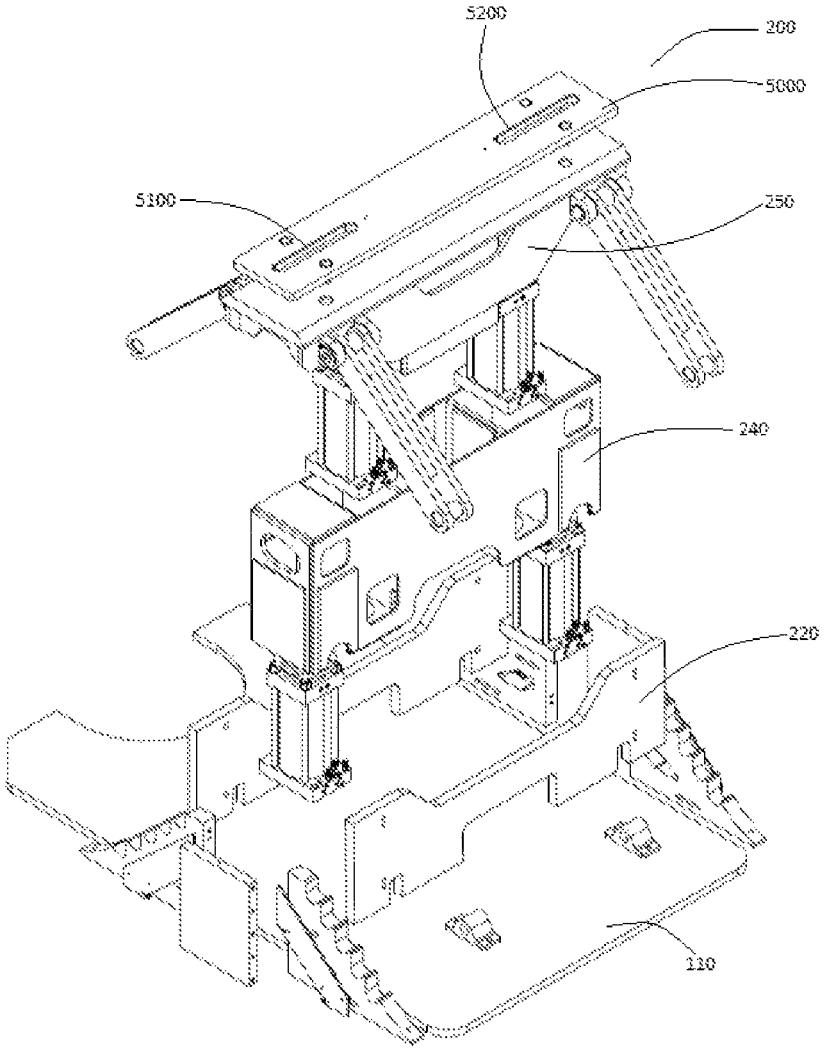
FIG. 42 is a fully exploded front perspective view thereof.

FIG. 38 is a partially exploded front perspective view illustrating the main lifting assembly 200 of FIG. 33 in accordance with an embodiment of the application. FIG. 39 is a front view thereof. FIG. 40 is a left side view thereof. FIG. 41 is a cross-sectional view thereof taken along line B-B in FIG. 40. And, FIG. 42 is a fully exploded front perspective view thereof.

According to one embodiment, the main lifting assembly 200 may include: a base lifting assembly (or frame) 220 mounted on the upper surface 111 of the base plate 110; an intermediate lifting assembly (or frame) 240 mounted over the base lifting assembly 220 and coupled thereto; a top lifting assembly (or frame) 250 mounted over the intermediate lifting assembly 240 and coupled thereto; compact spherical bearing cylinder mounts 410, 420; and, first, second, third, and fourth locking assemblies 810, 820, 830, 840.

According to one embodiment, the base lifting assembly (or frame) 220 may be mounted on the upper surface 111 of the base plate 110 and may have first and second main hydraulic lifting cylinders 271, 272 mounted therein. Each of the first and second main hydraulic lifting cylinders 271, 272 has a piston rod end 276 and a cylinder barrel end 275. The cylinder barrel end 275 of each of the first and second main hydraulic lifting cylinders 271, 272 may be mounted on the upper surface 111 of the base plate 110.

According to one embodiment, the intermediate lifting assembly 240 may have an intermediate plate 230 having a lower surface 232 and an upper surface 231. The intermediate plate 230 may have left and right lowered portions 2341, 2342 formed therein. The left and right portions 233, 235 of the intermediate plate 230 on either side of the left and right lowered portions 2341, 2342 are at the same level (or height) while the middle portion or left and right lowered portions 2341, 2342 of the intermediate plate 230 are at a lower level (or height). Alternatively, the left and right lowered portions 2341, 2342 may be a single lowered portion 234 similar to that shown in FIG. 24. The intermediate plate 230 may be positioned over and parallel or approximately parallel to the base plate 110. The lower surface 232 of the left and right portions 233, 235 of the intermediate plate 230 may be coupled to the piston rod ends 276 of the first and second main hydraulic lifting cylinders 271, 272 of the base lifting assembly 220, respectively, via respective compact spherical bearing mounts 410, 420. The upper surface 231 of the left and right lowered portions 2341, 2342 of the intermediate plate 230 may have third and fourth main hydraulic lifting cylinders 273, 274 mounted thereto, respectively. Each of the third and fourth main hydraulic lifting cylinders 273, 274 has a piston rod end 276 and a cylinder barrel end 275. The cylinder barrel end 275 of each of the third and fourth main hydraulic lifting cylinders 273, 274 may be mounted on the upper surface 231 of the left and right lowered portions 2341, 2342 of the intermediate plate 230, respectively.

Advantageously, by using an intermediate plate 230 having a lowered portion 234 or lowered portions 2341, 2342 formed therein, the overall height of the main lifting assembly 200 may be reduced.

According to one embodiment, the top lifting assembly 250 may have a top plate 210 having a lower surface 212 and an upper surface 211. The top plate 210 may be positioned over and parallel or approximately parallel to the intermediate plate 230. The lower surface 212 of the top plate 210 may be coupled to the piston rod end 276 of each of the third and fourth main hydraulic lifting cylinders 273, 274 of the intermediate lifting assembly 240 via respective compact spherical bearing mounts 410, 420. The upper surface 211 of the top plate 210 may be adapted for contacting the lifting points 1020, 1030 of a truck 1000 (or other load) either directly or via optional sliding adaptor blocks 6100, 6200 mounted to the upper surface 211 of the top plate 210 via an optional adaptor block mounting plate 5000 as described further below.

Figure 43:
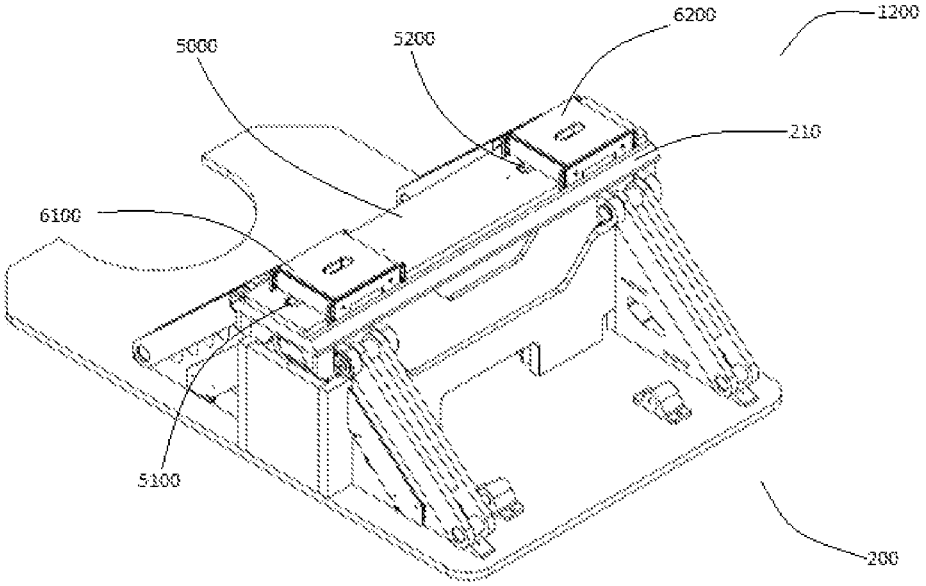
FIG. 43 is a front perspective view illustrating a main lifting assembly for the jack of FIG. 1 with the top plate shown in a lowered position and equipped with sliding adapter blocks and an adapter block mounting plate in accordance with another embodiment of the application.
Figure 44:
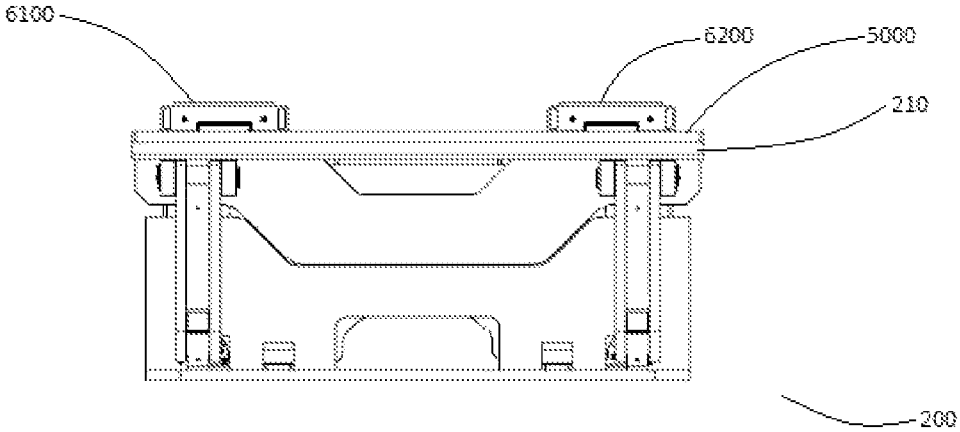
FIG. 44 is a front view thereof.
Figure 45:
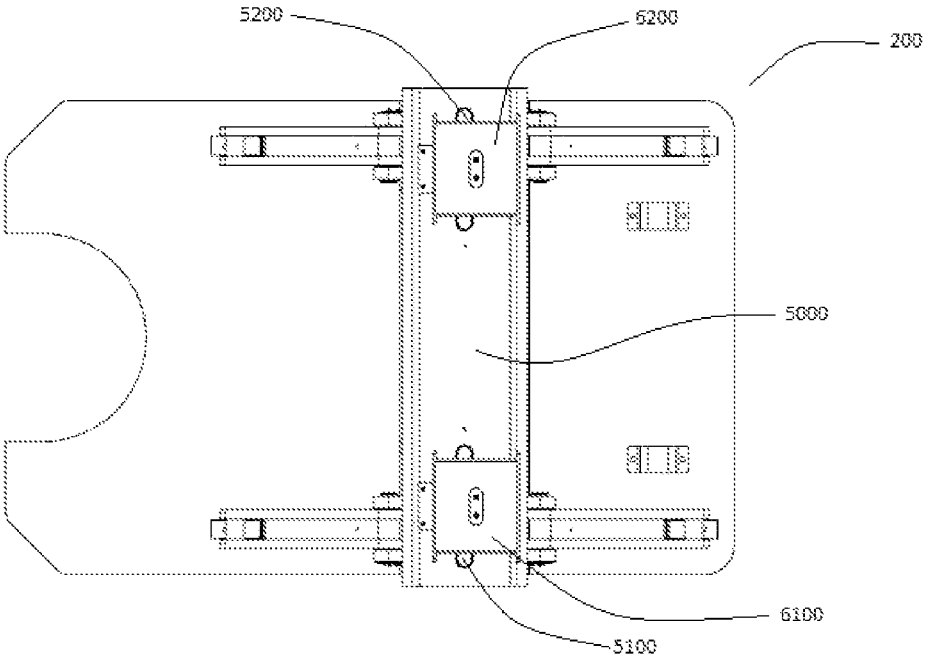
FIG. 45 is a top view thereof.
Figure 46:
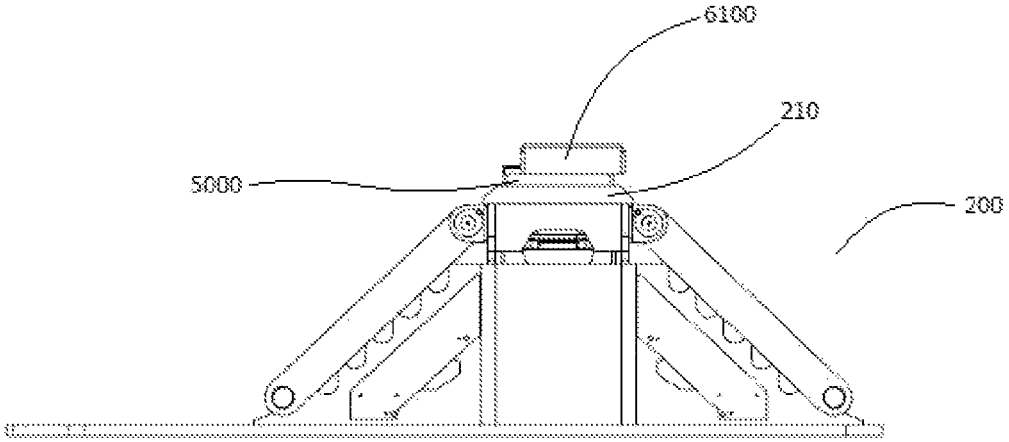
FIG. 46 is a left side view thereof.
Figure 47:
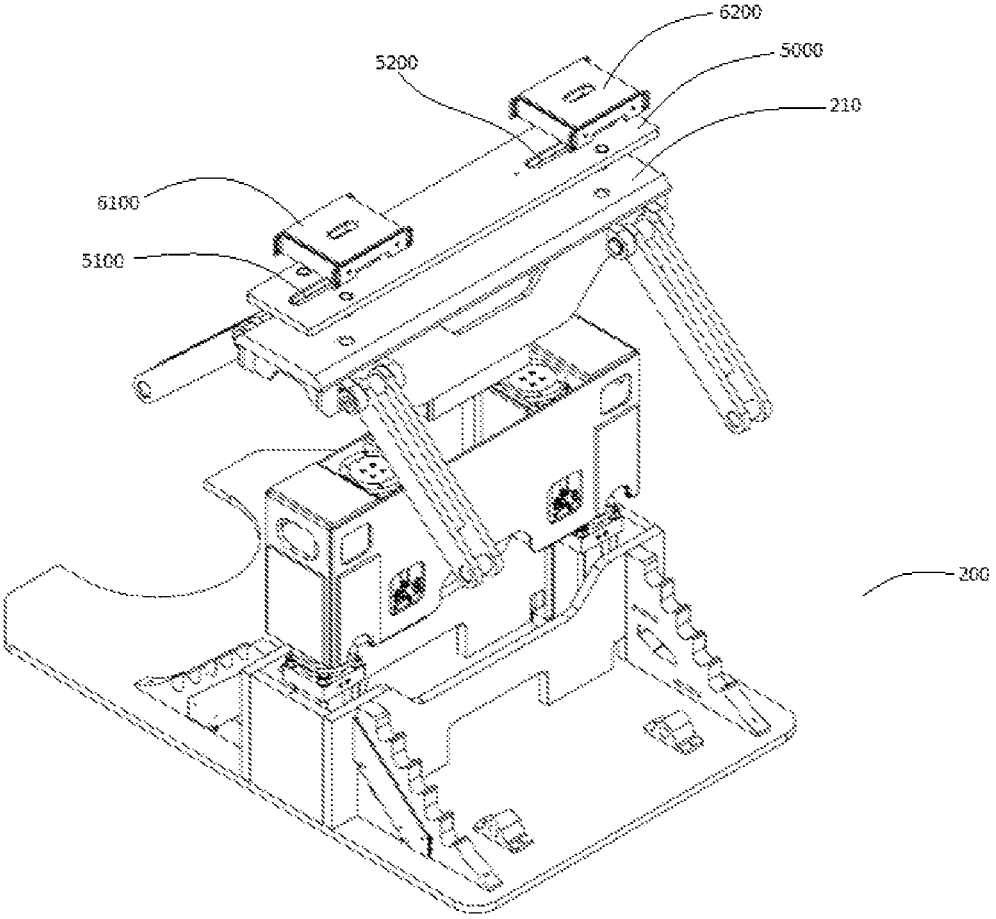
FIG. 47 is a partially exploded front perspective view illustrating the main lifting assembly of FIG. 43 in accordance with an embodiment of the application.
Figure 48:
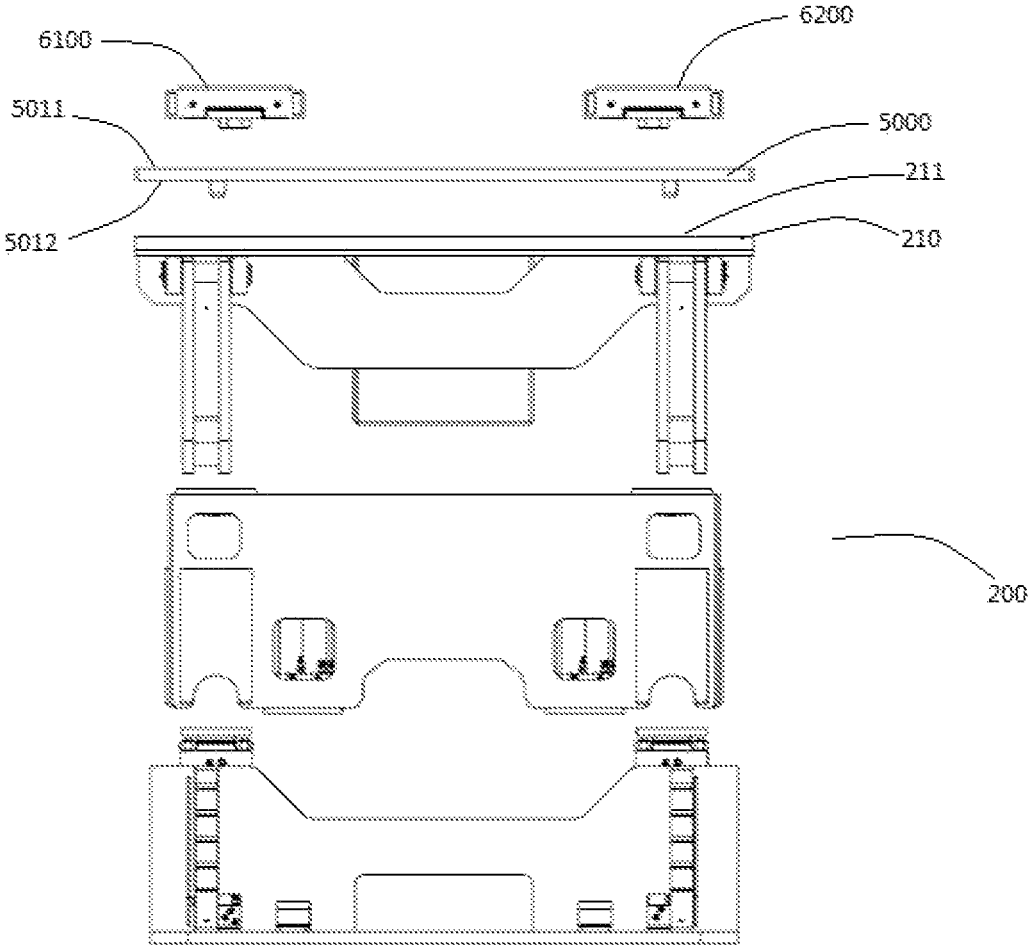
FIG. 48 is a front view thereof.

FIG. 43 is a front perspective view illustrating a main lifting assembly 200 for the jack 100 of FIG. 1 with the top plate 210 (and intermediate plate 230) shown in a lowered position 1200 and equipped with sliding adapter blocks 6100, 6200 and an adapter block mounting plate 5000 in accordance with another embodiment of the application. FIG. 44 is a front view thereof. FIG. 45 is a top view thereof. FIG. 46 is a left side view thereof. FIG. 47 is a partially exploded front perspective view illustrating the main lifting assembly 200 of FIG. 43 in accordance with an embodiment of the application. And, FIG. 48 is a front view thereof.

The upper surface 211 of the top plate 210 may be adapted for contacting the lifting points 1020, 1030 of a truck 1000 (or other load) via sliding adapter blocks 6100, 6200 mounted to the upper surface 211 of the top plate 210 via an adapter block mounting plate 5000.

The sliding adapter blocks 6100, 6200 are provided to shift a heavy load (e.g., a 220 ton truck) 1000 while preventing or reducing any misalignment or bending of the main lifting assembly 200 of the jack 100 (e.g., misalignment or bending with respect to the vertical axis of the main lifting assembly 200 from front 150 to rear 160 (and/or from rear 160 to front 150) of the jack 100). This allows the four locking bars 812 of the locking assemblies 810, 820, 830, 840 to function smoothly and effectively and reduces or eliminates top plate 210 or adapter block 6100, 6200 to load (e.g., truck body) 1000 contact slippage.

According to one embodiment, the adapter block mounting plate 5000 has an upper surface 5011 upon which one or more adapter blocks 6100, 6200 are mounted. The lower surface 5012 of the adapter block mounting plate 5000 is attached to the upper surface of the top plate 210 of the main lifting assembly 200. The adapter block mounting plate 5000 may have one or more mounting slots 5100, 5200 formed therein for receiving and positioning respective adapter blocks 6100, 6200. The mounting slots 5100, 5200 may be positioned proximate left and right ends of the mounting plate 5000, respectively, and may extend longitudinally across a portion of the mounting plate 5000. The mounting slots 5100, 5200 allow the upper surfaces (e.g., 6111) of the adapter blocks 6100, 6200 to be accurately positioned under the lifting points 1020, 1030 of a truck 1000 (or other load).

Figure 49:
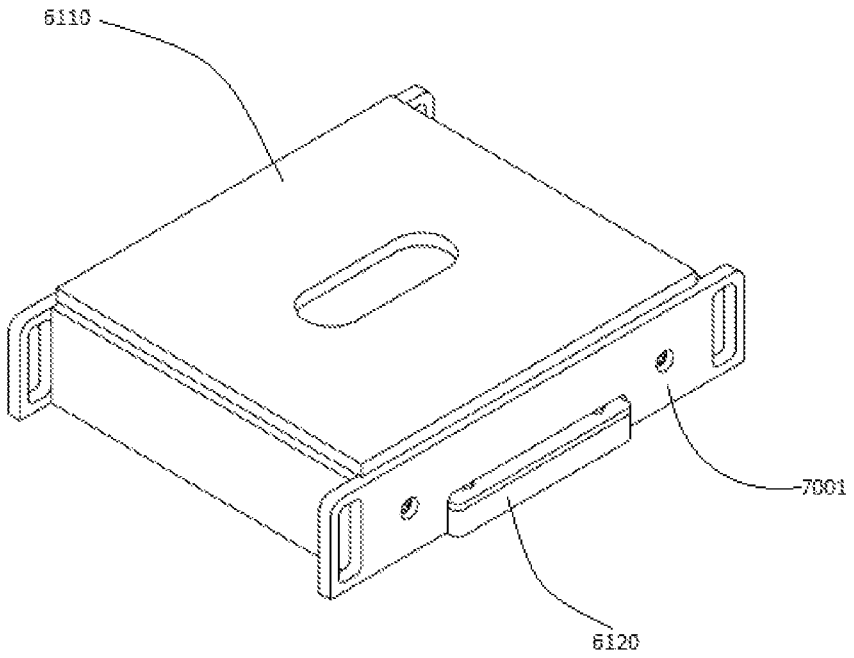
FIG. 49 is a front perspective view illustrating one of the sliding adapter blocks shown in FIG. 43 with the top adapter plate thereof shown in a first, unloaded, or retracted position in accordance with an embodiment of the application.
Figure 50:
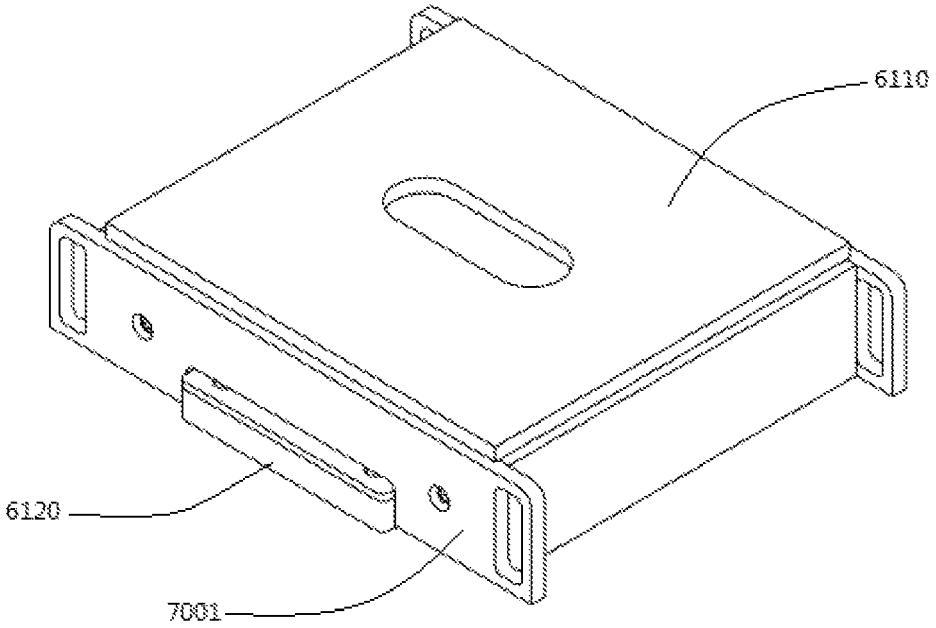
FIG. 50 is a rear perspective view thereof.
Figure 51:
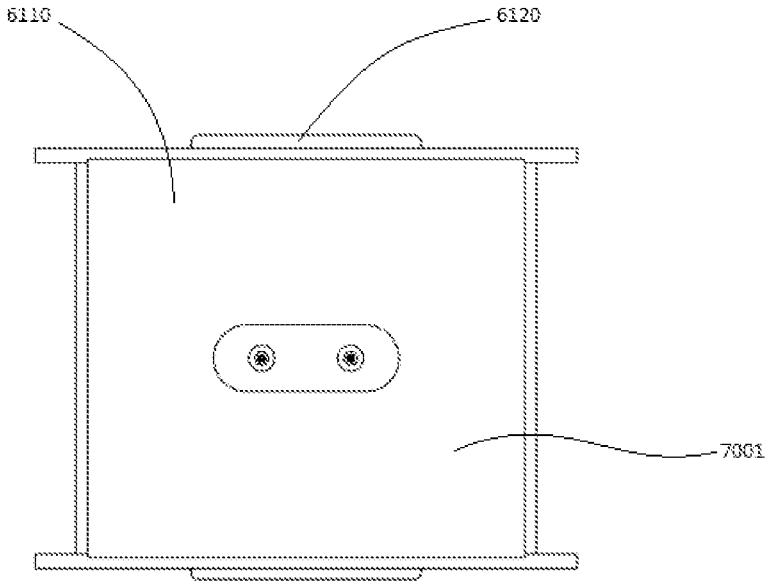
FIG. 51 is a top view thereof.
Figure 52:
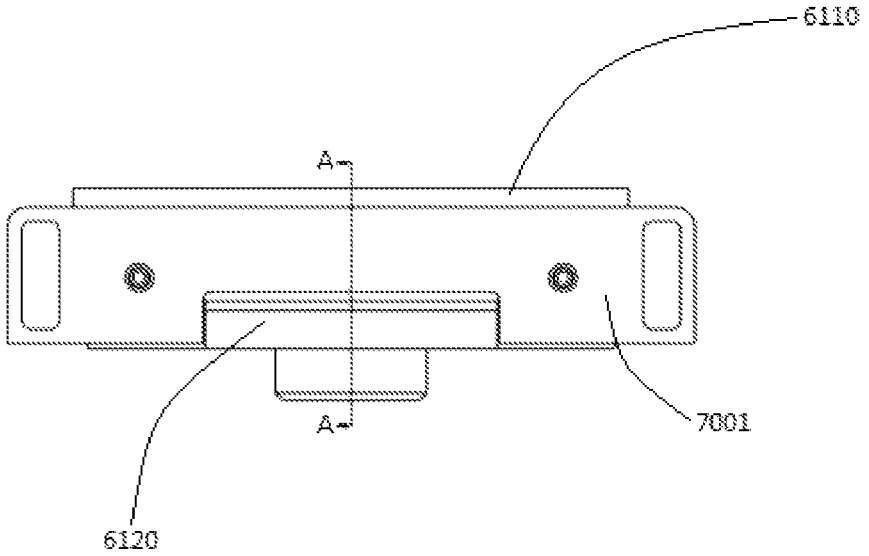
FIG. 52 is a front view thereof.
Figure 53:
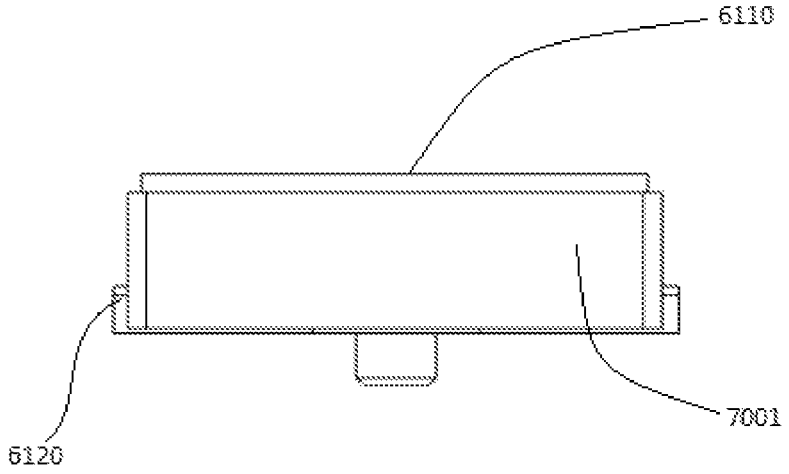
FIG. 53 is a right side view thereof.
Figure 54:
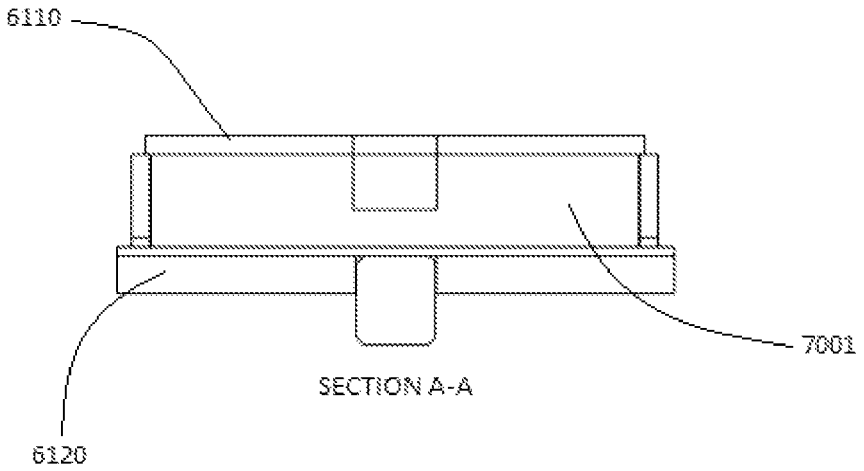
FIG. 54 is a cross-sectional view thereof taken along line A-A in FIG. 52.

FIG. 49 is a front perspective view illustrating one of the sliding adapter blocks 6100 shown in FIG. 43 with the top adapter plate 6110 thereof shown in a first, unloaded, or retracted position 7001 in accordance with an embodiment of the application. FIG. 50 is a rear perspective view thereof. FIG. 51 is a top view thereof. FIG. 52 is a front view thereof. FIG. 53 is a right side view thereof. And, FIG. 54 is a cross-sectional view thereof taken along line A-A in FIG. 52.

Figure 55:
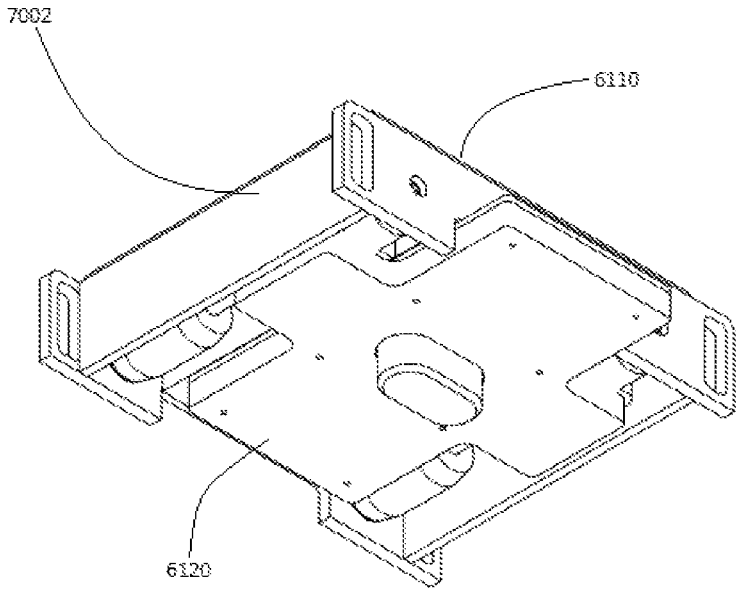
FIG. 55 is a bottom perspective view thereof with the top adapter plate thereof shown in second or rearward position.
Figure 56:
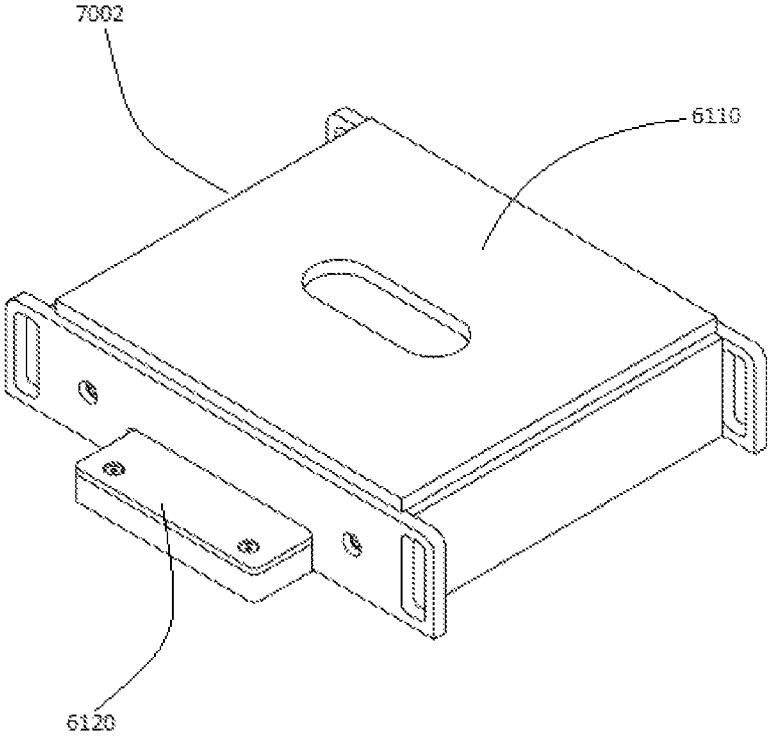
FIG. 56 is a front perspective view thereof.
Figure 57:
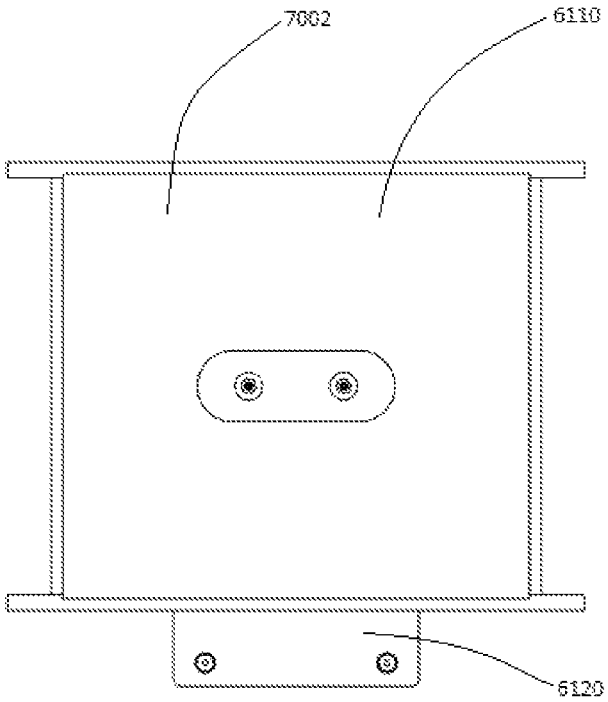
FIG. 57 is a top view thereof.
Figure 58:
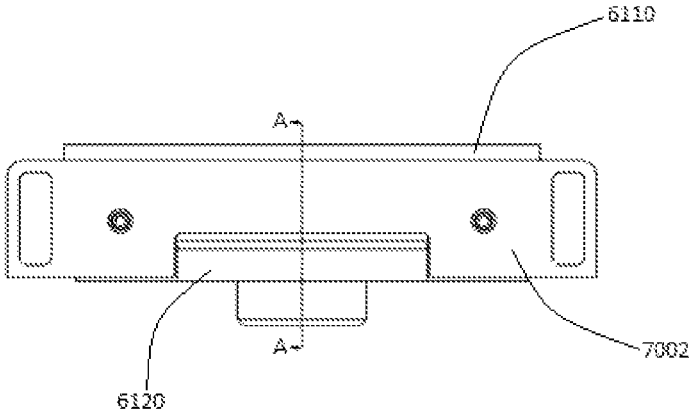
FIG. 58 is a front view thereof.
Figure 59:
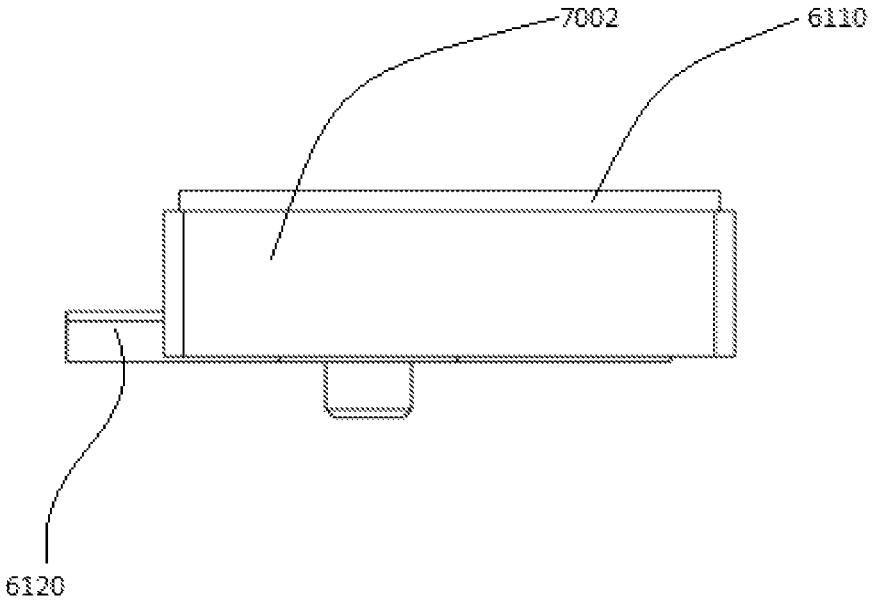
FIG. 59 is a right side view thereof.
Figure 60:
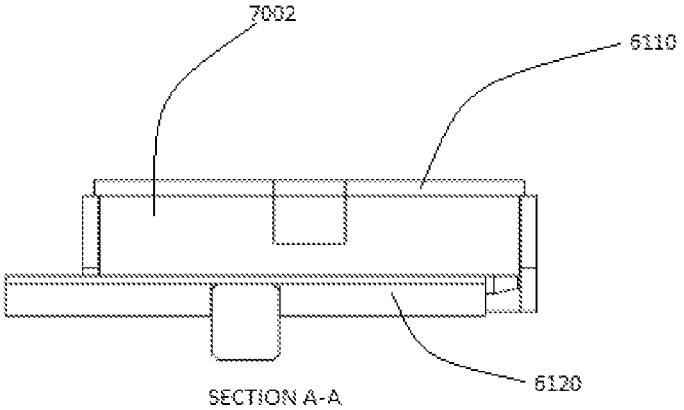
FIG. 60 is a cross-sectional view thereof taken along line A-A in FIG. 58.

FIG. 55 is a bottom perspective view thereof with the top adapter plate 6110 thereof shown in second or rearward position 7002. FIG. 56 is a front perspective view thereof. FIG. 57 is a top view thereof. FIG. 58 is a front view thereof. FIG. 59 is a right side view thereof. And, FIG. 60 is a cross-sectional view thereof taken along line A-A in FIG. 58.

Figure 61:
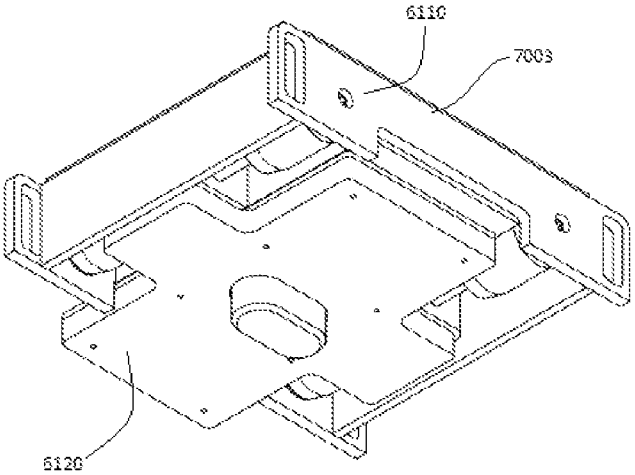
FIG. 61 is a bottom perspective view thereof with the top adapter plate thereof shown in a third or forward position.
Figure 62:
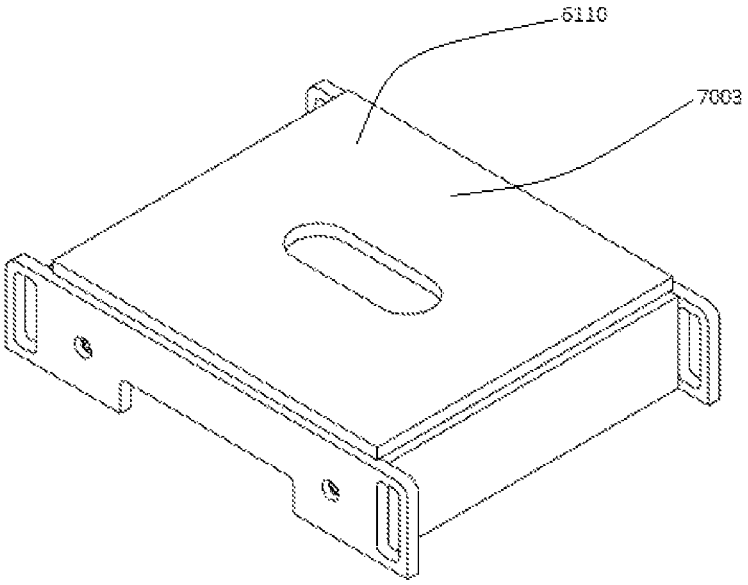
FIG. 62 is a front perspective view thereof.
Figure 63:
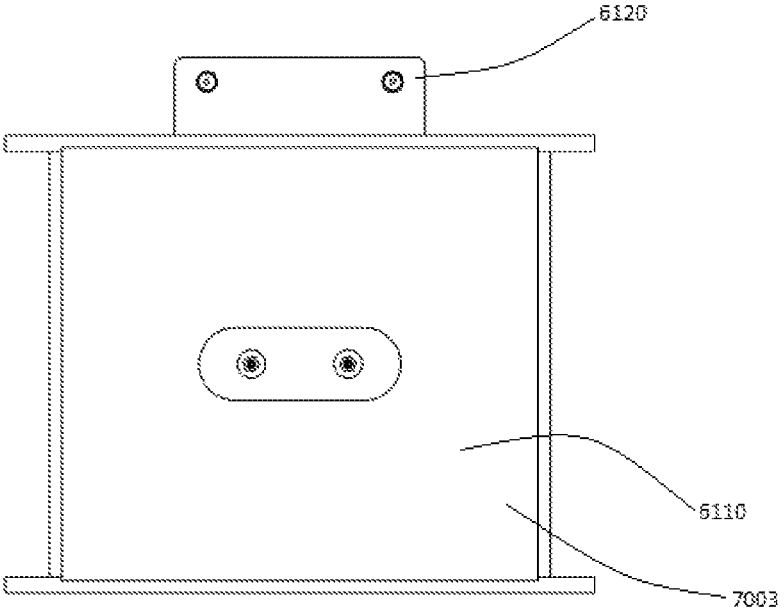
FIG. 63 is a top view thereof.
Figure 64:
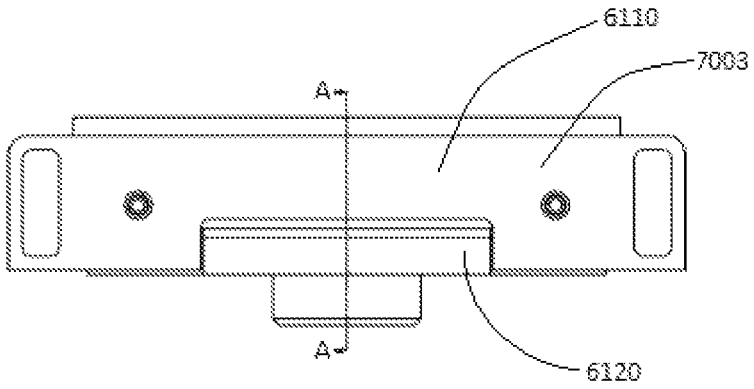
FIG. 64 is a front view thereof.
Figure 65:
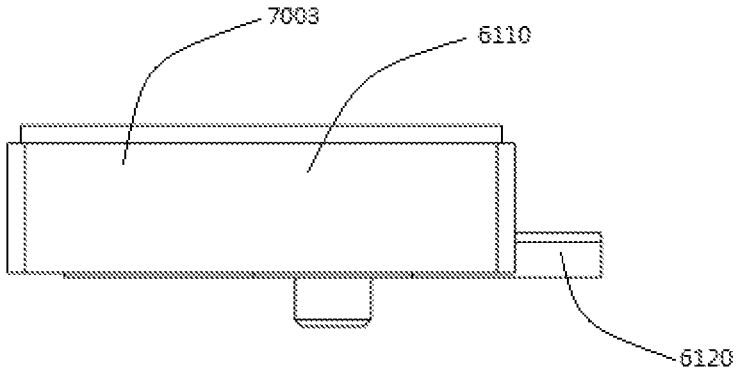
FIG. 65 is a right side view thereof.
Figure 66:
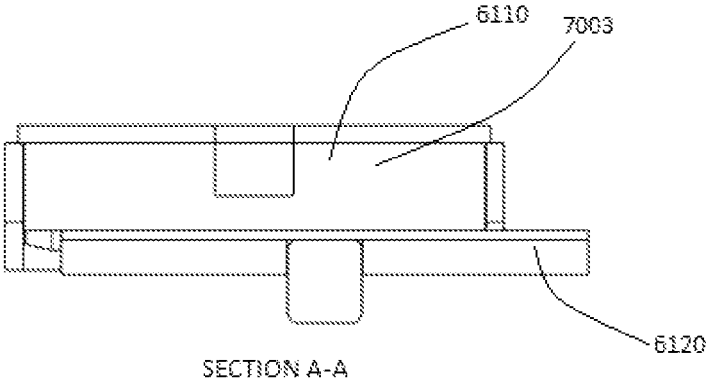
FIG. 66 is a cross-sectional view thereof taken along line A-A in FIG. 64.

FIG. 61 is a bottom perspective view thereof with the top adapter plate 6110 thereof shown in a third or forward position 7003. FIG. 62 is a front perspective view thereof. FIG. 63 is a top view thereof. FIG. 64 is a front view thereof. FIG. 65 is a right side view thereof. And, FIG. 66 is a cross-sectional view thereof taken along line A-A in FIG. 64.

Figure 67:
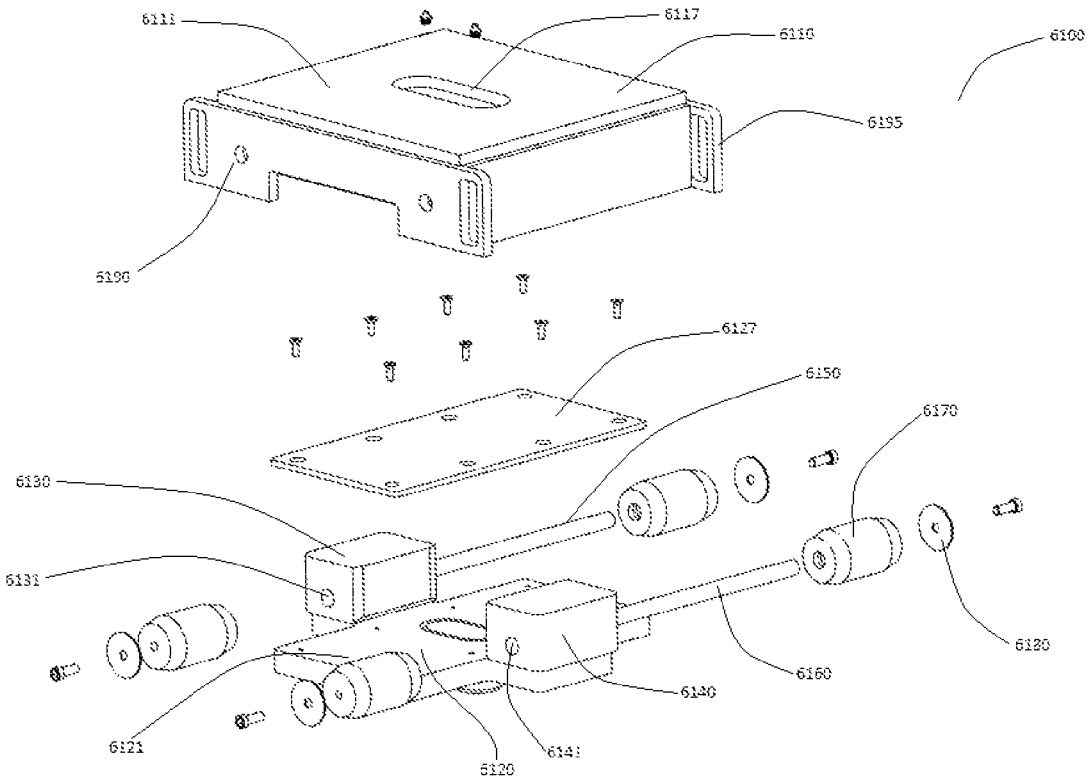
FIG. 67 is an exploded perspective view illustrating one of the sliding adapter blocks shown in FIG. 43 in accordance with an embodiment of the application.
Figure 68:
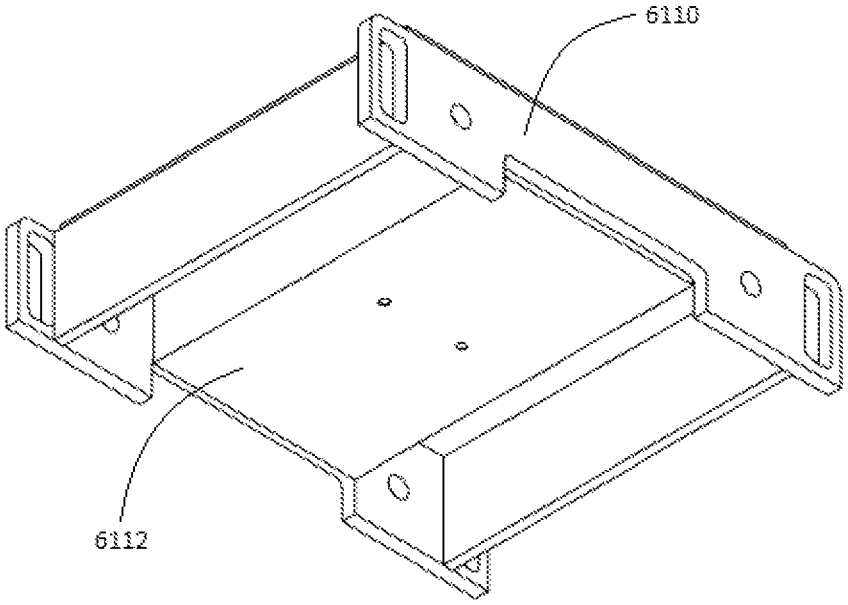
FIG. 68 is bottom perspective view illustrating the top adapter plate of the sliding block adapter block of FIG. 67 in accordance with an embodiment of the application.
Figure 69:
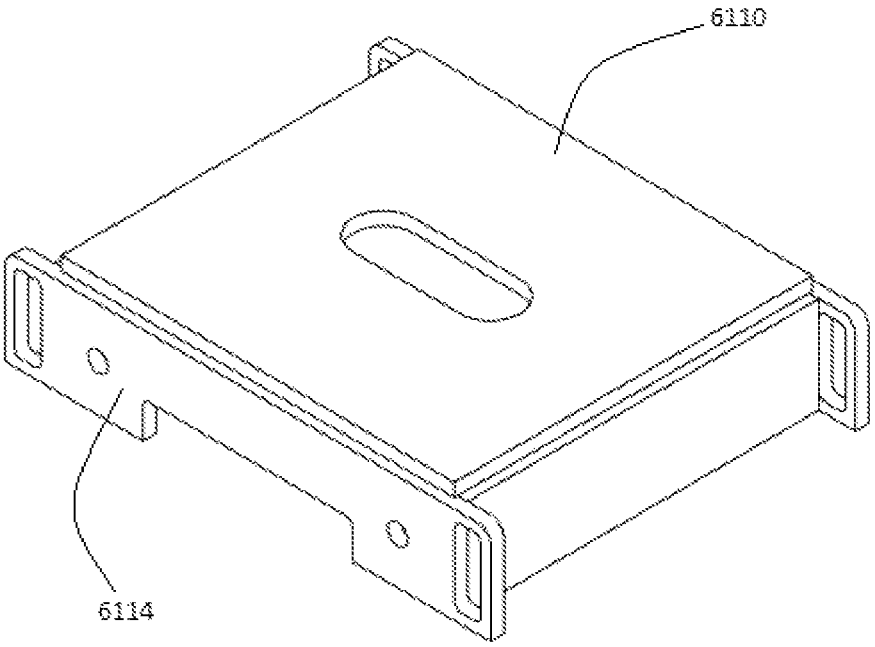
FIG. 69 is a rear perspective view thereof.
Figure 70:
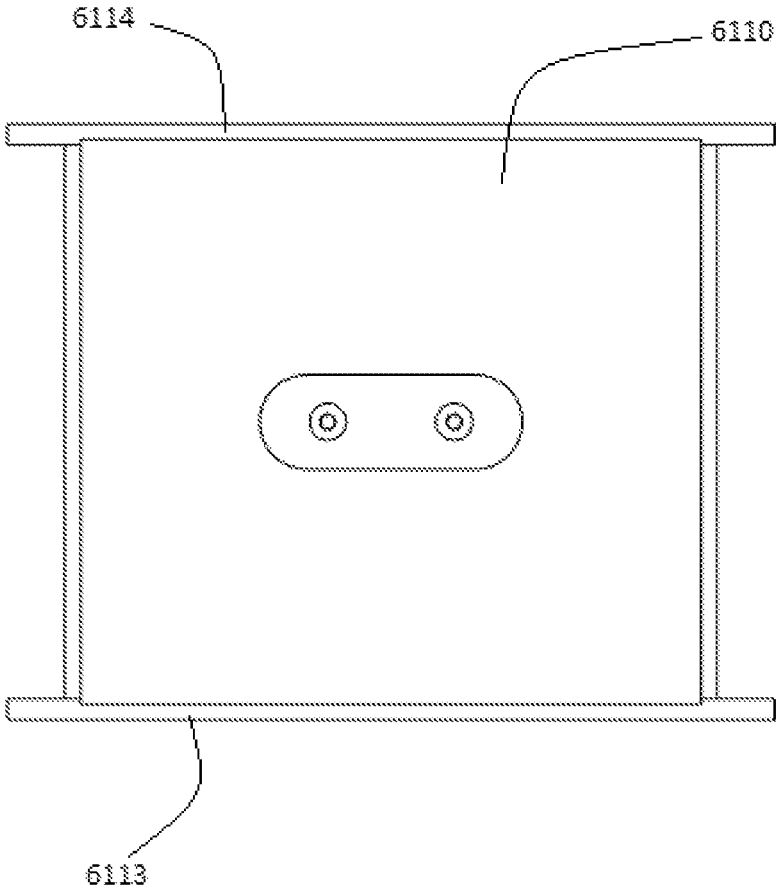
FIG. 70 is a top view thereof.
Figure 71:
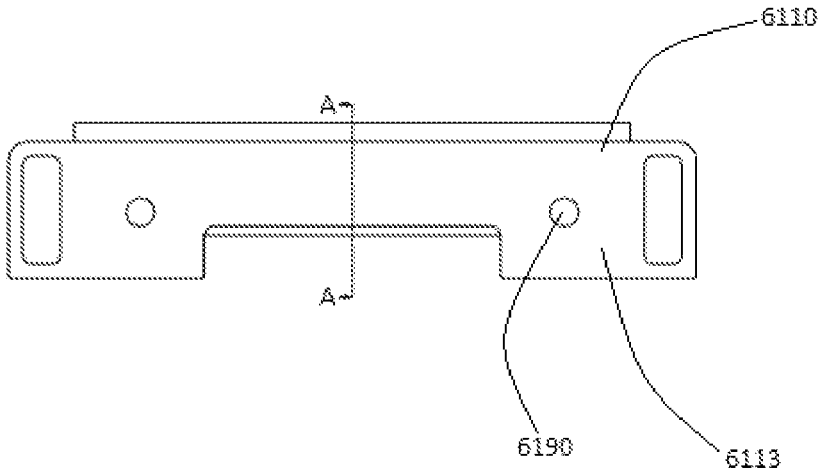
FIG. 71 is a front view thereof.
Figure 72:
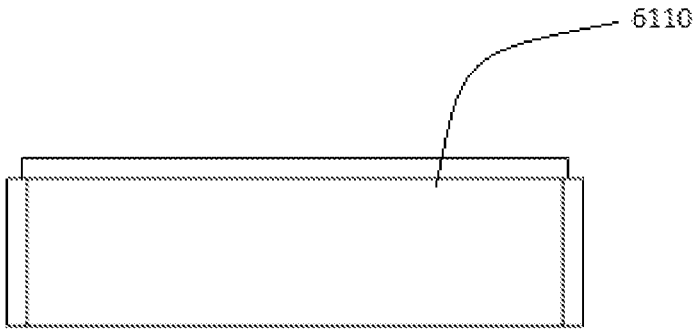
FIG. 72 is a right side view thereof.
Figure 73:
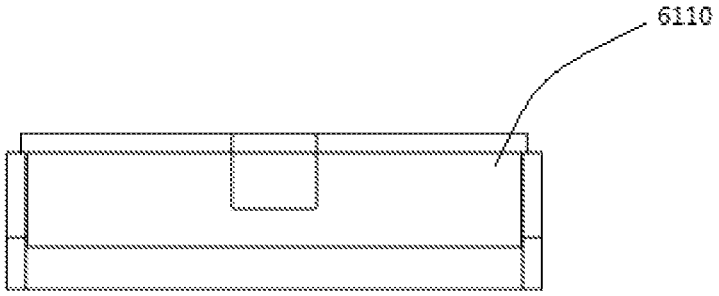
FIG. 73 is a cross-sectional view thereof taken along line A-A in FIG. 71.

FIG. 67 is an exploded perspective view illustrating one of the sliding adapter blocks 6100 shown in FIG. 43 in accordance with an embodiment of the application. FIG. 68 is bottom perspective view illustrating the top adapter plate 6110 of the sliding block adapter block 6100 of FIG. 67 in accordance with an embodiment of the application. FIG. 69 is a rear perspective view thereof. FIG. 70 is a top view thereof. FIG. 71 is a front view thereof. FIG. 72 is a right side view thereof. And, FIG. 73 is a cross-sectional view thereof taken along line A-A in FIG. 71.

Figure 74:
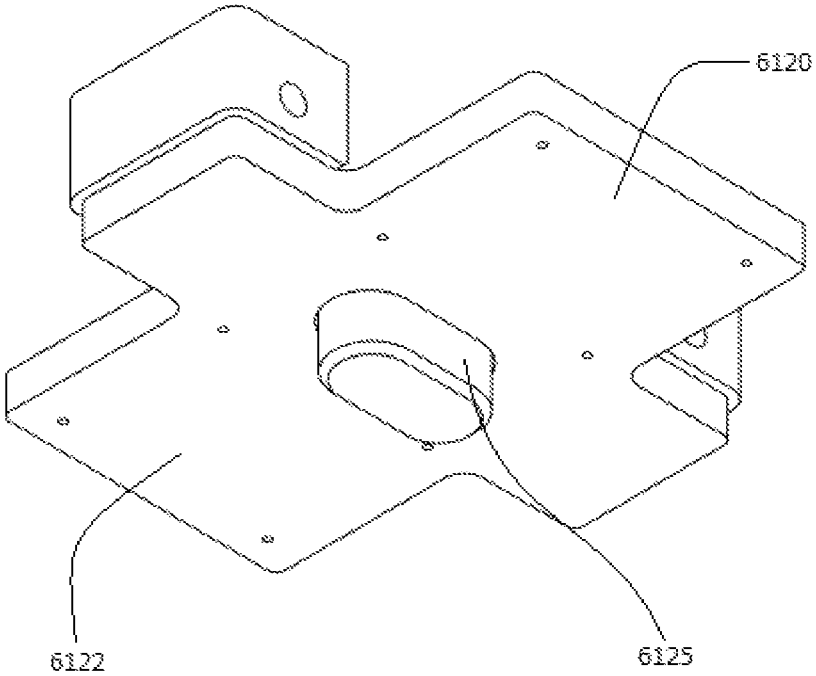
FIG. 74 is bottom perspective view illustrating the bottom adapter plate of the sliding block adapter block of FIG. 67 in accordance with an embodiment of the application.
Figure 75:
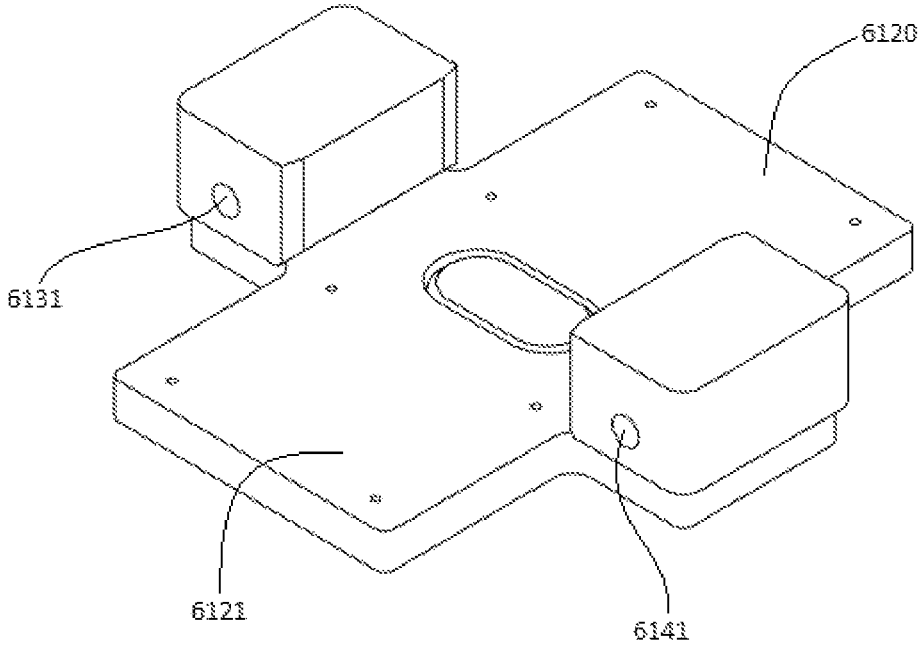
FIG. 75 is a rear perspective view thereof.
Figure 76:
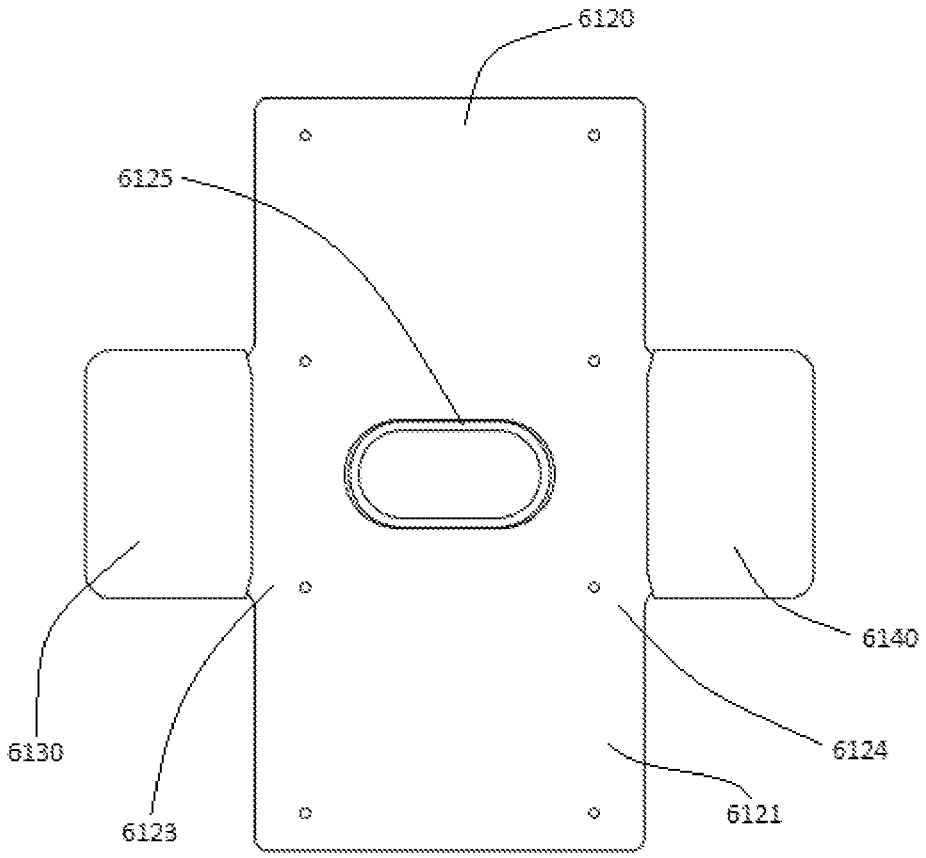
FIG. 76 is a top view thereof.
Figure 77:
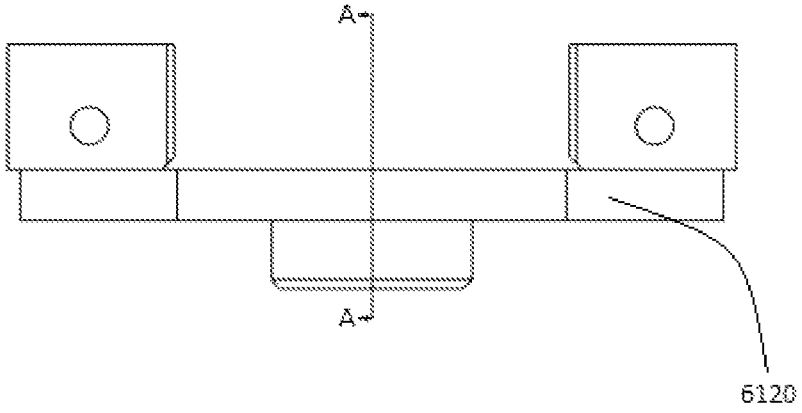
FIG. 77 is a front view thereof.
Figure 78:
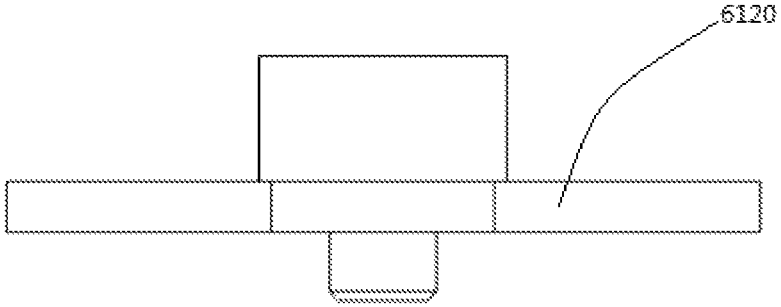
FIG. 78 is a right side view thereof.
Figure 79:
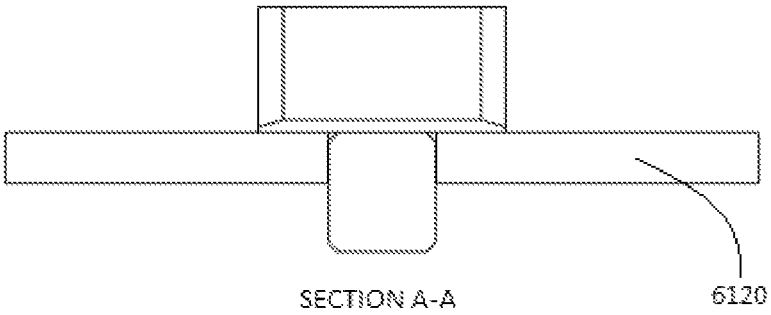
FIG. 79 is a cross-sectional view thereof taken along line A-A in FIG. 77.

FIG. 74 is bottom perspective view illustrating the bottom adapter plate 6120 of the sliding block adapter block 6100 of FIG. 67 in accordance with an embodiment of the application. FIG. 75 is a rear perspective view thereof. FIG. 76 is a top view thereof. FIG. 77 is a front view thereof. FIG. 78 is a right side view thereof. And, FIG. 79 is a cross-sectional view thereof taken along line A-A in FIG. 77.

According to one embodiment, each sliding adapter block (e.g., 6100) may include a top adapter plate 6110 slidably mounted over a bottom adapter plate 6120. The bottom plate adapter plate 6120 is used for mounting the sliding adapter block 6100 to the jack 100 (i.e., via the adapter block mounting plate 5000) and remains stationary with respect to the jack 100 during operation. A greased Nylatron™ sheet 6127 (or any similar nylon, plastic, nylon plastic, or friction reducing material) may be positioned between the lower surface 6112 of the top adapter plate 6110 and the upper surface 6121 of the bottom adapter plate 6120 to improve slippage (or reduce friction) between the top and bottom plates 6110, 6120. The sheet 6127 also reduces wear between the top and bottom adapter plates 6110, 6120. The top adapter plate 6110 may be coupled to the bottom adapter plate 6120 by first and second or left and right alignment rods 6150, 6160 which pass through respective holes 6131, 6141 formed in respective first and second or left and right alignment blocks 6130, 6140 mounted on respective first and second or left and right sides 6123, 6124 of the upper surface 6121 of the bottom adapter plate 6120. A rubber spring 6170 and a washer 6180 may be mounted on each end of each alignment rod 6150, 6160 and the top adapter plate 6110 may be attached (e.g., bolted, etc.) to the end of each alignment rod 6150, 6160 though respective mating holes 6190 formed in the front and rear sides 6113, 6114 of the top adapter plate 6110. The alignment rods 6150, 6160 slide within the holes 6131, 6141 formed in the alignment blocks 6130, 6140 allowing the top adapter plate 6110 to move or slip on the sheet 6127 over the bottom adapter plate 6120 and between the alignment blocks 6130, 6140.

As shown in FIG. 68, according to one embodiment, the lower surface 6112 of the top adapter plate 6110 extends downward to contact the greased Nylatron™ sheet 6127 on the upper surface 6121 of the lower adapter plate 6120. As shown in FIG. 74, the lower surface 6122 of the bottom adapter block 6120 may be equipped with an alignment extrusion 6125 which mates with a mounting slot (e.g., 5100) of the adapter block mounting plate 5000. As shown in FIG. 67, the top adapter plate 6110 may be equipped with handles 6195 for transport, ease of handling, and positioning. And, also as shown in FIG. 67, a slot 6117 may be formed in the upper surface 6111 of the top adaptor plate 6110 for the optional mounting of lifting adapters (not shown).

In operation, when the jack 100 begins lifting a load 1000, lateral loading (i.e., from front 150 to rear 160 (and/or from rear 160 to front 150) of the jack 100) causes the top adapter plate 6110 to slide over the bottom adapter plate 6120 from a first or unloaded or retracted position 7001 to either a second or rearward position 7002 or a third or forward position 7003 depending on the direction of the lateral loading. The sliding is facilitated by the greased Nylatron™ sheet 6127 positioned between the top and bottom adapter plates 6110, 6120. This sliding of the top adapter plate 6110 improves or maintains vertical or approximately vertical alignment of the main lifting assembly 200 below the load 1000 which improves the stability of the jack 100. The rubber springs 6170 function to center the top adapter plate 6110, maintain proportional linear force, and reduce the speed of lateral shifting of the top adapter plate 6110 over the bottom adaptor plate 6120. The washers 6180 provide a surface for the rubber springs 6170 to elastically deform during shifting of the top adapter plate 6110. The alignment blocks 6130, 6140, alignment rods 6150, 6160 align the top and bottom adapter plates 6110, 6120 making them function as one unit and allowing for the top adapter plate 6110 to shift smoothly when the jack 100 is under lateral loading.

Thus, according to another embodiment, there is provided a jack 100, comprising: a top plate 210 having at least one adapter block (e.g., 6100) mounted thereon and adapted to contact a load 1000; an intermediate plate 230 positioned below the top plate 210; a base plate 110 positioned below the intermediate plate 230; a first pair of actuators 271, 272 coupled between the base plate 110 and the intermediate plate 230; and, a second pair of actuators 273, 274 coupled between respective lowered portions 2341, 2342 of the intermediate plate 230 and the top plate 210; wherein one of the first pair of actuators 271, 272 is positioned on the base plate 110 on either side of the respective lowered portions 2341, 2342 of the intermediate plate 230; wherein the first and second pairs of actuators 271, 272, 273, 274 are operable to move the top plate 210 and the intermediate plate 230 between respective lowered positions (e.g., 1200) and respective raised positions (e.g., 1600, 2000) to thereby lower and raise the load 1000; and, wherein a top adapter plate 6110 of the at least one adapter block 6100 is operable to slide between first 7001 and second positions 7002, 7003 on the top plate 210 as the load 1000 is raised and lowered to thereby maintain alignment of the top, intermediate, and base plates 210, 230, 110 below the load 1000.

In the above jack 100, the at least one adapter block 6100 may include a bottom adapter plate 6120 attached to the top plate 210 of the jack 100 and to which the top adapter plate 6110 is slidably attached. The top adapter plate 6110 may be slidably attached to the bottom adapter plate 6120 by a pair of alignment rods 6150, 6160 passing through respective alignment blocks 6130, 6140 mounted on either side 6123, 6124 of the bottom adapter plate 6120, the alignment rods 6150, 6160 may be attached to front and rear ends 6113, 6114 of the top adapter plate 6110 through respective rubber springs 6170. The jack 100 may further include a plastic sheet 6127 mounted between the top and bottom adapter plates 6110, 6120 to reduce friction between the top and bottom adapter plates 6110, 6120. The plastic sheet 6127 may be a greased nylon plastic sheet.

Also in the above jack 100, the first and second pairs of actuators 271, 272, 273, 274 may be operable simultaneously. The load 1000 may be a truck. The first and second pairs of actuators 271, 272, 273, 274 may be first and second pairs of hydraulic cylinders, respectively. The first and second pairs of actuators 271, 272, 273, 274 may be arranged in a row.

The above jack 100 may further include at least one locking assembly (e.g., 810) adapted to lock the top plate 210 in the raised position (e.g., 2000). The at least one locking assembly 810 may include a locking bar 812 and a ratchet rack 811, the locking bar 812 having an upper end 819 and a lower end 818, the locking bar 812 hinge mounted at the upper end 819 proximate to the top plate 210, the ratchet rack 811 inclining upward from the base plate 110 toward the top plate 210 and having at least one notch 813 formed therein, the at least one notch 813 adapted to receive and lock the lower end 818 of the locking bar 812, and the lower end 818 of the locking bar 812 slidable up the ratchet rack 811 and into the at least one notch 813 as the top plate 210 is moved from the lowered position 1200 to the raised position 1600, 2000. The at least one locking assembly 810 may further include a lock release assembly 850 adapted to unlock the top plate 210 allowing the top plate 210 to be moved from the raised position 1600, 2000 to the lowered position 1200. The lock release assembly 850 may include a lock release plate 851 inclining upward from the base plate 110 toward the top plate 210, the lock release plate 851 moveable from a retracted position 2510 to an extended position 2520 to urge the lower end 818 of the locking bar 812 out of the at least one notch 813 allowing the lower end 818 of the locking bar 812 to slide down the ratchet rack 811 and over the at least one notch 813 as the top plate 210 is moved from the raised position 1600, 2000 to the lowered position 1200. The locking bar 812, the ratchet rack 811, and the at least one notch 813 are mounted to be visible (e.g., from a location distant from the jack 100 and load 1000). The at least one locking assembly 810 may be four locking assemblies 810, 820, 830, 840. The at least one notch 813 may be five notches.

The above jack 100 may further include respective pairs of spherical radius bearing mounts 410, 420 adapted to couple the first pair of actuators 271, 272 to the intermediate plate 230 and the second pair of actuators 273, 274 to the top plate 210. The jack 100 may further include: a pair of retractable front wheels 131, 132 mounted proximate to a front end 150 of the base plate 110, the pair of retractable front wheels 131, 132 may be hydraulically driven; a pair of retractable and steerable rear wheels 141, 142 mounted proximate to a rear end 160 of the base plate 110; and, an engine 710 mounted on the base plate 110 for providing power to components of the jack 100. The jack 100 may be remotely controllable (e.g., from a location distant from the jack 100 and load 1000 via a remote control unit 8000). And, the jack 100 may further include a base lifting assembly 220 mounted to the base plate 110 within which the first pair of actuators 271, 272 are mounted, an intermediate lifting assembly 240 within which the second pair of actuators 273, 274 are mounted, and a top lifting assembly 250 on which the top plate 110 is mounted.

According to one embodiment, the compact spherical bearing cylinder mounts 410, 420 may be optional. According to one embodiment, one or more of: the first pair of actuators 271, 272 are directly (i.e., without intervening components, linkage arms, etc.) coupled (e.g., one or more of attached, connected, joined, bolted, welded, screwed, pinned, hinged, etc.) between the base plate 110 and the intermediate plate 230; and, the second pair of actuators 273, 274 are directly (i.e., without intervening components, linkage arms, etc.) coupled (e.g., one or more of attached, connected, joined, bolted, welded, screwed, pinned, hinged, etc.) between respective lowered portions 2341, 2342 of the intermediate plate 230 and the top plate 210. According to one embodiment, one or more of: the first pair of actuators 271, 272 are coupled perpendicularly or approximately perpendicularly between the base plate 110 and the intermediate plate 230; and, the second pair of actuators 273, 274 are coupled perpendicularly or approximately perpendicularly between respective lowered portions 2341, 2342 of the intermediate plate 230 and the top plate 210. According to one embodiment, the engine 710 may be an electric motor which may be powered by the battery 740.

Figure 80:
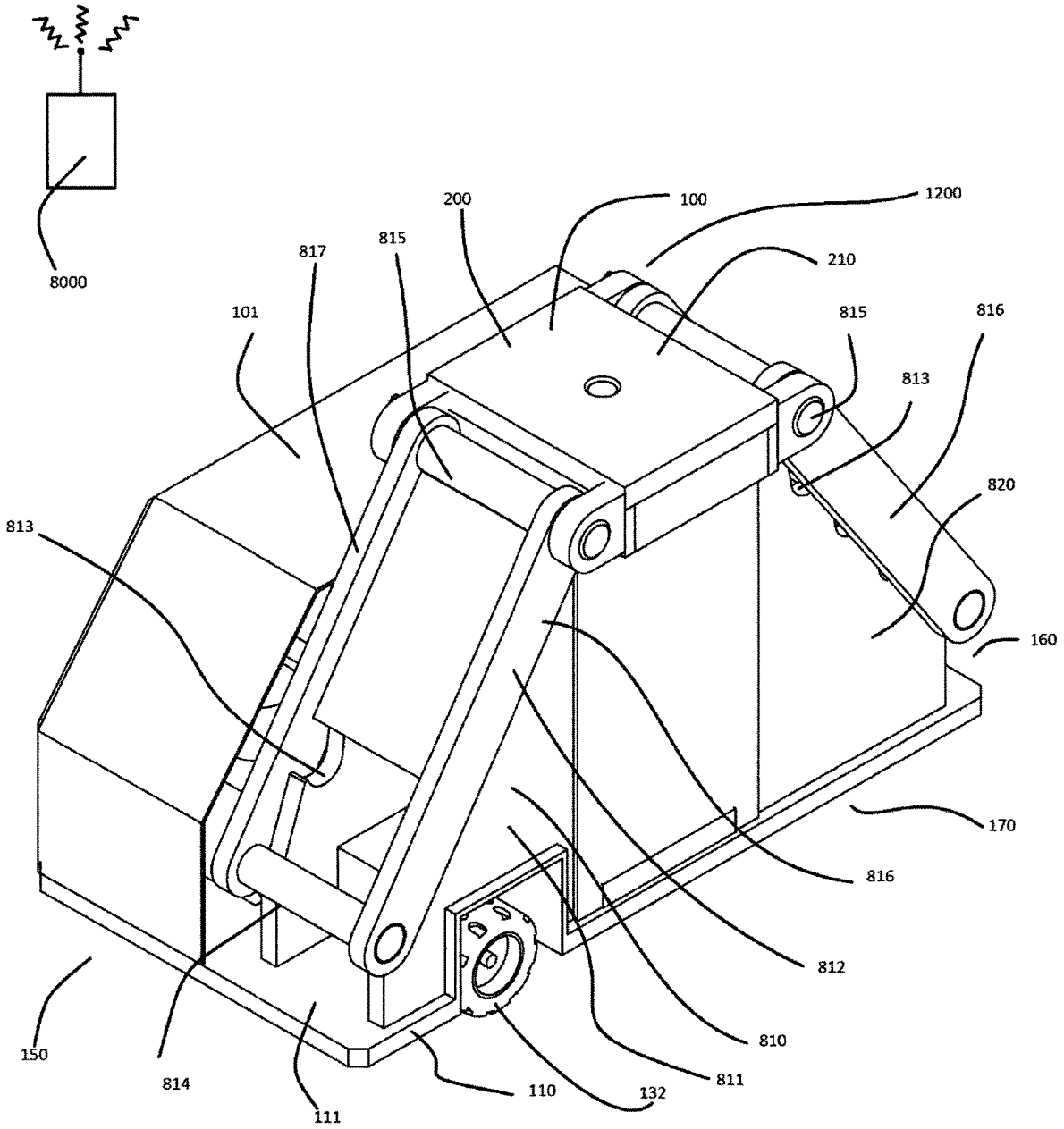
FIG. 80 is a front perspective view illustrating a jack with the top plate thereof shown in a lowered position in accordance with another embodiment of the application.
Figure 81:
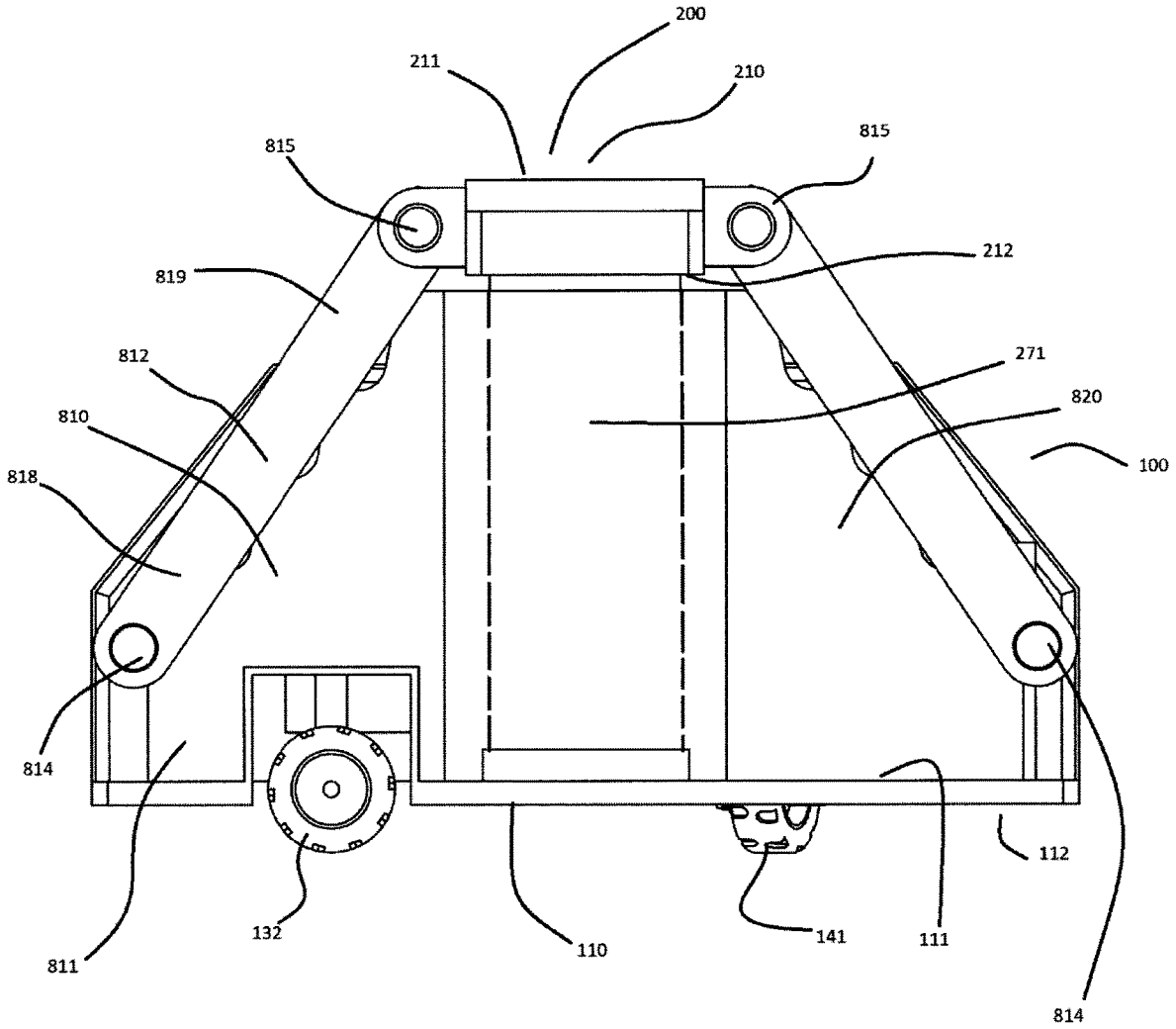
FIG. 81 is a right side view thereof.
Figure 82:
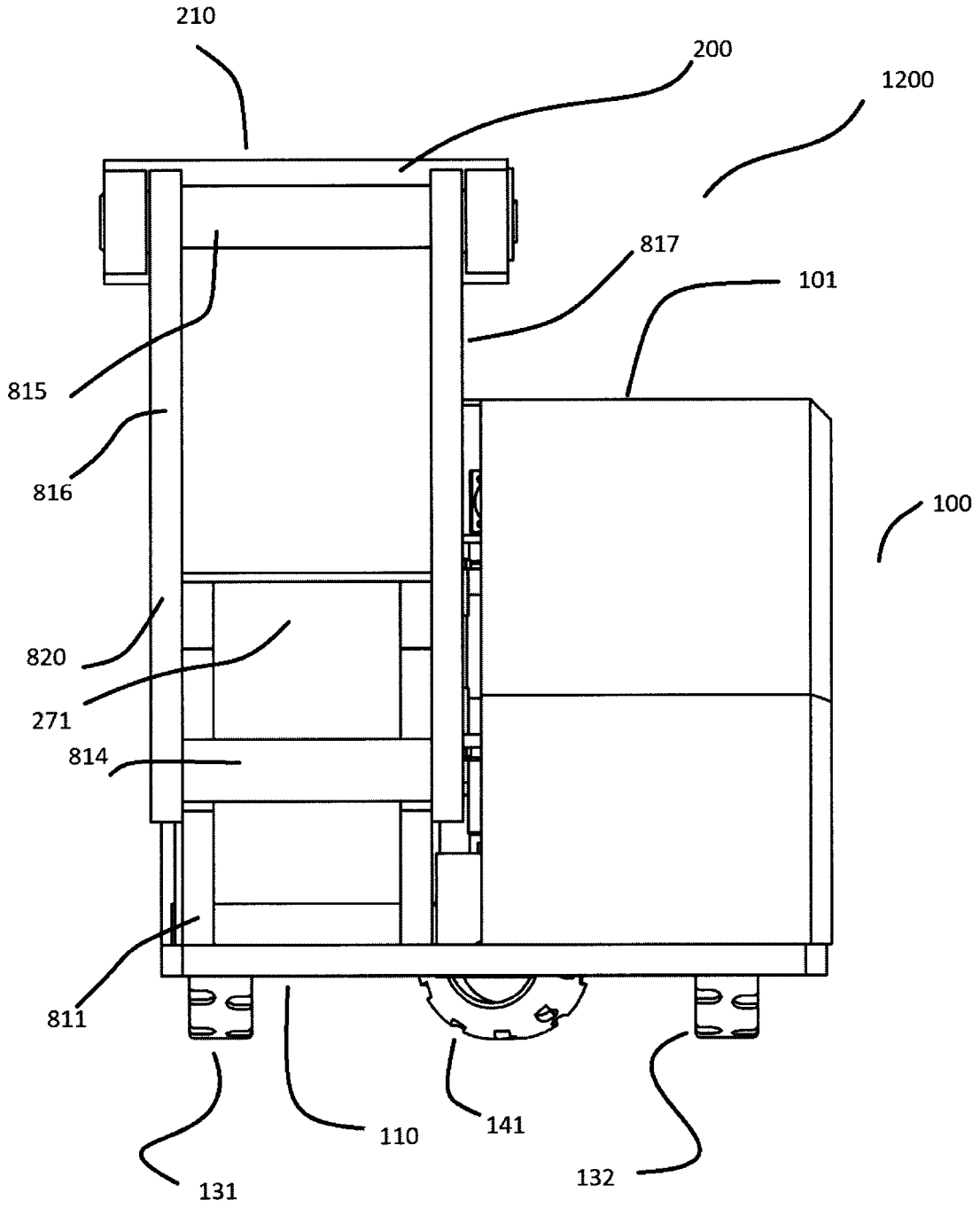
FIG. 82 is a rear view thereof.
Figure 83:
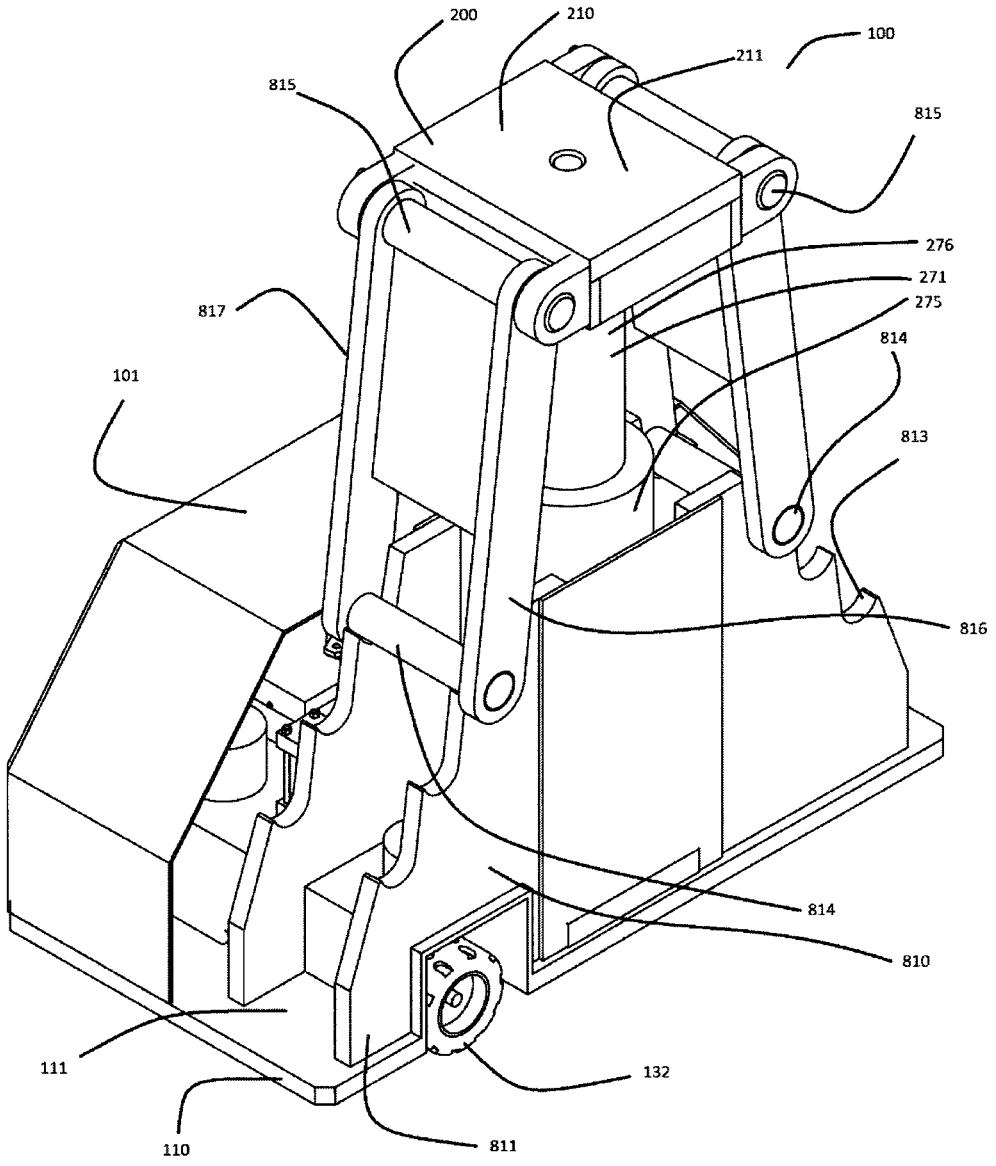
FIG. 83 is a front perspective view illustrating the jack of FIG. 80 with the top plate thereof shown in a raised position.
Figure 84:
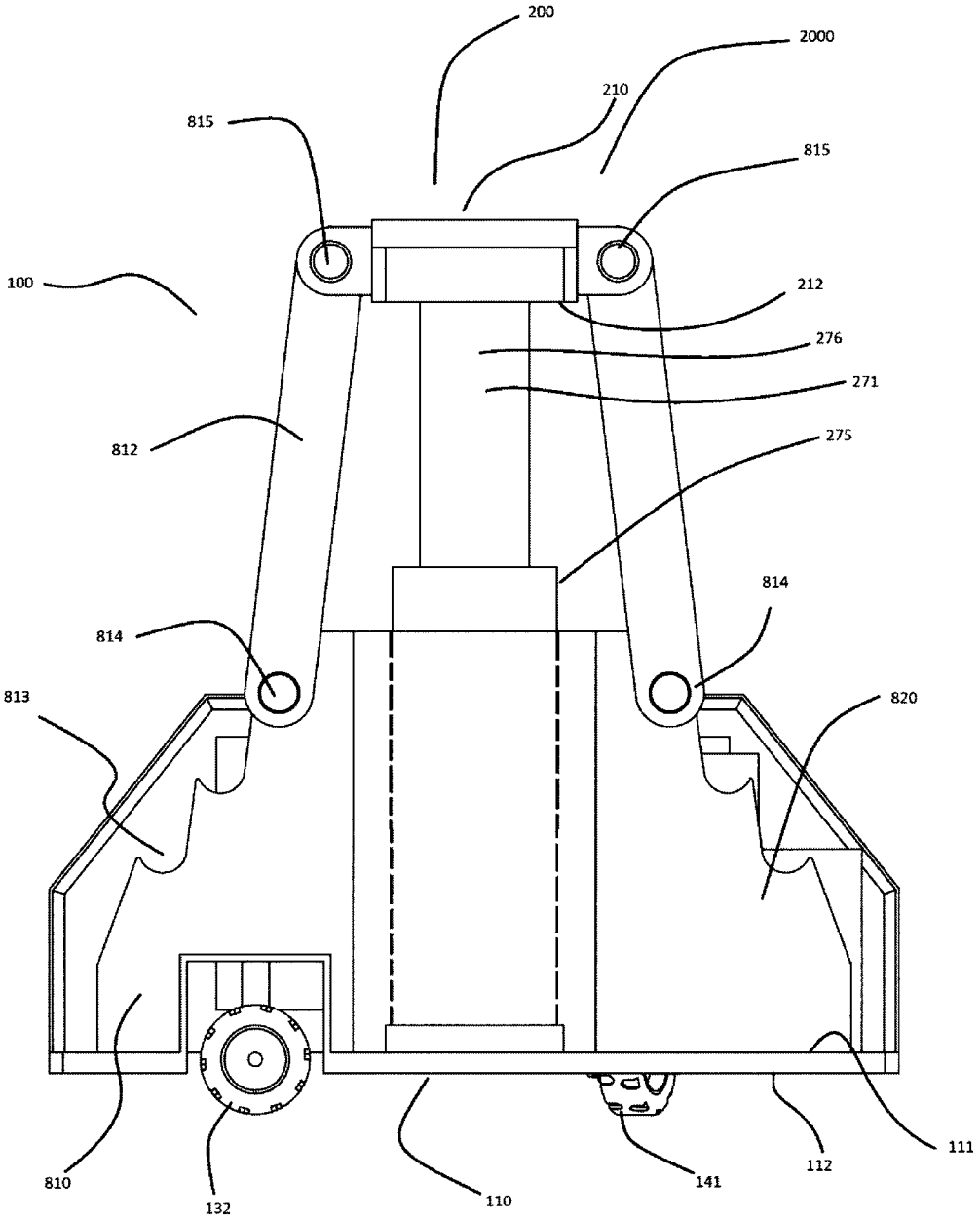
FIG. 84 is a right side view thereof.
Figure 85:
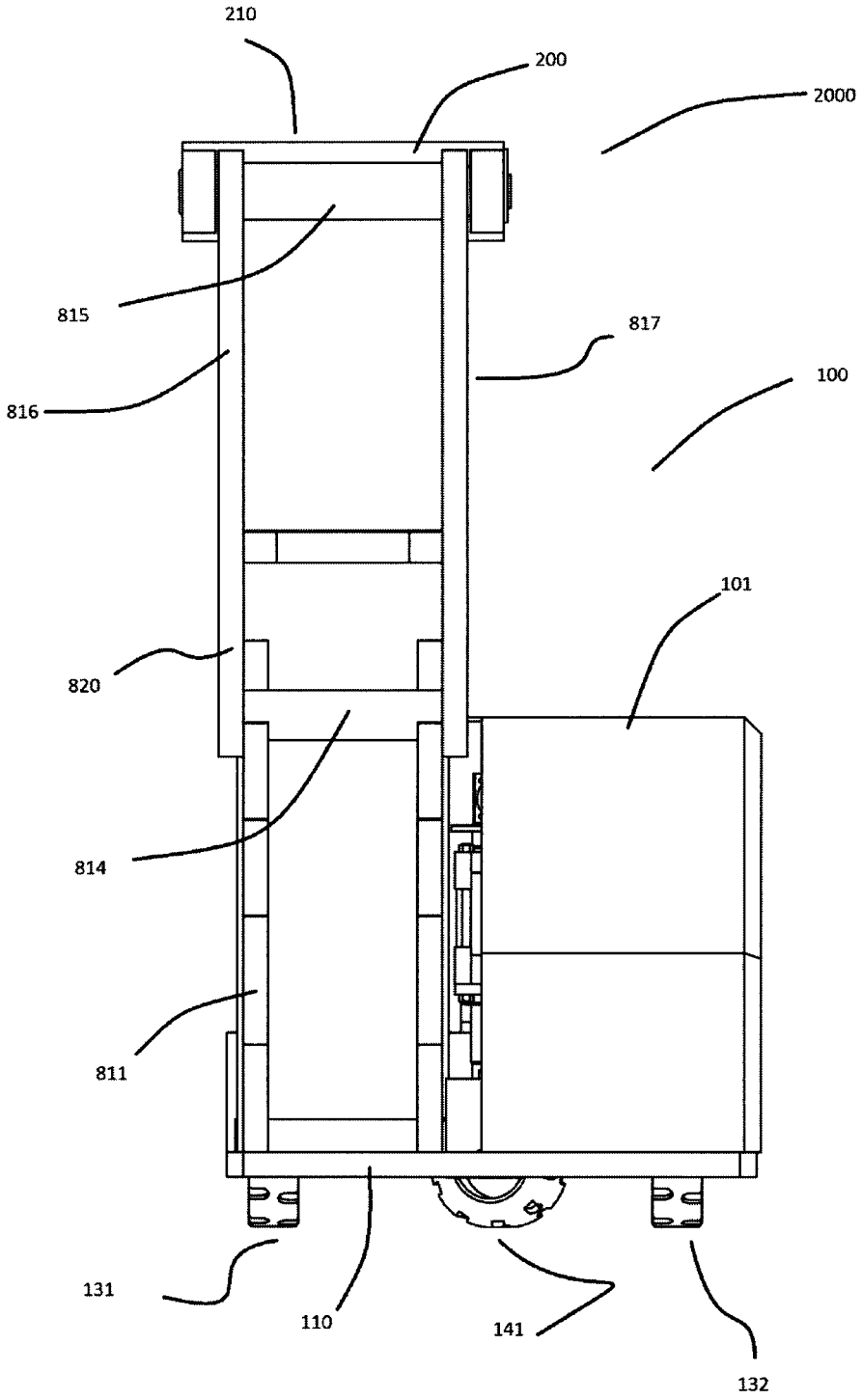
FIG. 85 is a rear view thereof.

FIG. 80 is a front perspective view illustrating a jack 100 with the top plate 210 thereof shown in a lowered position 1200 in accordance with another embodiment of the application. FIG. 81 is a right side view thereof. FIG. 82 is a rear view thereof. FIG. 83 is a front perspective view illustrating the jack 100 of FIG. 80 with the top plate 210 thereof shown in a raised position 2000. FIG. 84 is a right side view thereof. And, FIG. 85 is a rear view thereof.

According to one embodiment of the application, the jack 100 may include: a chassis, frame, or base plate 110 having an upper surface 111 and a lower surface 112; a main lifting assembly (or frame) 200 mounted on the upper surface 111 of the base plate 110; first and second front wheels 131, 132 mounted to the base plate 110 at the front end 150; and, at least one rear wheel 141 mounted to the base plate 110 at the rear end 160. As further described below, the jack 100 of this embodiment may include a single (or at least one) hydraulic lifting cylinder (or actuator) 271 mounted between the base plate 110 and the top plate 210. Note that the portion of the cylinder barrel end 275 of the hydraulic lifting cylinder 271 covered by the main lifting assembly 200 of the jack 100 is shown in broken lines in FIGS. 81 and 84.

According to one embodiment, the jack 100 may be self propelled and has mounted on its base plate 110 an electric motor (or optionally a diesel engine) 710 and battery 740 for powering the front wheels 131, 132 and the hydraulic lifting cylinder 271 of the main lifting assembly 200. The rear wheel 141 may provide for smooth 180 degree (or approximately 180 degree) rotational steering. According to one embodiment, the operation and positioning of the jack 100 is remotely controllable using a handheld remote control unit 8000 operated by an operator or worker.

According to one embodiment, the main lifting assembly 200 may include: a top plate 210 having an upper surface 211 and a lower surface 212, the top plate 210 positioned over and parallel or approximately parallel to the base plate 110; at least one hydraulic lifting cylinder 271 having a piston rod end 276 and a cylinder barrel end 275, the cylinder barrel end 275 of the lifting cylinder 271 may be mounted on the upper surface 111 of the base plate 110, the piston rod end 276 of the lifting cylinder 271 may be coupled (i.e., one or more of attached, connected, joined, bolted, welded, screwed, pinned, hinged, etc.) to the lower surface 212 of the top plate 210; and, first and second locking assemblies 810, 820. The upper surface 211 of the top plate 210 may be adapted for contacting one or more lifting points 1020, 1030 of a truck (or other load) 1000.

According to one embodiment, the lower surface 212 of the top plate 210 may be coupled to the piston rod end 276 of the at least one hydraulic lifting cylinder 271 via respective compact spherical bearing mounts 410 (as described above). According to one embodiment, the top plate 210 may have at least one adapter block 6100 (as described above) mounted thereon and adapted to contact the load 1000. According to one embodiment, the at least one hydraulic lifting cylinder 271 may be another type of actuator such as a pneumatic or electric actuator.

According to one embodiment, each of the first and second locking assemblies 810, 820 may have an inclined ratchet rack (or plate) 811, a locking bar 812, and a lock release assembly 850. The ratchet rack 811 may be a right-angled triangle (or approximately right-angled triangle) shaped gusset plate having a horizontal or approximately horizontal base, a vertical or approximately vertical side, and a hypotenuse or inclined side. The base of the ratchet rack 810 is mounted to the upper surface 111 of the base plate 110 proximate a side (e.g., the right side 170) of the base plate 110. The vertical side of the ratchet rack 810 may be mounted to the side (e.g., the front side) of the main lifting assembly (or frame) 200. The ratchet rack 811 may be built into or function as a gusset plate strengthening the connection of the main lifting assembly 200 to the base plate 110. The inclined side of the ratchet rack 811 has a number (e.g., three) of teeth or notches 813 formed therein for receiving a lower pin or roller 814 of the locking bar 812. The locking bar 812 may include first and second elongate plates or members 816, 817 that are coupled and spaced apart at a lower end 818 by the lower pin or roller 814 and at an upper end 819 by an upper pin or roller 815. The upper end 819 of the locking bar 812 is pin or hinge mounted (e.g., using the upper pin or roller 815) to the side (e.g., the front side) of the top plate 210 allowing the lower end 818 of the locking bar 812 to swing or rotate inwards toward the main lifting assembly 200 and outwards away from the main lifting assembly 200 by rotation about its pin or hinge.

Each locking assembly (e.g., 810) is gravity activated and the notches 813 on the inclined side of the ratchet rack 811 provides multiple (e.g., five for three notches) pre-set locking positions. Advantageously, as each locking assembly 810 is externally mounted on the jack 100, engagement of the locking bars 812 in the ratchet rack 811 remains fully visible to an operator located at a safe distance from the truck or load 1000.

Referring to FIGS. 80-82, when the top plate 210 of the jack 100 is in a lowered position 1200, for each locking assembly (e.g., 810), the roller 814 of the locking bar 812 is positioned below the lowest notch (e.g., the first notch) on the ratchet rack 811. Referring to FIGS. 83-85, as the top plate 210 is lifted to a fully raised position 2000, the roller 814 of the locking bar 812 rolls or slides up the ratchet rack 811 and is engaged with a higher notch 813 (e.g., the fifth notch) on the ratchet rack 811.

The notches 813 formed in the ratchet rack 811 are shaped or angled upward to allow the roller 814 of the locking bar 812 to travel upward over the notches 813 as the top plate 210 is lifted. Advantageously, the upward angling of the notches 813 prevents the roller 814 of the locking bar 812 from travelling downward over the notches 813 as the top plate 210 is lowered. In this way, gravity is used to lock the locking bars 812 in position to secure the raised truck or load 1000.

To allow the roller 814 of the locking bar 812 to travel downward over the notches 813 when the top plate 210 is lowered, each locking assembly (e.g., 810) is equipped with a lock release assembly 850 as shown in FIG. 25 and as described above.

In operation, the jack 100 with its top plate 210 in the lowered position 1200 is positioned under a lifting point (e.g., the rear lifting point 1020) of a truck 1000 by an operator using a remote control unit 8000. To lift the truck 1000, the upper surface 211 of the top plate 210 is brought into contact with the lifting point 1020 by moving the top plate 210 to a partially raised position under control of the operator using the remote control unit 8000. When moving from the jack's lowered position 1200 to its partially raised position, the piston rod of the at least one hydraulic lifting cylinder 271 is urged out of its cylinder barrel by fluid pressure causing the top plate 210 to be pushed upward to its partially raised position, and the rollers 814 of the locking bars 812 of each of the locking assemblies 810, 820 to be pulled up their respective ratchet racks 811 to engage respective notches 813 (e.g., the first or second notches) to lock the top plate 210 and truck 1000 in place.

Similarly, when moving from the jack's partially raised position to its raised position 2000, the piston rod of the at least one hydraulic lifting cylinder 271 is urged further out of its respective cylinder barrel by fluid pressure causing the top plate 210 to be pushed further upward to its raised position 2000, and the rollers 814 of the locking bars 812 of each of the locking assemblies 810, 820 to be pulled further up their respective ratchet racks 811 to engage respective notches 813 (e.g., the third notches) to the lock the top plate 210 and truck 1000 in place.

After maintenance on the truck 1000 has been performed, the truck 1000 is ready to be lowered. First, the lock release hydraulic cylinder 852 of each lock release assembly 850 is operated to move the lock release plate 851 from its retracted position 2510 to its extended position 2520 allowing the rollers 814 and their locking bars 812 to slide downward over the notches 813 in their respective ratchet racks 811. Second, when moving from the jack's raised position 2000 to its lowered position 1200, the piston rod of the at least one hydraulic lifting cylinder 271 is urged into its cylinder barrel by fluid pressure causing the top plate 210 to be pulled downward to its lowered positions 1200, and the unlocked locking bars 812 of each of the locking assemblies 810, 820 to be pushed down their respective ratchet racks 811 to their lowered positions.

According to one embodiment, at least one of the compact spherical bearing cylinder mount 410 and the adapter block 6100 may be optional. According to one embodiment, the at least one actuator 271 is directly (i.e., without intervening components, linkage arms, etc.) coupled (e.g., one or more of attached, connected, joined, bolted, welded, screwed, pinned, hinged, etc.) between the base plate 110 and the top plate 210. According to one embodiment, the at least one actuator 271 is coupled perpendicularly or approximately perpendicularly between the base plate 110 and the top plate 210.

Thus, according to another embodiment, there is provided a jack 100, comprising: a top plate 210 adapted to contact a load 1000; a base plate 110 positioned below the top plate 210; at least one actuator 271 coupled perpendicularly between the base plate 110 and the top plate 210; wherein the at least one actuator 271 is operable to move the top plate 210 between a lowered position 1200 and a raised position 2000 to thereby lower and raise the load 100; and, at least one locking assembly (e.g., 810) adapted to lock the top plate 210 in the raised position 2000; wherein the at least one locking assembly 810 includes a locking bar 812 and a ratchet rack 811, the locking bar 812 having an upper end 819 and a lower end 818, the locking bar 812 hinge mounted at the upper end 819 proximate to the top plate 210, the ratchet rack 811 inclining upward from the base plate 110 toward the top plate 210 and having at least one notch 813 formed therein, the at least one notch 813 adapted to receive and lock the lower end 818 of the locking bar 812, and the lower end 818 of the locking bar 812 slidable up the ratchet rack 811 and into the at least one notch 813 as the top plate 210 is moved from the lowered position 1200 to the raised position 2000.

In the above jack 100, the at least one locking assembly 810 may further include a lock release assembly 850 adapted to unlock the top plate 210 allowing the top plate 210 to be moved from the raised position 2000 to the lowered position 1200. The lock release assembly 850 may include a lock release plate 851 inclining upward from the base plate 110 toward the top plate 210, the lock release plate 851 moveable from a retracted position 2510 to an extended position 2520 to urge the lower end 818 of the locking bar 812 out of the at least one notch 813 allowing the lower end 818 of the locking bar 812 to slide down the ratchet rack 811 and over the at least one notch 813 as the top plate 210 is moved from the raised position 2000 to the lowered position 1200. The locking bar 812, the ratchet rack 811, and the at least one notch 813 may be mounted to be visible. The at least one locking assembly 810 may be two locking assemblies 810, 820. The at least one notch may be three notches. The jack 100 may further include a remote control unit 8000 for remotely controlling operations of the jack 100. The jack 100 may further include a pair of front wheels 131, 132 mounted proximate to a front end 150 of the base plate 110 and at least one rear wheel 141 mounted proximate to a rear end 160 of the base plate 110. The jack 100 may further include a battery 740 mounted on the base plate 110 for providing power to components of the jack 100. The jack 100 may be remotely controllable. The load may be a truck 1000. And, the at least one actuator 271 may be at least one hydraulic cylinder 271.

The above embodiments may contribute to an improved telescoping jack 100 for lifting large capacity trucks 1000 and may provide one or more advantages. First, the jack 100 may be used on trucks made by multiple manufacturers such as Caterpillar™, Komatsu™, and Liebherr™ and may accommodate their proprietary specifications such as lifting points, lifting methods, and height restrictions. Second, the jack 100 may be used on trucks of different physical sizes as it has a width that may fit under the smallest truck but yet still may balance the load of the largest truck. This reduces the need for two or more different jacks to handle differently sized trucks and hence provides for cost savings. Third, the jack 100 conforms to mine specific, country specific, and culture specific safety protocols while accommodating any custom aftermarket "add-ons" to the trucks provided by the above-mentioned truck manufacturers. Fourth, the jack 100 may be used in high altitude applications. Fifth, the jack 100 fits under the front of most trucks to reach the manufacturer's certified lifting points. Sixth, the jack 100 has sufficient working stroke to lift the front tires of a truck off the ground. Seventh, the jack 100 requires only a single lift or operation to lift the front or rear end of a truck. Eighth, the jack 100 does not require the use of a separate safety stand or other means required by existing "double lift" jacks. Ninth, the jack 100 may complete a two-point lift in approximately 10 minutes. Tenth, at approximately 7 tons and with approximately 72 square feet of ground contact with the wheels 131, 132, 141, 142 retracted, the jack 100 acts as effective safety stand and requires no additional safety stands. Eleventh, the jack 100 may be used as a multi-lifting device for lifting skid plates, undercarriage components, and the like. Twelfth, the jack 100 is user friendly and its remote control unit 8000 reduces or eliminates the risk of operator injury. Thirteenth, the jack 100 is designed to lift at O.E.M. recommended truck lifting points 1020, 1030 and provides for easy front and rear access under a truck 1000. Fourteenth, using the jack 100 of the present application, a mining operation improve per truck utilization by up to 815 hours in a 48-month period. Fifteenth, the jack 100 has a low profile with an overall collapsed height of approximately 33 inches while still achieving a very difficult linear lifting stroke of approximately 30 inches without using a scissor lift (the jack 100 not being of the scissor lift type) or telescoping hydraulic cylinders. And, sixteenth, the jack 100 has multiple pre-set position (e.g., five, seven, etc.) gravity activated secondary mechanical locking assemblies 810, 820, 830, 840 that provide a visual indication of load locking to an operator from a safe working distance.

The embodiments of the application described above are intended to be exemplary only. Those skilled in this art will understand that various modifications of detail may be made to these embodiments, all of which come within the scope of the application.

What is claimed is:

1. A jack, comprising:

a top plate having at least one adapter block mounted thereon and adapted to contact a load;

a base plate positioned below the top plate;

the top plate movable between a lowered position and a raised position to thereby lower and raise the load; and, at least one locking assembly adapted to lock the top plate in the raised position; wherein the at least one locking assembly includes a locking bar and a ratchet rack, the locking bar having an upper end and a lower end, the locking bar hinge mounted at the upper end proximate to the top plate, the ratchet rack inclining upward at an acute angle from the base plate toward the top plate and having at least one notch formed therein, the at least one notch adapted to receive and lock the lower end of the locking bar, and the lower end of the locking bar slidable up the ratchet rack and into the at least one notch as the top plate is moved from the lowered position to the raised position;

wherein the ratchet rack is stationarily attached to the base plate; and, wherein a top adapter plate of the at least one adapter block is operable to slide between first and second positions on the top plate as the load is raised and lowered to thereby maintain alignment of the top and base plates below the load.

2. The jack of claim 1, wherein the at least one locking assembly further includes a lock release assembly adapted to unlock the top plate allowing the top plate to be moved from the raised position to the lowered position.

3. The jack of claim 2, wherein the lock release assembly includes a lock release plate inclining upward from the base plate toward the top plate, the lock release plate moveable from a retracted position to an extended position to urge the lower end of the locking bar out of the at least one notch allowing the lower end of the locking bar to slide down the ratchet rack and over the at least one notch as the top plate is moved from the raised position to the lowered position.

4. The jack of claim 3, wherein the locking bar, the ratchet rack, and the at least one notch are mounted to be visible.

5. The jack of claim 1, wherein the at least one locking assembly is two locking assemblies.

6. The jack of claim 1, wherein the at least one notch is three notches.

7. The jack of claim 1, further comprising a remote control unit for remotely controlling operations of the jack.

8. The jack of claim 1, further comprising a pair of front wheels mounted proximate to a front end of the base plate and at least one rear wheel mounted proximate to a rear end of the base plate.

9. The jack of claim 1, further comprising a battery mounted on the base plate for providing power to components of the jack.

10. The jack of claim 1, wherein the jack is remotely controllable.

11. The jack of claim 1, wherein the load is a truck.

12. The jack of claim 1, wherein the at least one adapter block includes a bottom adapter plate attached to the top plate of the jack and to which the top adapter plate is slidably attached; and, wherein the top adapter plate is slidably attached to the bottom adapter plate by a pair of alignment rods passing through respective alignment blocks mounted on either side of the bottom adapter plate, the alignment rods being attached to front and rear ends of the top adapter plate through respective rubber springs.

13. A locking assembly for a jack, the jack having a top plate adapted to contact a load, a base plate positioned below the top plate, and the top plate movable between a lowered position and a raised position to lower and raise the load, the locking assembly comprising:

a ratchet rack, the ratchet rack inclining upward at an acute angle from the base plate toward the top plate and having at least one notch formed therein; and, a locking bar, the locking bar having an upper end and a lower end, the locking bar hinge mounted at the upper end proximate to the top plate;

wherein the at least one notch is adapted to receive and lock the lower end of the locking bar, the lower end of the locking bar slidable up the ratchet rack and into the at least one notch as the top plate is moved from the lowered position to the raised position to thereby lock the top plate in the raised position;

wherein the racket rack is stationarily attached to the base plate.

14. The locking assembly of claim 13, further comprising a lock release assembly adapted to unlock the top plate allowing the top plate to be moved from the raised position to the lowered position.

15. The locking assembly of claim 14, wherein the lock release assembly includes a lock release plate inclining upward from the base plate toward the top plate, the lock release plate moveable from a retracted position to an extended position to urge the lower end of the locking bar out of the at least one notch allowing the lower end of the locking bar to slide down the ratchet rack and over the at least one notch as the top plate is moved from the raised position to the lowered position.

16. The locking assembly of claim 15, wherein the locking bar, the ratchet rack, and the at least one notch are mounted to be visible.

17. The locking assembly of claim 13, wherein the at least one notch is three notches.

18. The locking assembly of claim 13, wherein the jack includes at least two locking assemblies.

19. The locking assembly of claim 13, wherein the load is a truck.

20. The locking assembly of claim 13, wherein the top plate has at least one adapter block mounted thereon;

wherein a top adapter plate of the at least one adapter block is operable to slide between first and second positions on the top plate as the load is raised and lowered to thereby maintain alignment of the top and base plates below the load; wherein the at least one adapter block includes a bottom adapter plate attached to the top plate of the jack and to which the top adapter plate is slidably attached; and, wherein the top adapter plate is slidably attached to the bottom adapter plate by a pair of alignment rods passing through respective alignment blocks mounted on either side of the bottom adapter plate, the alignment rods being attached to front and rear ends of the top adapter plate through respective rubber springs.

* * * * *